US007160125B1

(12) United States Patent
Teicher

(10) Patent No.: US 7,160,125 B1
(45) Date of Patent: Jan. 9, 2007

(54) REVERSIBLE UNIVERSAL SERIAL BUS (USB) DEVICE AND CONNECTOR

(75) Inventor: Mordechai Teicher, Hod Hasharon (IL)

(73) Assignee: msystems Ltd., Kfar Saba (IL)

( * ) Notice: Subject to any disclaimer, the term of this patent is extended or adjusted under 35 U.S.C. 154(b) by 0 days.

(21) Appl. No.: 11/477,441

(22) Filed: Jun. 30, 2006

Related U.S. Application Data

(63) Continuation of application No. 11/185,771, filed on Jul. 21, 2005, now Pat. No. 7,094,086.

(60) Provisional application No. 60/592,517, filed on Aug. 2, 2004.

(51) Int. Cl.
*H01R 29/00* (2006.01)

(52) U.S. Cl. ..... 439/173; 439/218; 439/53; 439/954

(58) Field of Classification Search ..... 439/173, 439/53, 217–218, 954
See application file for complete search history.

(56) References Cited

U.S. PATENT DOCUMENTS 6,257,930 B1 * 7/2001 Yu ..... 439/607
6,394,813 B1 * 5/2002 Stout et al. ..... 439/11
6,490,163 B1 * 12/2002 Pua et al. ..... 361/737
6,544,058 B1 * 4/2003 Chang ..... 439/173
6,733,329 B1 * 5/2004 Yang ..... 439/518
6,948,983 B1 * 9/2005 Peng ..... 439/660
6,981,887 B1 * 1/2006 Mese et al. ..... 439/244
2003/0171035 A1 * 9/2003 Yoo ..... 439/638
2005/0042930 A1 * 2/2005 Harkabi et al. ..... 439/660

* cited by examiner

*Primary Examiner*—Truc Nguyen
(74) *Attorney, Agent, or Firm*—Mark M. Friedman

(57) ABSTRACT

A reversible connector for coupling with a USB A-type standard connector, including a first set of four electrical contacts deployed on a first slidingly retractable block and a second set of four electrical contacts deployed on a second slidingly retractable block, the contacts configured such that in a first coupling orientation of the reversible connector with the standard connector, the second block retracts so that only the first set of electrical contacts is mechanically connected with the contacts of the standard connector and in a second coupling orientation of the reversible connector with the standard connector, the first block retracts so that only the second set of electrical contacts is mechanically connected with the contacts of the standard connector.

13 Claims, 49 Drawing Sheets

90

184

REVERSIBLE UNIVERSAL SERIAL BUS (USB) DEVICE AND CONNECTOR

This application is a continuation of U.S. patent application Ser. No. 11/185,771 filed Jul. 21, 2005, now U.S. Pat. No. 7,094,086 which in turn claims the benefit of U.S. Provisional Patent Application No. 60/592,517 filed Aug. 2, 2004.

FIELD AND BACKGROUND OF THE INVENTION

The present invention relates to Universal Serial Bus (USB) devices, and, in particular, it concerns USB devices for reversible coupling with USB hosts. The invention further relates to reversible USB connectors.

By way of introduction, a standard USB plug can only be inserted into a standard USB receptacle in one of two possible orientations. Therefore, if the USB plug is orientated incorrectly in relation to the USB receptacle, the plug and receptacle cannot be coupled. As there is no standard for the positioning of a USB receptacle on a device, the user will often attempt to insert the plug into a receptacle in an incorrect orientation. In a situation in which a USB plug is frequently inserted and removed from a USB receptacle, such errors may become a significant inconvenience for the user. Also, many USB devices have a USB plug which extends directly from the body of the USB device. When such a USB device is connected to a USB receptacle of a host appliance that has another port, the USB device frequently blocks access to the other port of the host and prevents other USB devices from being connected to the host appliance. Where the body of the USB device is asymmetric, i.e., the USB plug is positioned asymmetrically in relation to the sides of the USB device, insertion in a first orientation may block the neighboring port, whereas if it were possible to insert the device in an inverted orientation the insertion would not block the neighboring port. Also, in the case of a USB device that has an asymmetric body, insertion in a first orientation may not be possible due to the combined structure of the device and the host appliance, whereas if it were possible to insert the device in a different orientation the insertion could become possible.

Of relevance to the present invention is U.S. Pat. No. 6,394,813 to Stout, et al. Stout, et al. teaches a USB connector adapter connected to a peripheral device. The adapter is adjustable so as to allow selective reorientation of the peripheral device with respect to a host device. A shortcoming of the aforementioned system is due the need of ensuring that the adapter is always inserted into the USB connector of the host device in the same orientation.

Also of relevance to the present invention is U.S. Pat. No. 6,733,329 to Yang. Yang teaches a interchangeable USB adapter connected to a peripheral device. The USB adapter is configured for being interchangeable between an A-type USB connector, a B-type USB connector and a mini type USB connector. A shortcoming of the aforementioned system is due the need of ensuring that the adapter is always inserted into the USB connector of the host device in the same orientation. A further shortcoming of the aforementioned system is that the peripheral device has to have the same orientation with respect to the host device when connected therewith.

Also of relevance to the present invention is U.S. Publication No. 2003/0171035 to Yoo. Yoo teaches a USB peripheral device having a printed circuit board having electrical terminals on both sides of the printed circuit board.

Yoo also teaches an adapter having a standard USB plug at one end and a slit at the other end having terminals thereon. The USB peripheral device is then connected to the adapter by inserting the printed circuit board into the slit of the adapter. The printed circuit board can be inserting into the slit in two orientations. A shortcoming of the aforementioned system is due the need of ensuring that the adapter is always inserted into the USB connector of the host device in the same orientation. An additional shortcoming of the aforementioned system is that the system is not convenient to use. A further shortcoming of the aforementioned system is that the printed circuit board needs to be specially designed to incorporate the reversibility feature.

There is therefore a need for a reliable, easy-to-use and reversible USB plug that can be connected to a standard USB receptacle in two orientations without having to adjust the plug prior to, during or after connection. Additionally, there is a need for a reliable, easy-to-use and reversible USB receptacle that can be connected to a standard USB plug in two orientations without having to adjust the plug prior to, during or after connection. Furthermore, there is a need for a reversible device for connecting in two orientations to an appliance which includes a standard USB receptacle without having to adjust the device prior to, during or after connection.

SUMMARY OF THE INVENTION

The present invention is a reversible USB device and a corresponding connector construction.

According to the teachings of the present invention there is provided, a reversible connector for coupling with a USB A-type standard connector, the standard connector having a hollow section, a fixed set of four electrical contacts disposed on one side of the hollow section and an electrically conducting shield disposed on three sides of the hollow section, the reversible connector comprising: (a) a first block having a first set of four electrical contacts deployed for mechanical connection to the set of electrical contacts of the standard connector when the reversible connector is in a first coupling orientation relative to the standard connector; (b) a second block having a second set of four electrical contacts deployed for mechanical connection to the set of electrical contacts of the standard connector when the reversible connector is in a second coupling orientation relative to the standard connector; wherein the first and second blocks are slidably mounted adjacent to each other and configured for independently sliding between an operative position and a retracted position such that, when the reversible connector is engaged with the standard connector in the first coupling orientation, the second block slides to the retracted position and the first block assumes the operative position for insertion into the hollow section of the standard connector, and when the reversible connector is engaged with the standard connector in the second coupling orientation, the first block slides to the retracted position and the second block assumes the operative position for insertion into the hollow section of the standard connector.

According to a further feature of the present invention, the reversible connector is a plug and the standard connector is a USB A-type receptacle.

According to a further feature of the present invention, the reversible connector is a receptacle and the standard connector is a USB A-type plug.

According to a further feature of the present invention, there is also provided a conductive sleeve, wherein the first and second blocks are slidingly mounted within the sleeve.

According to a further feature of the present invention, there is also provided a restoring arrangement configured for restoring the blocks to the operative position.

According to a further feature of the present invention, the restoring arrangement includes two helical springs, the blocks having a width and a thickness, each of the helical springs having an outside diameter greater than the thickness.

According to a further feature of the present invention, each of the blocks include a plurality of grooves, the first set of electrical contacts and the second set of electrical contacts being recessed in the grooves.

According to a further feature of the present invention, there is also provided a housing having a set of electrical terminals disposed therein, the set of electrical terminals and the first set of electrical contacts being configured such that: (a) the set of electrical terminals makes electrical contact with the first set of electrical contacts when the first block is in the operative position; and (b) the set of electrical terminals is electrically isolated from the first set of electrical contacts when the first block is in the retracted position.

According to a further feature of the present invention, there is also provided a contact raising arrangement configured for: (a) raising the first set of contacts away from the first block in the first coupling orientation, so that the first set of contacts makes mechanical contact with the set of electrical contacts of the standard connector; and (b) raising the second set of contacts away from the second block in the second coupling orientation, so that the second set of contacts makes mechanical contact with the set of electrical contacts of the standard connector.

According to a further feature of the present invention, there is also provided a first lever arrangement and a second lever arrangement, the first lever arrangement being mechanically connected to the first set of contacts, the second lever arrangement being mechanically connected to the second set of contacts, the first lever arrangement and the second lever arrangement being configured to raise the first set of contacts and the second set of contacts, respectively, in response to actuation by the standard connector.

According to a further feature of the present invention, the first block has at least one groove therein configured to accommodate at least part of the first lever arrangement during relative movement of the first block and the second block, and wherein the second block has at least one groove therein configured to accommodate at least part of the second lever arrangement during relative movement of the first block and the second block.

There is also provided according to the teachings of the present invention, a reversible plug for coupling with a USB A-type standard receptacle, the standard receptacle having a hollow section, a fixed set of four electrical contacts disposed on one side of the hollow section and an electrically conducting shield disposed on three sides of the hollow section, the reversible plug comprising: (a) a first block having a first set of four electrical contacts deployed for mechanical connection to the set of electrical contacts of the standard receptacle when the reversible plug is in a first coupling orientation relative to the standard receptacle; (b) a second block having a second set of four electrical contacts deployed for mechanical connection to the set of electrical contacts of the standard receptacle when the reversible plug is in a second coupling orientation relative to the standard receptacle; wherein the first and second blocks are slidably mounted adjacent to each other and configured for independently sliding between an operative position and a retracted position such that, when the reversible plug is engaged with the standard receptacle in the first coupling orientation, the second block slides to the retracted position and the first block assumes the operative position for insertion into the hollow section of the standard receptacle, and when the reversible plug is engaged with the standard receptacle in the second coupling orientation, the first block slides to the retracted position and the second block assumes the operative position for insertion into the hollow section of the standard receptacle.

There is also provided according to the teachings of the present invention, a reversible receptacle for coupling with a USB A-type standard plug, the standard plug having a hollow section, a fixed set of four electrical contacts disposed on one side of the hollow section and an electrically conducting shield disposed on three sides of the hollow section, the reversible receptacle comprising: (a) a first block having a first set of four electrical contacts deployed for mechanical connection to the set of electrical contacts of the standard plug when the reversible receptacle is in a first coupling orientation relative to the standard plug; (b) a second block having a second set of four electrical contacts deployed for mechanical connection to the set of electrical contacts of the standard plug when the reversible receptacle is in a second coupling orientation relative to the standard plug; wherein the first and second blocks are slidably mounted adjacent to each other and configured for independently sliding between an operative position and a retracted position such that, when the reversible receptacle is engaged with the standard plug in the first coupling orientation, the second block slides to the retracted position and the first block assumes the operative position for insertion into the hollow section of the standard plug, and when the reversible receptacle is engaged with the standard plug in the second coupling orientation, the first block slides to the retracted position and the second block assumes the operative position for insertion into the hollow section of the standard plug.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
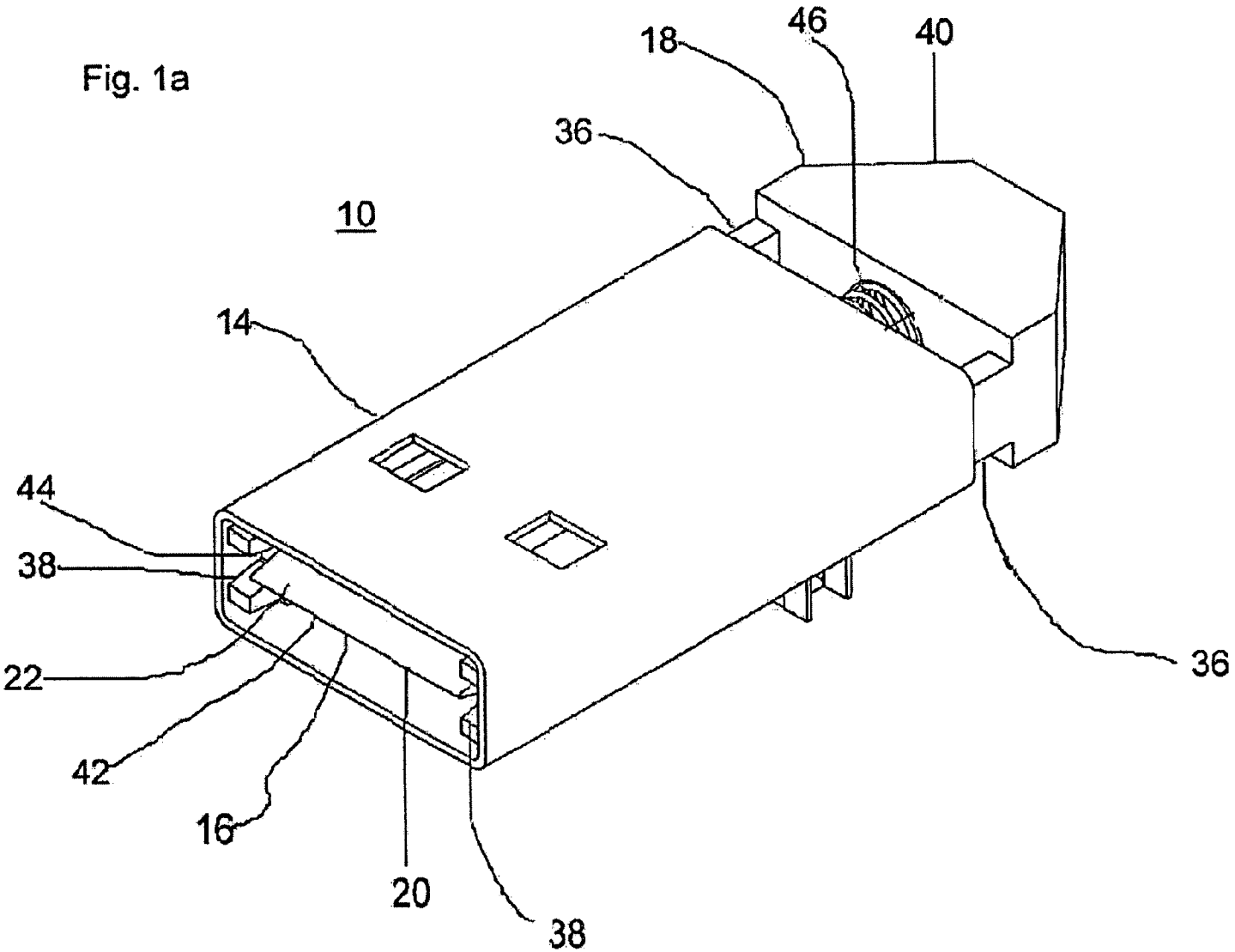
FIG. 1*a* is an isometric view of a reversible plug that is constructed and operable in accordance with a preferred embodiment of the present invention.

The present invention is a reversible USB connector construction and method of operation thereof.

The principles and operation of a reversible USB connector according to the present invention may be better understood with reference to the drawings and the accompanying description.

By way of introduction, the present invention teaches a reversible USB connector for connection with a standard A-type USB connector. The reversible connector is configured for engagement with the standard connector interchangeably in each of two orientations. Thus the reversible connector can mate with the standard connector in a first orientation, the connectors can be disconnected, one of the connectors can be rotated through 180 degrees and the connectors can then mate again without having to reconfigure or otherwise adjust the reversible connector. The term "connector" is defined herein to include both plugs and receptacles. An A-type USB standard connector is defined herein as a connector which conforms to USB standards without any modification to render it reversible. These standards are well defined in the art, and are standardized by the Universal Serial Bus Implementers Forum (USB-IF). This invention further teaches a reversible USB device. The phrase "USB device" is defined herein to include any device that is programmed or otherwise configured to perform a function and which includes a body attached to or integrally formed with a USB plug. The reversible USB devices of the present invention include a reversible USB plug such that the user can hold the body of the reversible device and engage it with a standard USB receptacle in either of two orientations. Finally, the invention further teaches a reversible USB appliance. The phrase "USB appliance" is defined herein to include any device that is programmed or otherwise configured to perform a function and which includes a body attached to or integrally formed with a USB receptacle. The reversible USB appliances of the present invention include a reversible USB receptacle (socket) such that the user can hold a standard USB device and engage it with the reversible USB receptacle of the appliance in either of two orientations.

Before turning to the specific implementations of the invention illustrated in the drawings, it will be helpful to present a conceptual description of the invention common to all of the embodiments described below. Thus, in general terms, the present invention provides a reversible connector (plug or receptacle) for coupling with a USB A-type standard connector (receptacle or plug), the standard connector having a hollow section, a fixed set of four electrical contacts disposed on one side of the hollow section and an electrically conducting shield disposed on three sides of the hollow section. The reversible connector of the present invention includes a first set of four electrical contact regions and a second set of four electrical contact regions. The first and second sets of electrical contact regions are configured such that, in a first coupling orientation of the reversible connector with the standard connector, the first set of electrical contact regions is mechanically connected with the set of electrical contacts of the standard connector and the second set is mechanically disconnected from the set of electrical contacts of the standard connector. The sets of contacts are further configured such that, in an alternative second coupling orientation of the reversible connector with the standard connector, the second set of electrical contact regions is mechanically connected with the set of electrical contacts of the standard connector and the first set is mechanically disconnected from the set of electrical contacts of the standard connector.

There are many possible mechanical solutions for implementing the underlying reversible connector concept of the present invention, all of which fall within the general scope of the present invention. By way of non-limiting examples, the invention will be exemplified below with reference to a small number of specific preferred examples. In some of these examples, the two sets of contacts are deployed on opposing sides of a single interface element so that one set of contacts is correctly oriented independent of the orientation of the interface element. The interface element may be a movable or flexible tongue or may be a rigid block. In other exemplary implementations described below, each set of contacts is deployed on a separate block and the blocks are selectively retractable to allow the appropriately oriented block to form the required connections. These options will be described in detail below.

For each implementation, correct connection of each set of contacts with the associated electronics of a USB device or appliance may be achieved in any or a large number of ways which will be clear to one ordinarily skilled in the art. By way of non-limiting examples, reference will be made below to three particular preferred connectivity options as follows: in a first option, an electronic switching arrangement is used to automatically switch between connections between the two sets of contacts; alternatively, a crossover arrangement of electrical contacts is used to connect both sets of contacts to a PCB in parallel; finally, a further option employs a modified PCB with eight separate input contacts, wherein the required connections may be achieved internally with or without switching. These options will be illustrated below. It should be noted, however, that the different options are interchangeable between the various embodiments described.

Ten embodiments of a reversible connector are described below. The first five embodiments, described with reference to FIGS. 1*a* to 4*g*, describe a reversible plug for connection to an A-type USB standard receptacle. The final five embodiments, described with reference to FIGS. 5*a* to 8*g*, describe a reversible receptacle for connection to an A-type USB standard plug. The overall resulting functionality of a reversible USB device, generic to the plug embodiments of FIGS. 1*a*–4*g*, is described with reference to FIGS. 9*a*–9*h*. Finally, an appliance containing a USB reversible receptacle, generic to the receptacle embodiments of FIGS. 5*a*–8*g*, is described with reference to FIG. 10.

It should be noted that, while the present description and the attached claims refer specifically to a reversible connector for connection to an A-type USB standard connector, this terminology should be interpreted by equivalents to encompass other existing or future connectors, having different standards but similar design considerations, for connecting two devices.

Figure 1B:
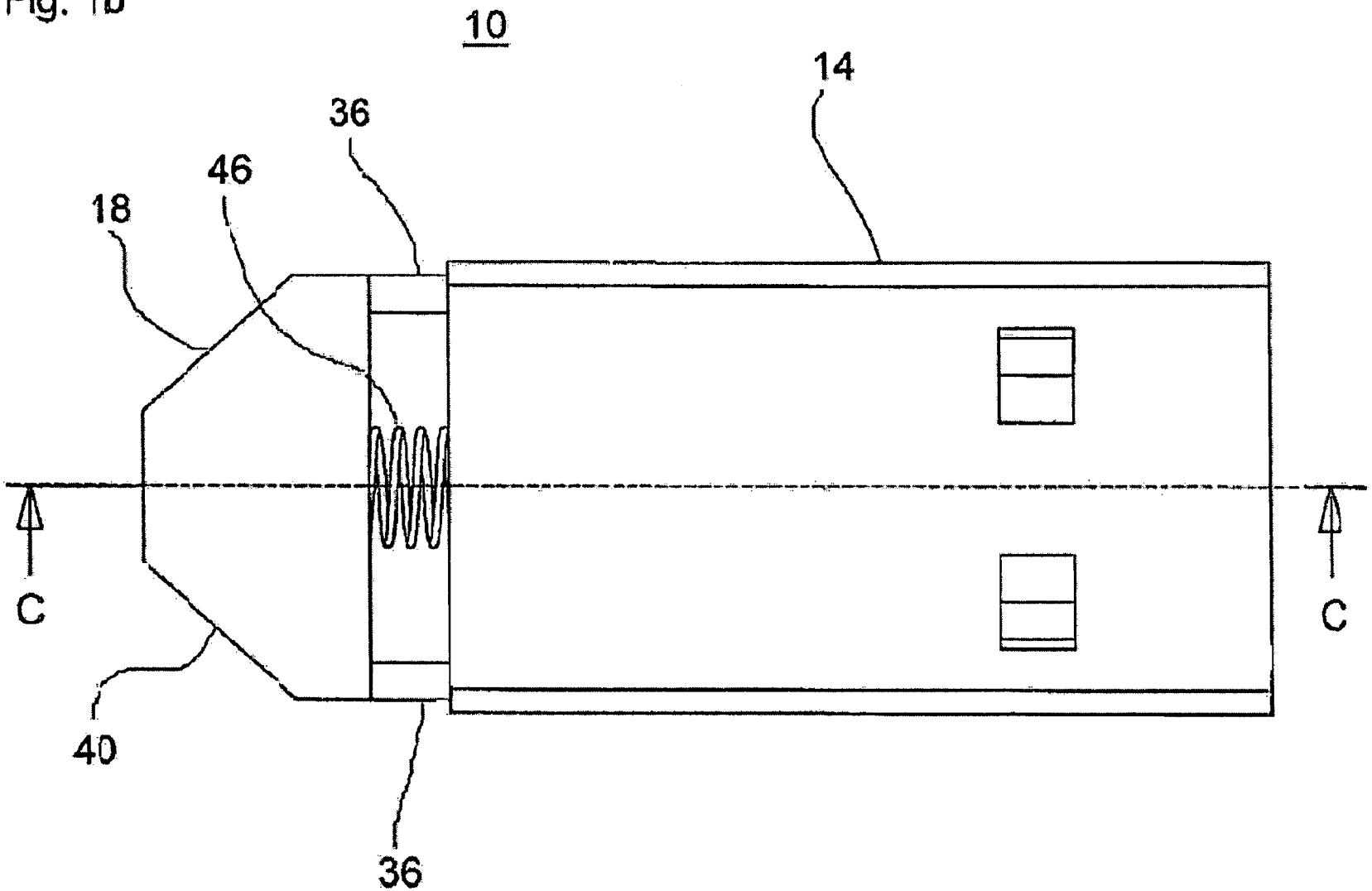
FIG. 1*b* is a plan view of the plug of FIG. 1*a;*
Figure 1C:
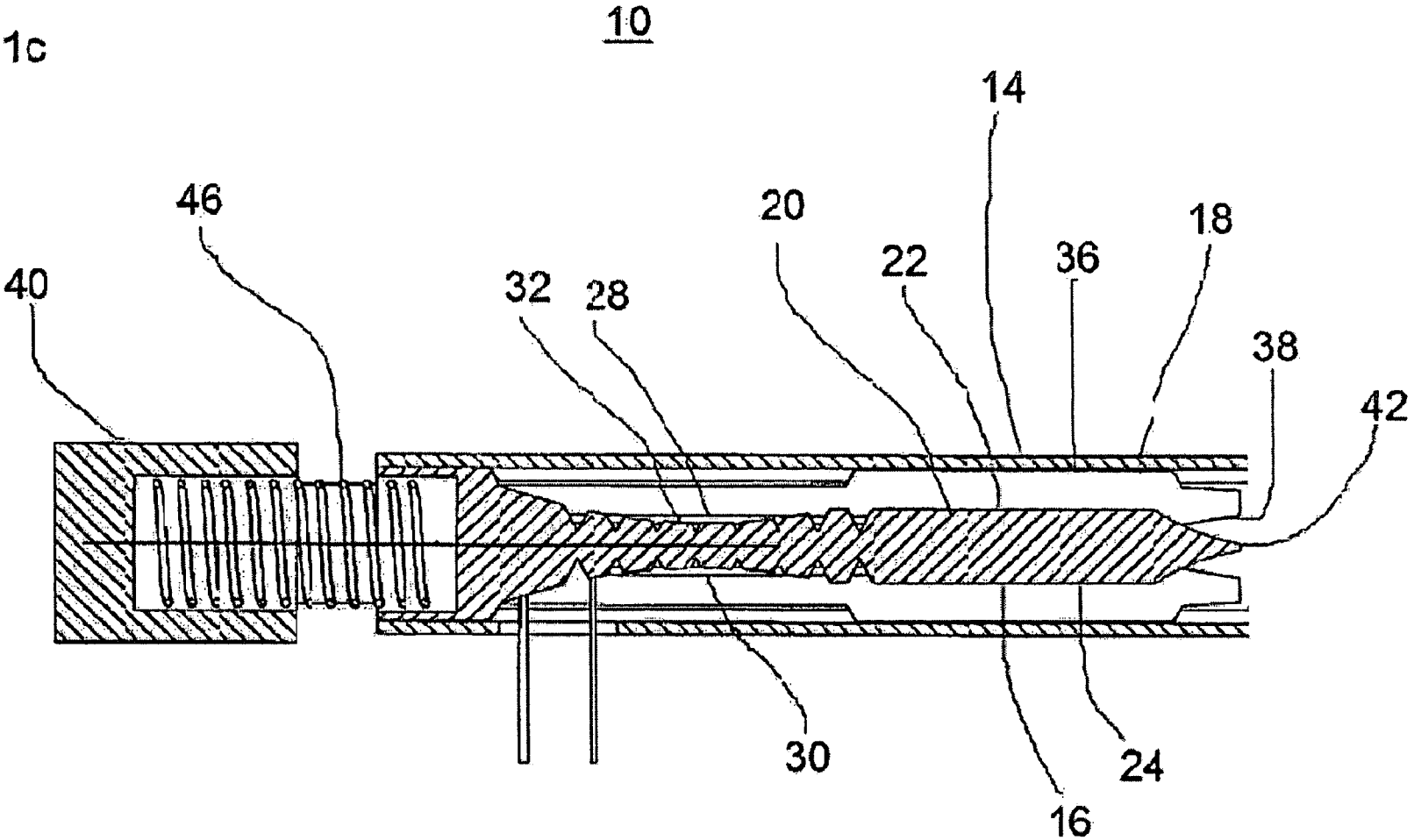
FIG. 1*c* is a sectional view through the line C—C of FIG. 1*b;*
Figure 1D:
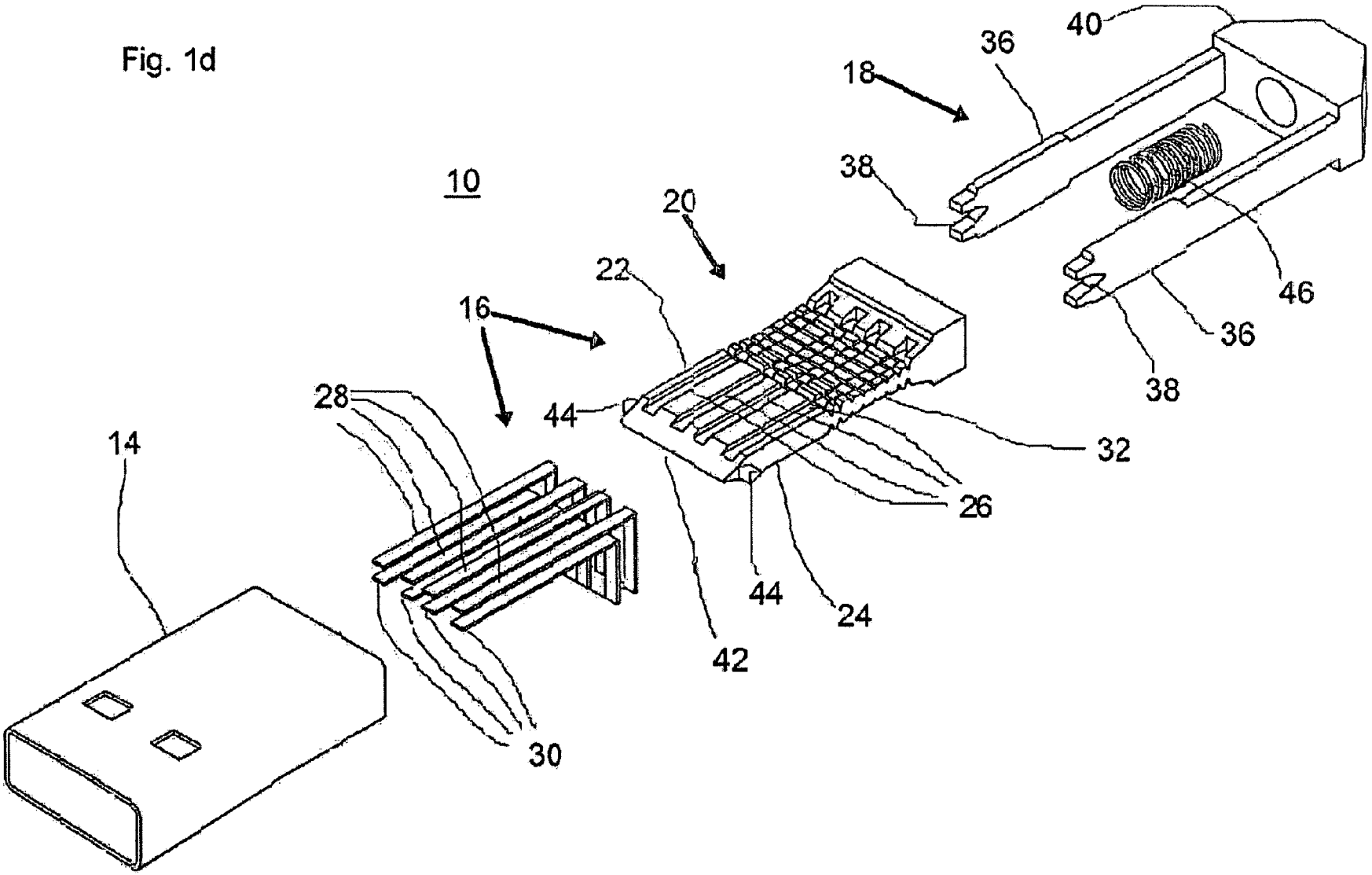
FIG. 1*d* is an exploded isometric view of the plug of FIG. 1*a;*

Reference is now made to FIGS. 1*a*–*d*. FIG. 1*a* is an isometric view of a reversible plug 10 that is constructed and operable in accordance with a preferred embodiment of the present invention. FIG. 1*b* is a plan view of reversible plug 10 of FIG. 1*a*. FIG. 1*c* is a sectional view through the line C—C of FIG. 1*b*. FIG. 1*d* is an exploded isometric view of reversible plug 10 of FIG. 1*a*. Reversible plug 10 has a sleeve 14, a tongue arrangement 16 and a centering mechanism 18. The phrase "tongue arrangement" as used herein in the description and claims refers to a generally flat arrangement (i.e., having two dimensions, "length" and "width", significantly greater than a third "thickness" dimension) which is movable, at least under certain conditions, in a direction generally parallel to its thickness dimension, i.e., roughly perpendicular to its two larger dimensions. The dimensions referred to are the outer dimensions of the arrangement which may itself be an open structure with internal spaces as illustrated below in FIGS. 2*a*–2*f*, 2*h*–2*m* and 6*a*–6*i*, or a solid structure as illustrated here in FIGS. 1*a*–1*d* and below in FIGS. 5*a*–5*e*. The movement of the tongue arrangement or part thereof may be a roughly parallel motion, or may be a flexing motion achieved through the flexibility of the tongue arrangement itself or a pivotal movement about an effective pivot axis.

Sleeve 14 is an electrically conducting shield configured to mate with the standard shielding configuration of a USB receptacle, and thus has four generally rectangular sides. Tongue arrangement 16 is initially centrally disposed in sleeve 14. Tongue arrangement 16 includes a central insulating layer 20. Central insulating layer 20 has an upper major side 22 and a lower major side 24. It should be noted that, as reversible plug 10 is reversible, upper major side 22 may become the lower major side and lower major side 24 may become the upper major side. Nevertheless, the non-limiting terminology of "upper" and "lower" has been adopted for clarity of presentation in order to explain the present invention with reference to the drawings. Upper major side 22 has four grooves 26 therein. Similarly, lower major side 24 has four grooves (not shown) therein. Reversible plug 10 includes an upper set of electrical contact regions 28 recessed in grooves 26 of upper major side 22. Similarly, reversible plug 10 includes a lower set of electrical contact regions 30 recessed in the grooves of lower major side 24. Electrical contact regions 28 are electrically isolated from electrical contact regions 30 by central insulating layer 20. Tongue arrangement 16 includes a bendable portion 32. Bendable portion 32 enables tongue arrangement 16 to move up or down when coupled with a USB receptacle, as will be described below with reference to FIGS. 1*e* and 1*f*. Bendable portion 32 is typically a flexible element. However, it will be appreciated by those ordinarily skilled in the art that bendable portion 32 can also be a hinge or similar member.

Tongue arrangement 16 is preferably formed so as to center by itself elastically when not coupled with a USB receptacle. Nevertheless in order to ensure that tongue arrangement 16 is always centered within sleeve 14 prior to insertion into a USB receptacle, reversible plug 10 preferably also includes a centering mechanism 18 configured for maintaining tongue arrangement 16 centrally within sleeve 14. Centering mechanism 18 will be described in more detail with reference to FIGS. 1*e* and 1*f*.

Figure 1E:
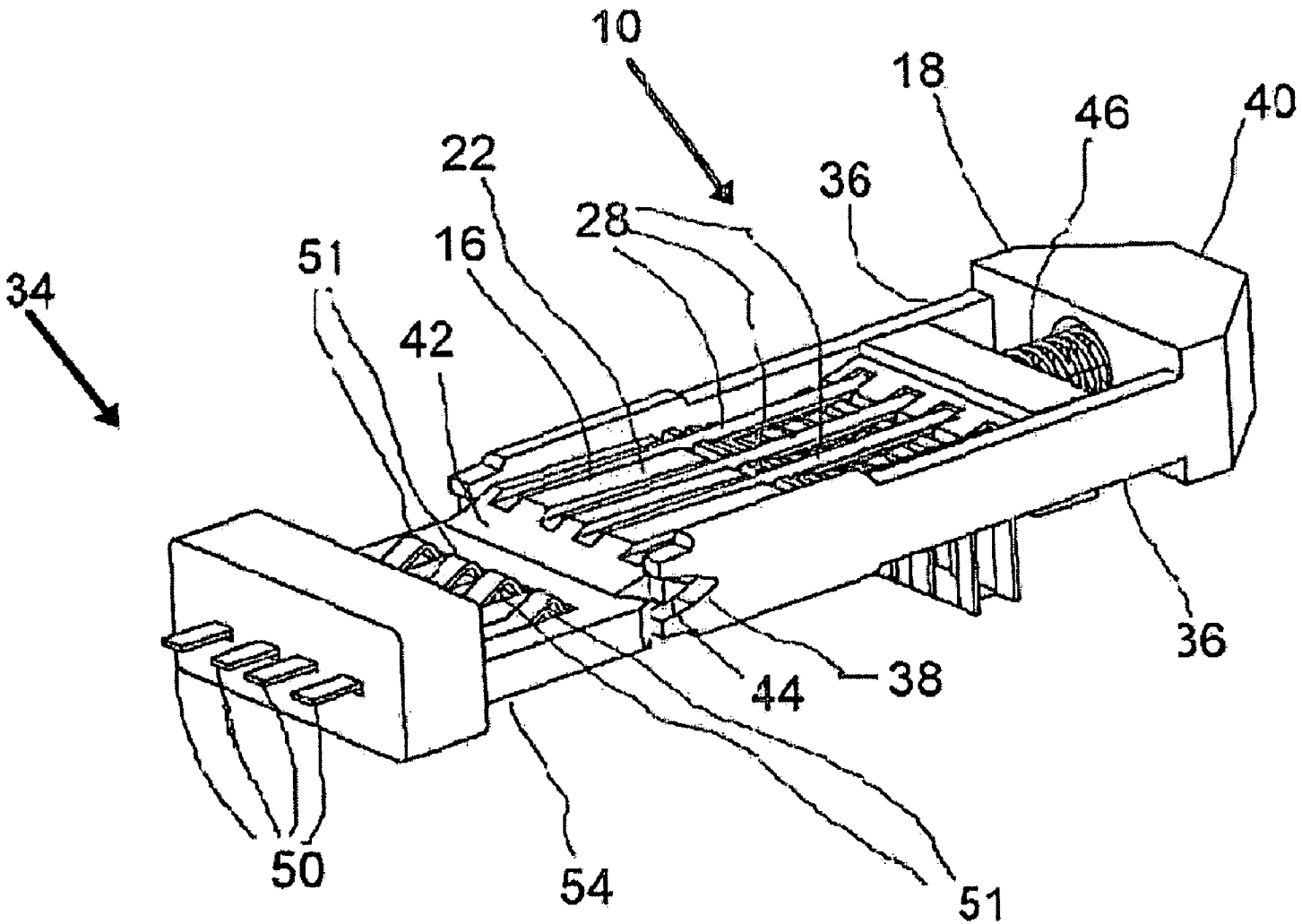
FIG. 1*e* is an isometric view of the plug of FIG. 1*a* (having its outer housing removed for clarity) making contact with an A-type USB standard receptacle (also having its outer housing removed for clarity)
Figure 1F:
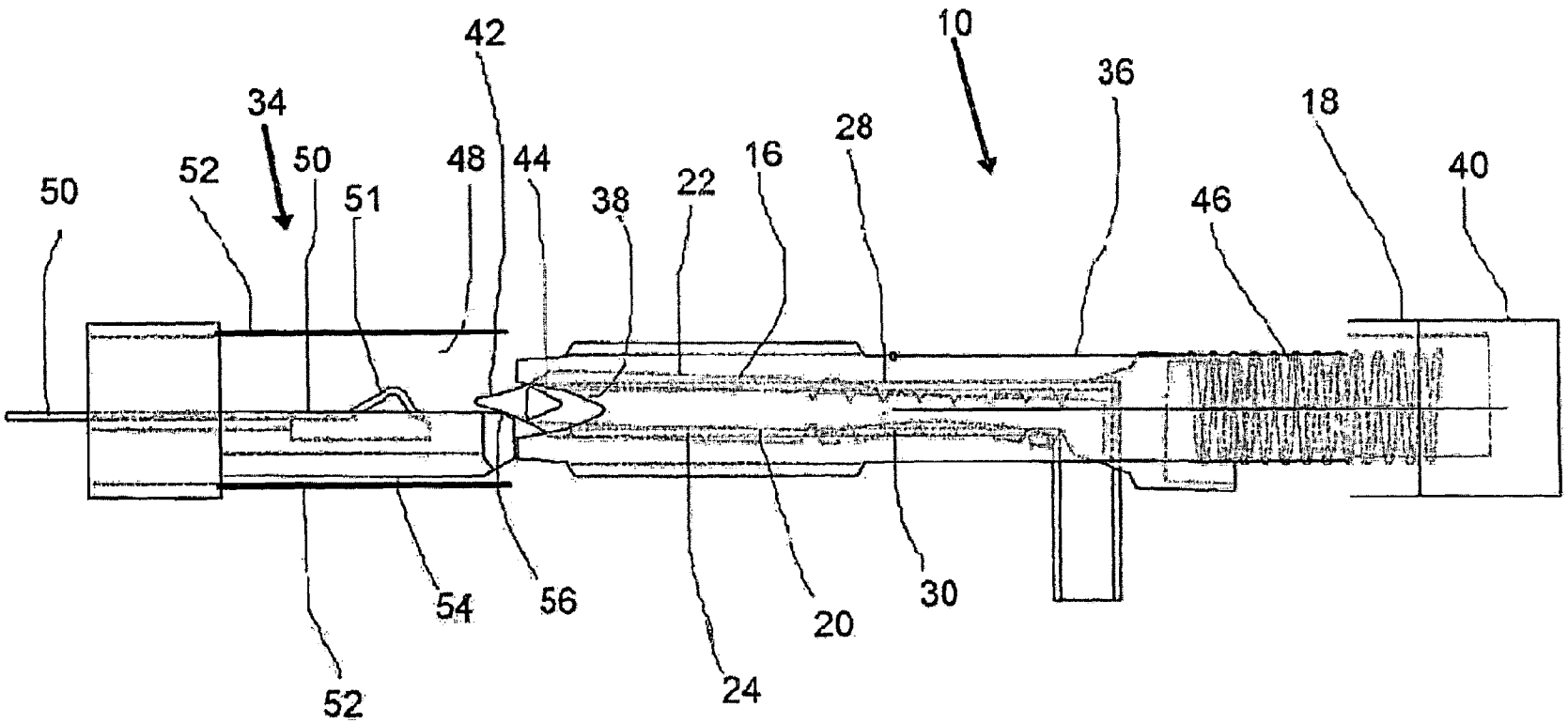
FIG. 1*f* is a schematic semi-transparent side view of the plug and receptacle of FIG. 1*e;*

Reference is also made to FIGS. 1*e* and 1*f*. FIG. 1*e* is an isometric view of reversible plug 10 of FIG. 1*a* (having sleeve 14 removed for clarity) making contact with an A-type USB standard receptacle 34 (also having its outer housing removed for clarity). FIG. 1*f* is a schematic semi-transparent side view of reversible plug 10 and A-type USB standard receptacle 34 of FIG. 1*e*. A-type USB standard receptacle 34 has a shield 52 (FIG. 1*f*) which surrounds a hollow section 48 on three sides. A set of four electrical contacts 50 is disposed on an insulating block 54 on one side of hollow section 48. Electrical contacts 50 have projecting portions 51 which make electrical contact with either electrical contact regions 28 or electrical contact regions 30 of reversible plug 10, as described below. Shield 52, which is an electrically conducting shield, is disposed on the other three sides of hollow section 48. Shield 52 has four sides so that hollow section 48 and insulating block 54 are surrounded by shield 52. There is a gap between insulating block 54 and shield 52 so that sleeve 14 of reversible plug 10 is inserted between this gap when reversible plug 10 is coupled with A-type USB standard receptacle 34. Insulating block 54 has a curved upper edge 56 at the entrance to A-type USB standard receptacle 34.

Centering mechanism 18 includes two elongated side panels 36. Each panel 36 has, at one end, a V-shaped notch 38 cut therein. The other end of each panel 36 is connected to a connecting member 40. Panels 36 are connected to connecting member 40, such that panels 36 are parallel to each other and the space between panels 36 accommodates tongue arrangement 16. Centering mechanism 18 is typically formed as a unitary molded plastic element. Tongue arrangement 16 has a tip 42. Tip 42 includes a protrusion 44 disposed on either side of tip 42 for engaging with V-shaped notches 38 of centering mechanism 18. Centering mechanism 18 is retractable and is normally biased by an extension spring 46 to a forward position as shown in FIG. 1*e* in which engagement of protrusions 44 with V-shaped notches 38 prevents centers and prevents up-down movement of tongue arrangement 16. Therefore, centering mechanism 18 is a spring recoiled sliding locking mechanism. In this way, when reversible plug 10 is not connected to A-type USB standard receptacle 34, tongue arrangement 16 is centered by means of centering mechanism 18.

Initial contact of panels 36 of centering mechanism 18 with insulating block 54 of A-type USB standard receptacle 34 pushes panels 36 backward. This action releases protrusion 44 of tongue arrangement 16 from V-shaped notch 38 of centering mechanism 18 thereby allowing up and down movement of tongue arrangement 16.

As reversible plug 10 is inserted into A-type USB standard receptacle 34, tip 42 makes contact with curved upper edge 56 of insulating block 54. Curved upper-edge 56 pushes tip 42 and therefore tongue arrangement 16 upward. Reversible plug 10 is inserted fully into hollow section 48. At this point, only electrical contact regions 30 of lower major side 24 of tongue arrangement 16 make mechanical contact with electrical contacts 50 of A-type USB standard receptacle 34. The term "only electrical contact regions 30" is defined herein to exclude electrical contact regions 28. As electrical contact regions 28 of upper major side 22 are recessed in central insulating layer 20, electrical contact regions 28 are electrically isolated from sleeve 14. This is important to prevent shorting of electrical contact regions 28 with sleeve 14. The above paragraph describes one coupling orientation of reversible plug 10 with A-type USB standard receptacle 34.

A second coupling orientation is described below. In order to describe this coupling orientation, it is more convenient to consider a rotation of A-type USB standard receptacle 34 by 180 degrees so that insulating block 54 is above hollow section 48 rather than rotating reversible plug 10. As reversible plug 10 is inserted into A-type USB standard receptacle 34, tongue arrangement 16 is moved down. When reversible plug 10 is fully inserted, only electrical contact regions 28 of upper major side 22 of tongue arrangement 16 make mechanical contact with electrical contacts 50 of A-type USB standard receptacle 34. The term "only electrical contact regions 28" is defined herein to exclude electrical contact regions 30. Similarly, in this second coupling orientation, electrical contact regions 30 of lower major side 24 are electrically isolated from sleeve 14. This implementation shows eight output connectors which may be connected directly to a suitably adapted printed circuit board, as will be clear to one ordinarily skilled in the art. As mentioned earlier, this connectivity solution is interchangeable with the alternative solutions of electronic switching and cross-over connection which will be described below.

Figure 2A:
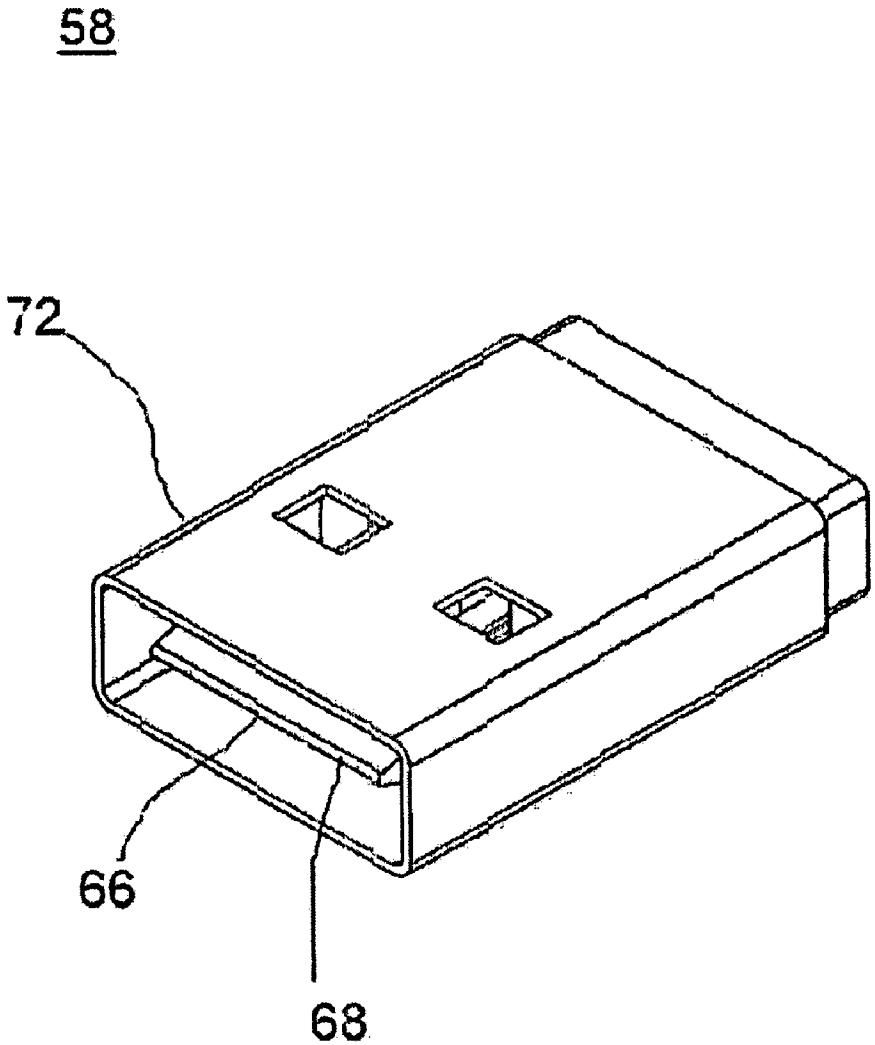
FIG. 2*a* is an isometric view of a reversible plug that is constructed and operable in accordance with a first alternate embodiment of the present invention.
Figure 2B:
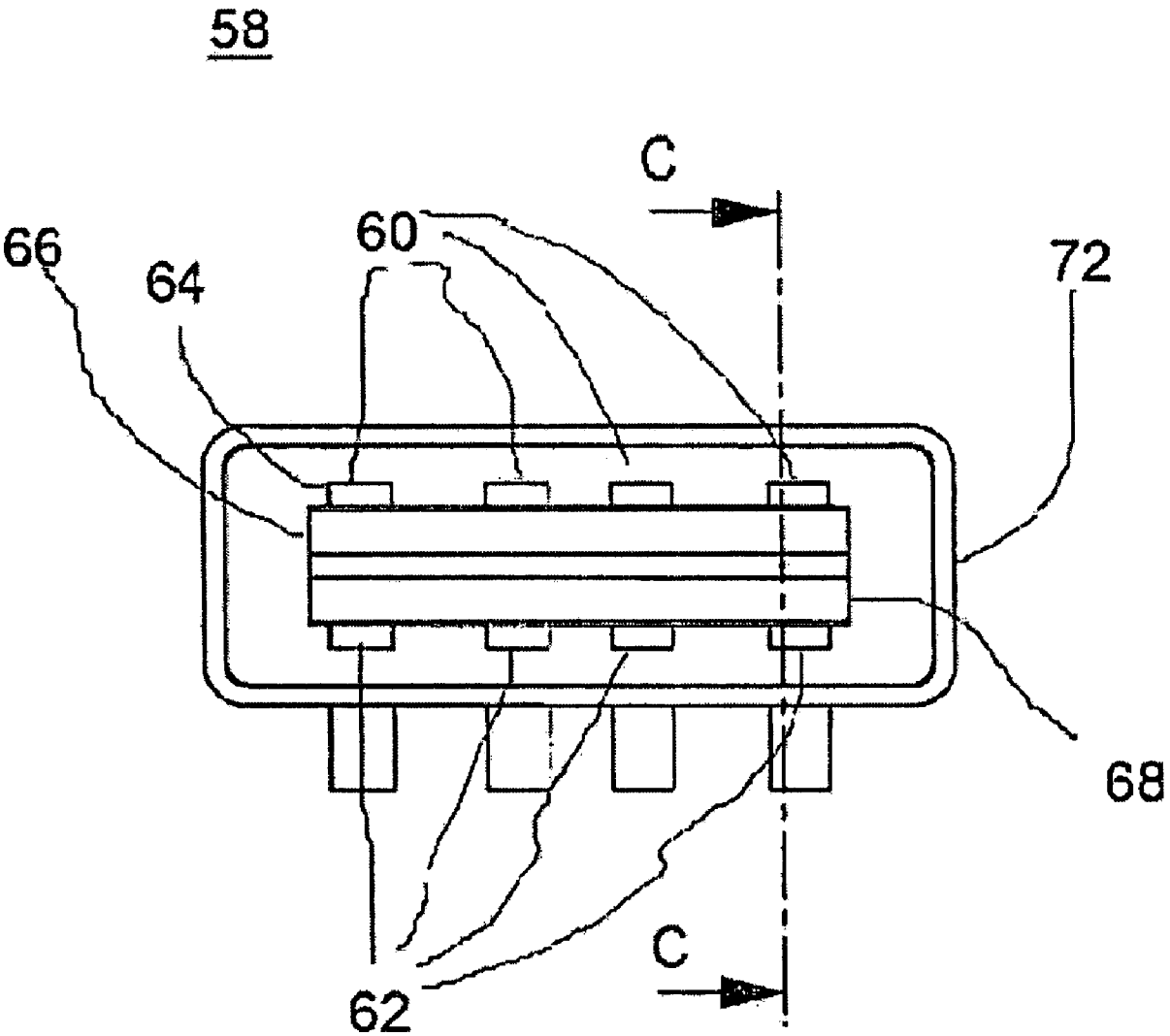
FIG. 2*b* is a front view of the plug of FIG. 2*a;*
Figure 2C:
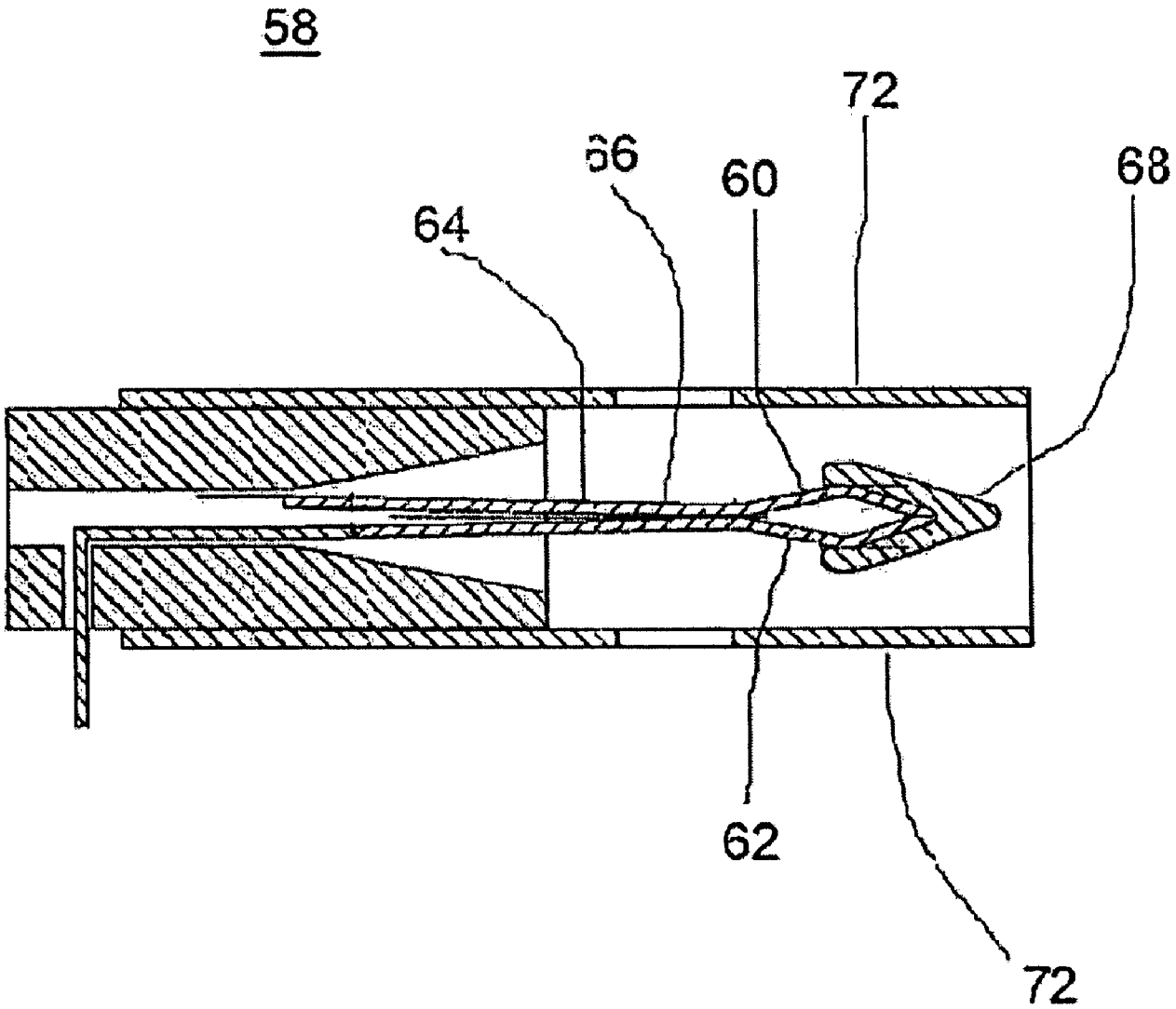
FIG. 2*c* is a sectional view through the line C—C of FIG. 2*b;*

Reference is now made to FIGS. 2*a*–*c*. FIG. 2*a* is an isometric view of a reversible plug 58 that is constructed and operable in accordance with a first alternate embodiment of the present invention. FIG. 2*b* is a front view of reversible plug 58 of FIG. 2*a*. FIG. 2*c* is a sectional view through the line C—C of FIG. 2*b*. Reversible plug 58 is substantially the same as reversible plug 10 except for the differences described below and shown in FIGS. 2*a* to 2*f*. Reversible plug 58 has a tongue arrangement 66 formed from a first set of four electrical contact regions 60 and a second set of four electrical contact regions 62. Tongue arrangement 66 is particularly distinguished from that of FIGS. 1*a*–1*f* in that the metallic strips which provide electrical contact regions 60 and 62 themselves make up a primary structural element of the tongue arrangement. The term "primary structural element" is used herein to refer to an element or set of elements without which the structure described would not be self-supporting. The resulting structure is effectively a leaf spring electrical contact arrangement 64. In other words, the primary structure of the tongue arrangement is resiliently flexible along most or all of its length such that the required up-down flexing of the tongue occurs by flexing of the entire structure without requiring a localized flexible region like the previous embodiment. Tongue arrangement 66 is initially centrally disposed in an electrically conducting sleeve 72 and preferably returns elastically to that central position. Electrical contact regions 60 and electrical contact regions 62 are typically from four metal strips which are bent to form leaf spring electrical contact arrangement 64. However, it will be appreciated by those ordinarily skilled in the art that leaf spring electrical contact arrangement 64 can be formed from eight or more metal strips which are then joined together to form leaf spring electrical contact arrangement 64. There is no central insulating layer in this embodiment. The individual leaf spring electrical contacts are connected at their tips via an insulated cap 68.

Figure 2D:
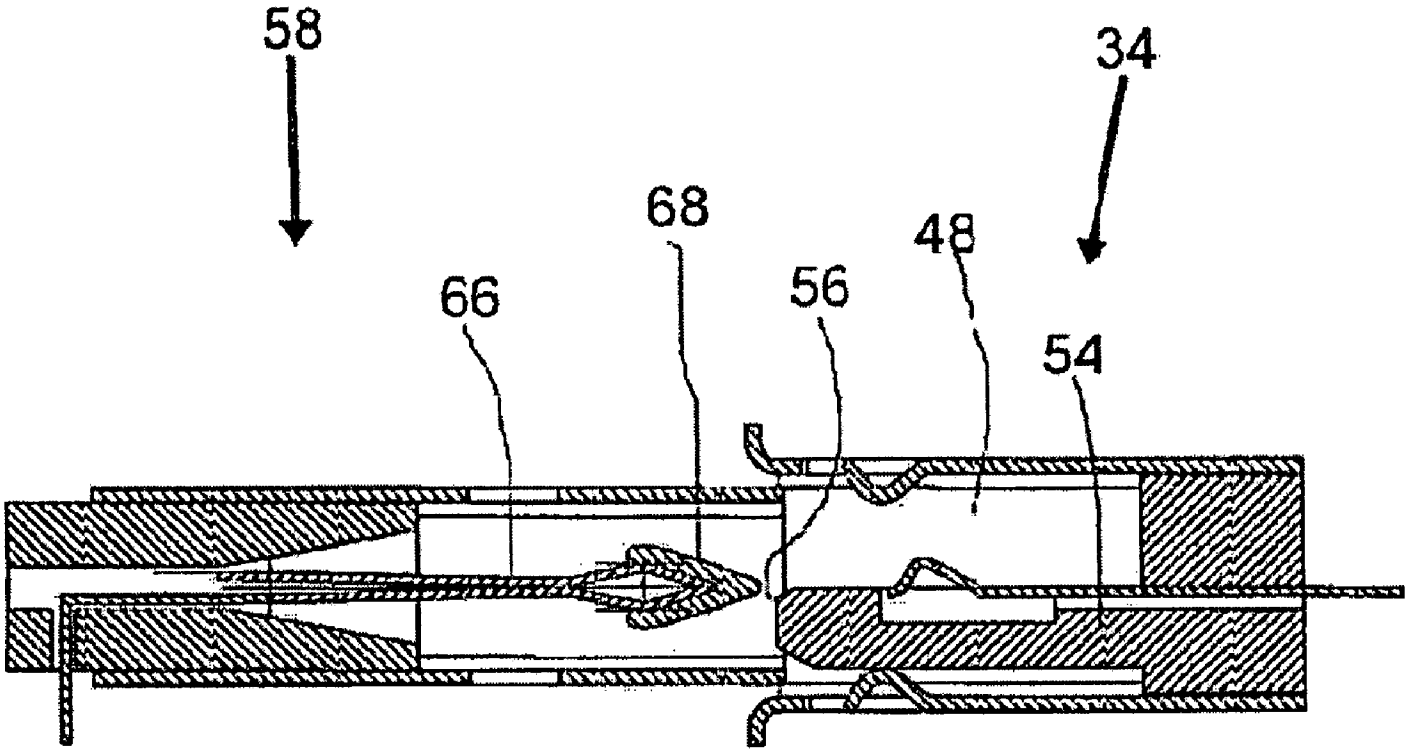
FIG. 2*d* is a sectional view of the plug of FIG. 2*a* making contact with an A-type USB standard receptacle.

Reference is now made to FIG. 2*d*, which is a sectional view of reversible plug 58 of FIG. 2*a* making contact with A-type USB standard receptacle 34. Insulated cap 68 has a pointed end so that tongue arrangement 66 is pushed up or down (depending on the coupling orientation of reversible plug 58 and A-type USB standard receptacle 34) when inserted into A-type USB standard receptacle 34 via curved upper edge 56 of insulating block 54 of A-type USB standard receptacle 34. In the example of FIG. 2*d*, tongue arrangement 66 will be pushed up when inserted into hollow section 48 of A-type USB standard receptacle 34.

Figure 2E:
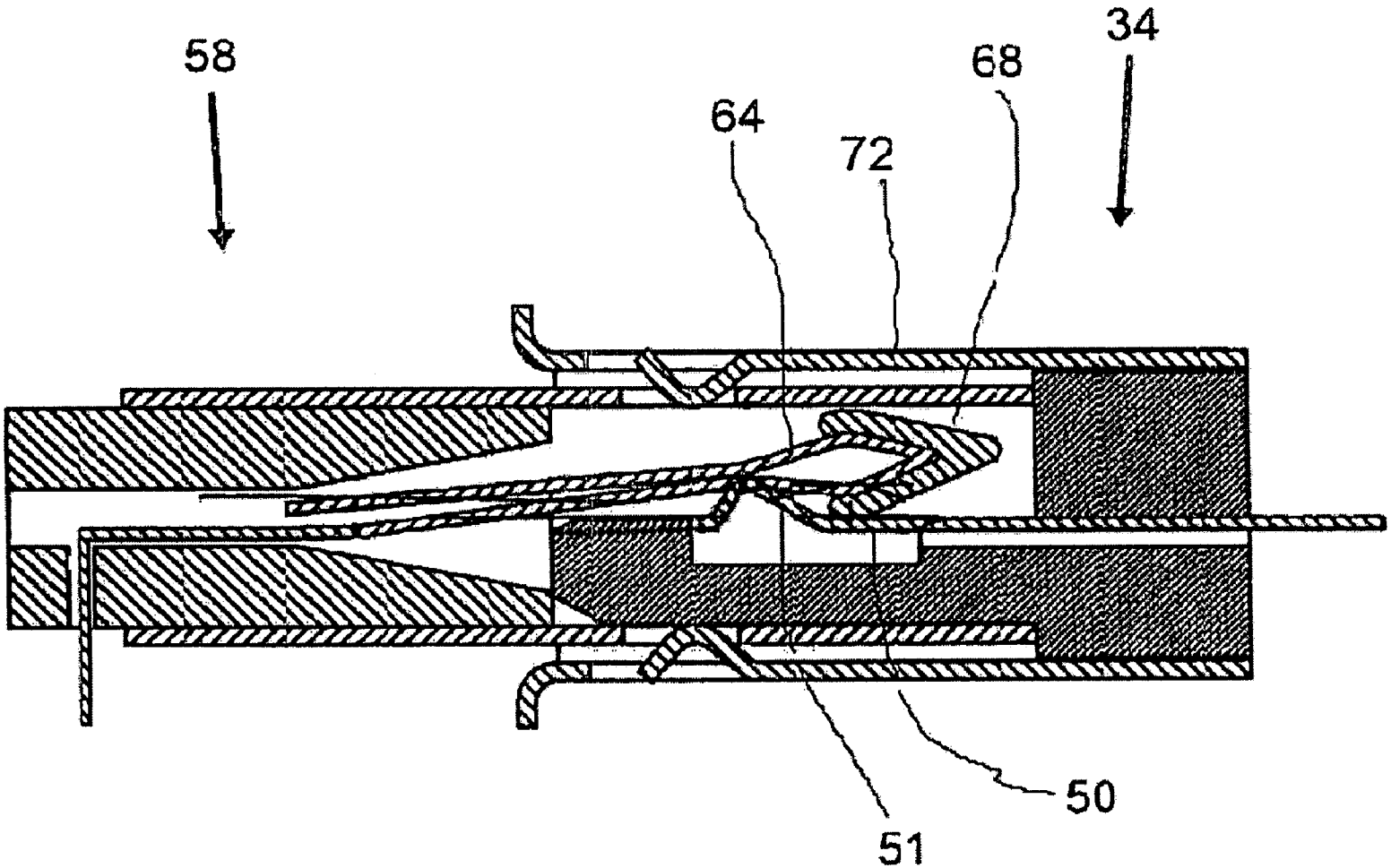
FIG. 2*e* is a sectional view of the plug and receptacle of FIG. 2*d* fully coupled.

Reference is now made to FIG. 2*e*, which is a sectional view of reversible plug 58 and A-type USB standard receptacle 34, fully coupled. Insulated cap 68 is configured for preventing electrical contact between leaf spring electrical contact arrangement 64 and sleeve 72 in both coupling orientations of reversible plug 58 with A-type USB standard receptacle 34. Additionally, insulated cap 68 and leaf spring electrical contact arrangement 64 are configured such that leaf spring electrical contact arrangement 64 makes electrical contact with projecting portions 51 of electrical contacts 50 of A-type USB standard receptacle 34 in both coupling orientations of reversible plug 58. Therefore, each contact of leaf spring electrical contact arrangement 64 forms a diamond shape at the tip of tongue arrangement 66. The half of the diamond shape closest to the tip of tongue arrangement 66 is covered by insulated cap 68. The other half of the diamond shape is not insulated so that this portion of the diamond makes electrical contact with projecting portions 51 of electrical contacts 50. The diamond shape is configured so that it makes maximum contact with projecting portions 51.

Figure 2F:
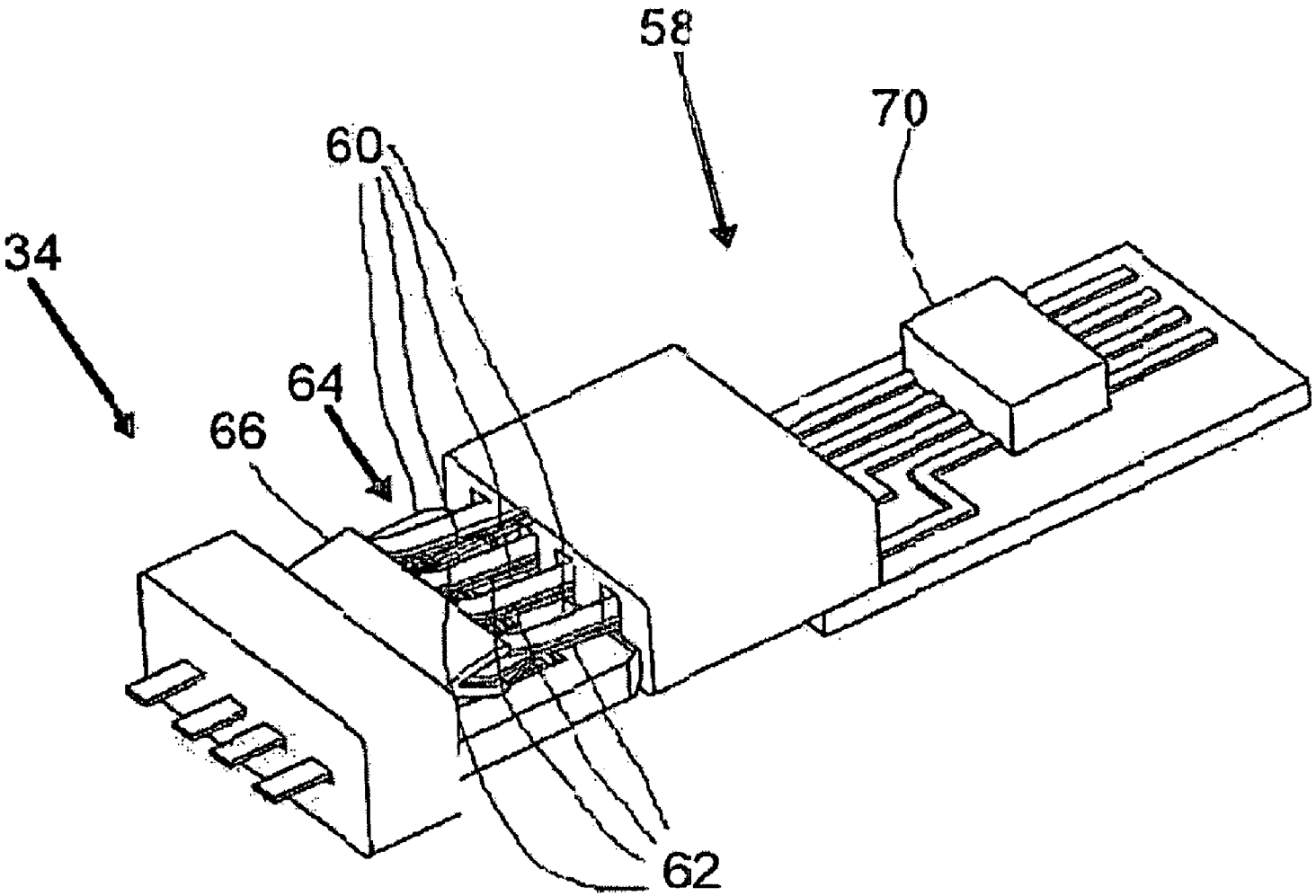
FIG. 2*f* is an isometric view of the plug and receptacle of FIG. 2*e* fully coupled (having their outer housing removed for clarity)

Reference is now made to FIG. 2*f*, which is an isometric view of reversible plug 58 and A-type USB standard receptacle 34 of FIG. 2*e* fully coupled (having their outer housings removed for clarity). As each of electrical contact regions 60 is electrically connected with a corresponding electrical contact region 62, electrical signals from leaf spring electrical contact arrangement 64 need to be routed according to the coupling orientation of reversible plug 58 with A-type USB standard receptacle 34. Therefore, reversible plug 58 includes an electronic switching arrangement 70 configured for routing electrical signals from leaf spring electrical contact arrangement 64 according to the coupling orientation of tongue arrangement 66 with A-type USB standard receptacle 34. It will be appreciated by those ordinarily skilled in the art how to design and produce a suitable device for performing the function of electronic switching arrangement 70. A preferred example of electronic switching arrangement 70 is described below.

Figure 2G:
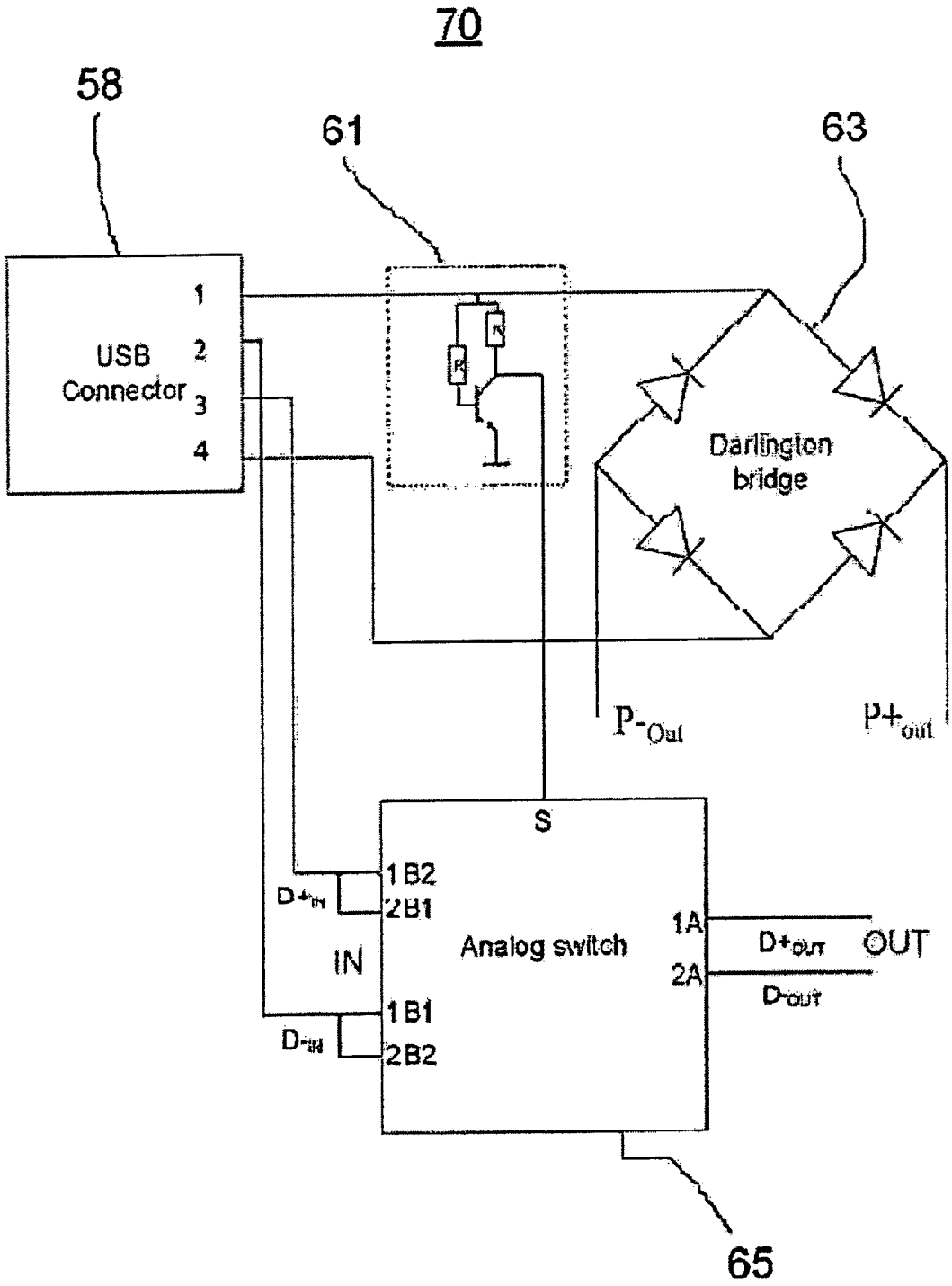
FIG. 2*g* is a schematic view of an electronic switching arrangement for use with the plug of FIG. 2*a;*

Reference is now made to FIG. 2*g*, which is a schematic view of electronic switching arrangement 70 for use with plug 58 of FIG. 2*a*. Reversible plug 58 has two power pins and two data pins. Electronic switching arrangement 70 includes a power detection circuit 61, a power inversion arrangement 63 and a data inversion arrangement 65. One of the power pin outputs of reversible plug 58 is inputted into power detection circuit 61. Power detection circuits 61 can be electrically connected to either output pin of reversible plug 58. The output of power detection circuit 61 is fed into data inversion arrangement 65. Additionally, the output of the data pins of reversible plug 58 is fed into data inversion arrangement 65. Data inversion arrangement 65 is configured for routing the output of the data pins in accordance with the output of power detection circuit 61, thereby inverting the output if necessary. Data inversion arrangement 65 is typically an analog switch, compliant with USB 2.0, for example, but not limited to ADG 3257. Power inversion arrangement 63 inverts the power output if necessary. Power inversion arrangement 63 is typically a Darlington Bridge diode circuit.

Figure 2H:
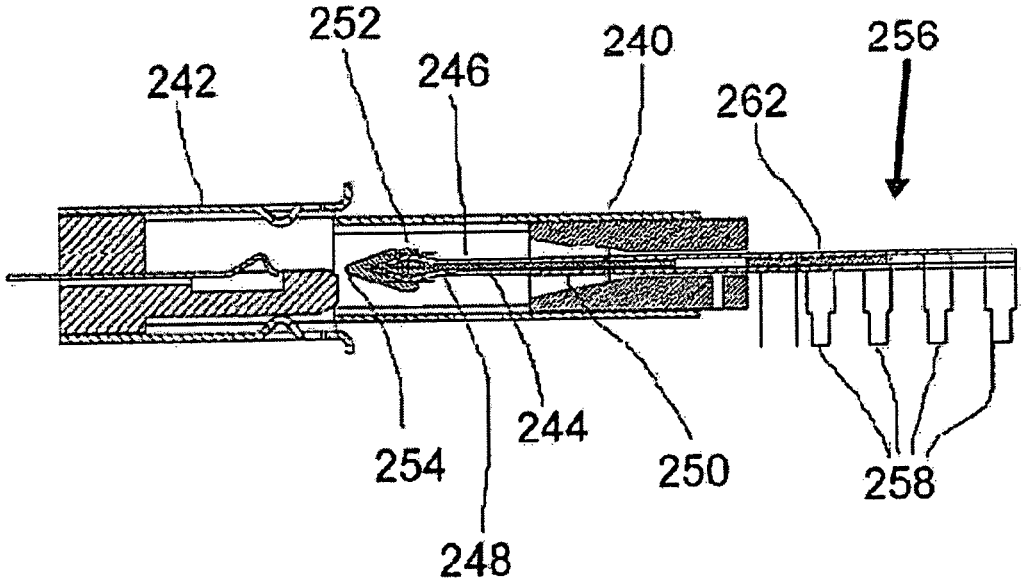
FIG. 2*h* is a sectional view of a reversible plug, that is constructed and operable in accordance with a second alternate embodiment of the present invention, making contact with an A-type USB standard receptacle.
Figure 2I:
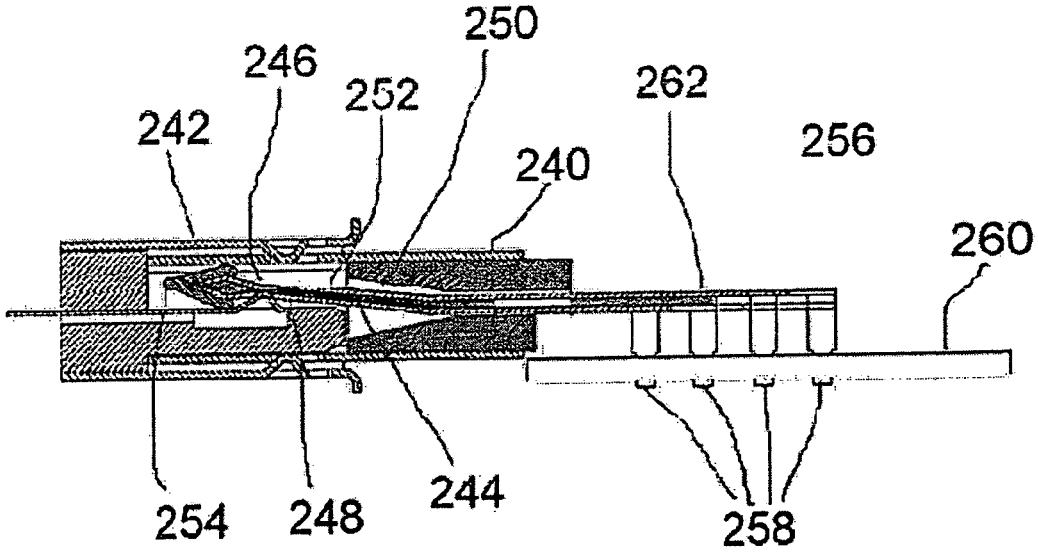
FIG. 2*i* is a sectional view of the plug and receptacle of FIG. 2*h* fully coupled.
Figure 2J:
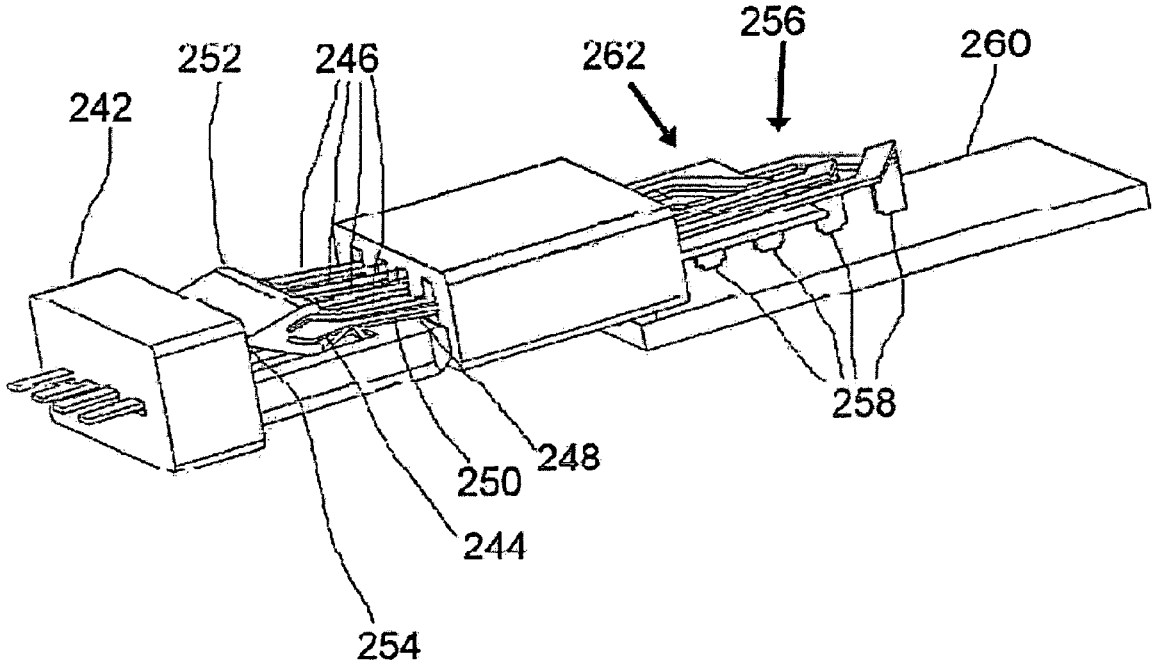
FIG. 2*j* is an isometric view of the plug and receptacle of FIG. 2*h* fully coupled (having their outer housing removed for clarity)
Figure 2K:
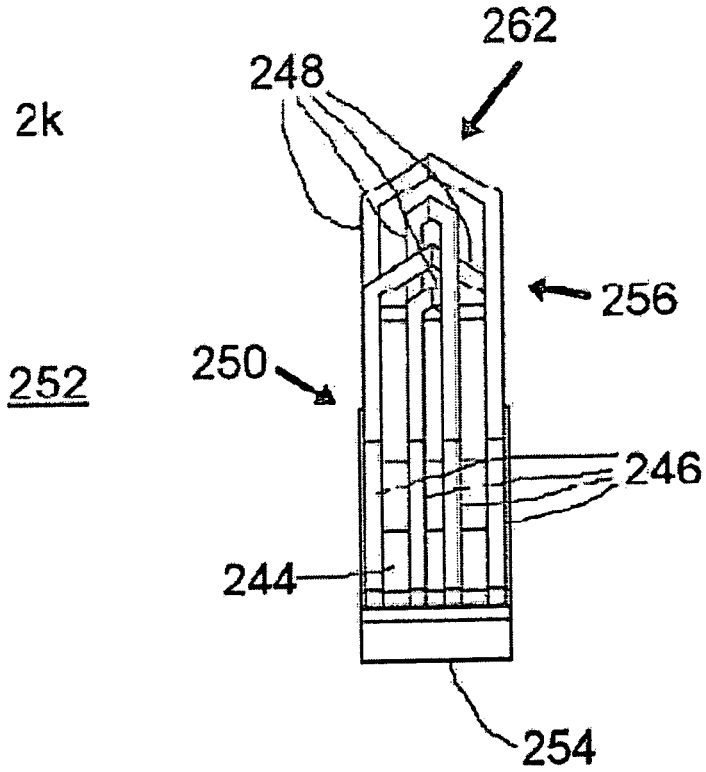
FIG. 2*k* is a top view of a tongue arrangement of the plug of FIG. 2*h;*
Figure 2M:
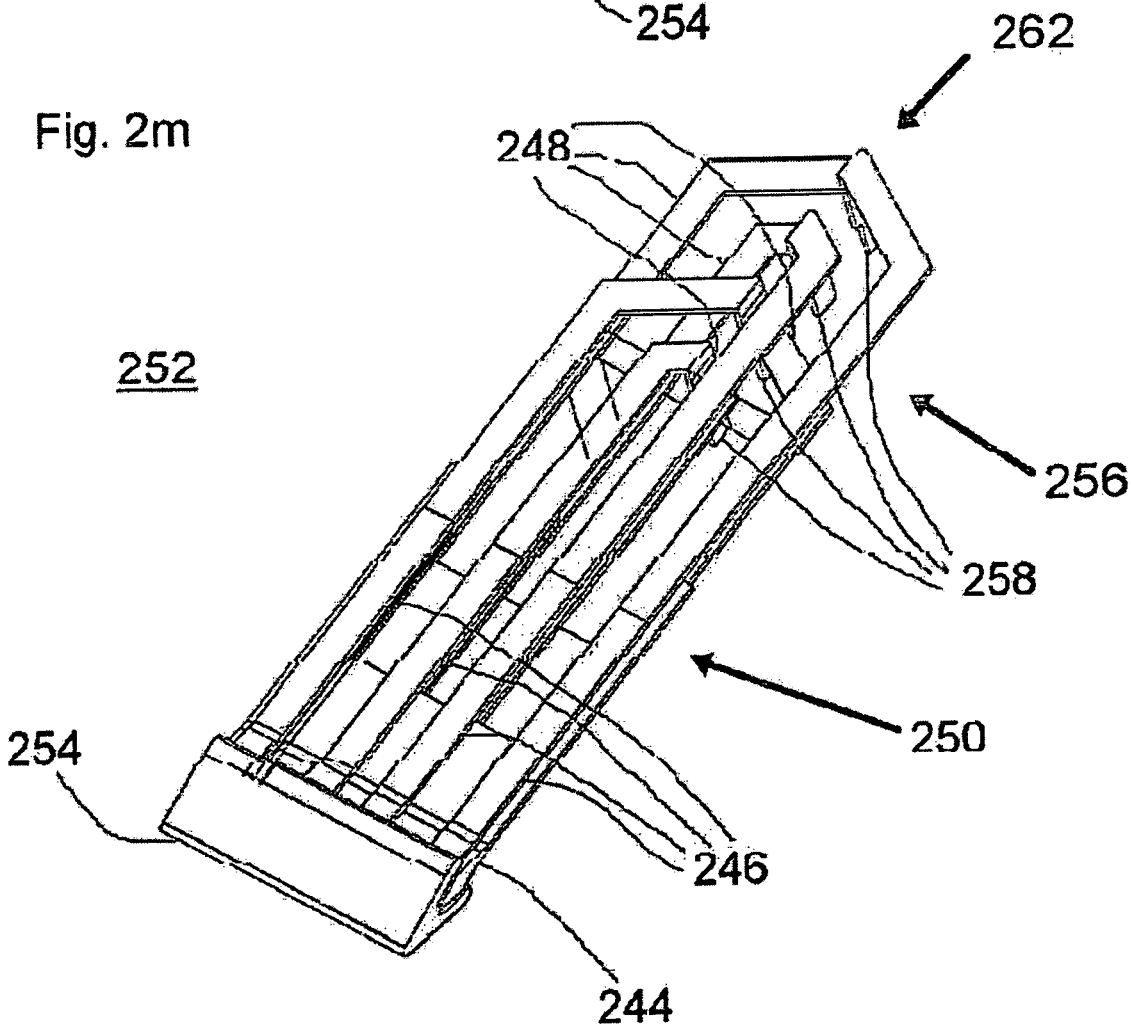
FIG. 2*m* is an isometric view of the tongue arrangement of FIG. 2*k;*

Reference is now made to FIGS. 2*h* to 2*k*. FIG. 2*h* is a sectional view of a reversible plug 240, that is constructed and operable in accordance with a second alternate embodiment of the present invention, making contact with an A-type USB standard receptacle 242. FIG. 2*i* is a sectional view of reversible plug 240 and A-type USB standard receptacle 242 of FIG. 2*h* fully coupled. FIG. 2*j* is an isometric view of reversible plug 240 and A-type USB standard receptacle 242 of FIG. 2*h* fully coupled (having their outer housing removed for clarity). FIG. 2*k* is a top view of tongue arrangement 252 of reversible plug 240 of FIG. 2*h*. FIG. 2*m* is an isometric view of tongue arrangement 252 of FIG. 2*k*. Reversible plug 240 is substantially the same as reversible plug 58 of FIGS. 2*a* to 2*g* except for the differences described below and shown in FIGS. 2*h* to 2*m*. Reversible plug 240 includes a tongue arrangement 252 having an insulating layer 244 disposed between a set of electrical contact regions 246 and a set of electrical contact regions 248. Set of electrical contact regions 246 and set of electrical contact regions 248 are formed as a leaf spring electrical contact arrangement 250. Set of electrical contact regions 246 and set of electrical contact regions 248 are not electrically connected at a tip 254 of tongue arrangement 252. As with reversible plug 58, the primary structural element of tongue arrangement 252 of reversible plug 240 is the set of metallic strips which also function as a leaf spring electrical contact arrangement 250. Insulating layer 244 is primarily for electrically isolating set of electrical contact regions 246 and set of electrical contact regions 248 over the flexible portion of tongue arrangement 252. Reversible plug 240 also includes a printed circuit board interface connector arrangement 256 having four terminals 258 disposed thereon. Each terminal 258 is configured for connection to a printed circuit board 260. Printed circuit board interface connector arrangement 256 has a crossover arrangement 262 for electrically connecting electrically corresponding contact regions of set of electrical contact regions 246 and set of electrical contact regions 248 to terminals 258. The term "electrically corresponding contact region" is defined herein as contact regions of reversible plug 240 which make electrical contact with the same electrical contact of A-type USB standard receptacle 242. Therefore, in whichever coupling orientation reversible plug 240 is inserted into A-type USB standard receptacle 242, the same terminals of A-type USB standard receptacle 242 are in electrical contact with the same terminals 258 of printed circuit board interface connector arrangement 256. Therefore, electronic switching arrangement 70 is not needed in this embodiment. It should be noted that the arrangement of terminals 258 differs from the standard USB pin arrangement for connection to a printed circuit board. The arrangement shown in FIGS. 2*h* to 2*m* has been chosen in order to simplify the figures. However, it will be appreciated by those ordinarily skilled in the art that terminals 258 can be arranged in accordance with a standard USB pin arrangement for connection to a printed circuit board.

Figure 3A:
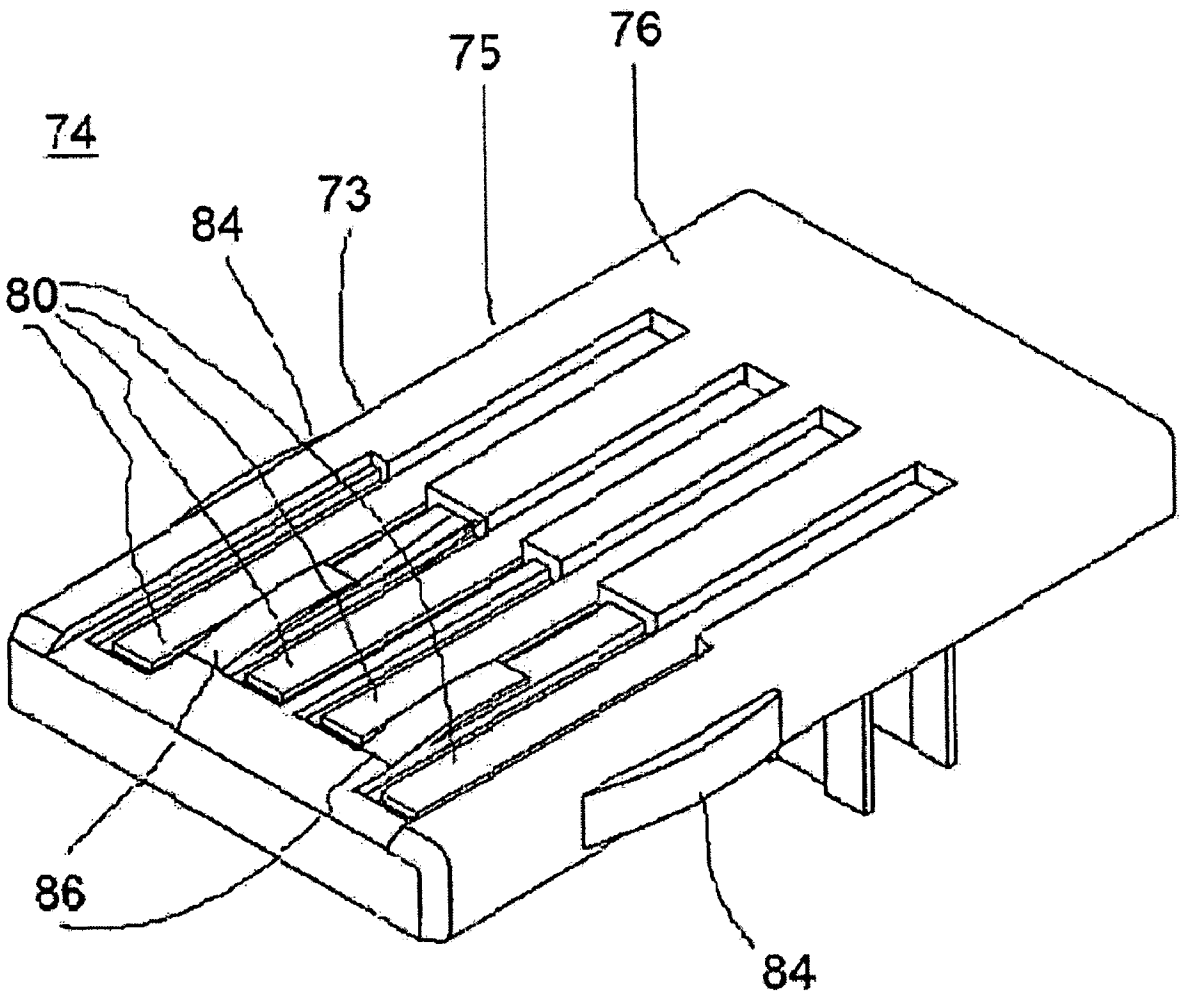
FIG. 3*a* is an isometric view of a reversible plug that is constructed and operable in accordance with a third alternate embodiment of the present invention.
Figure 3C:
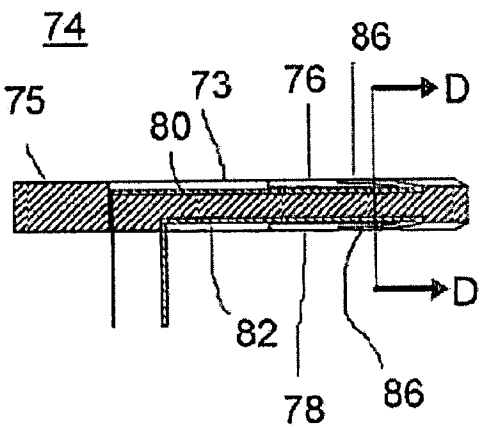
FIG. 3*c* is a sectional view through line C—C of FIG. 3*b;*
Figure 3D:
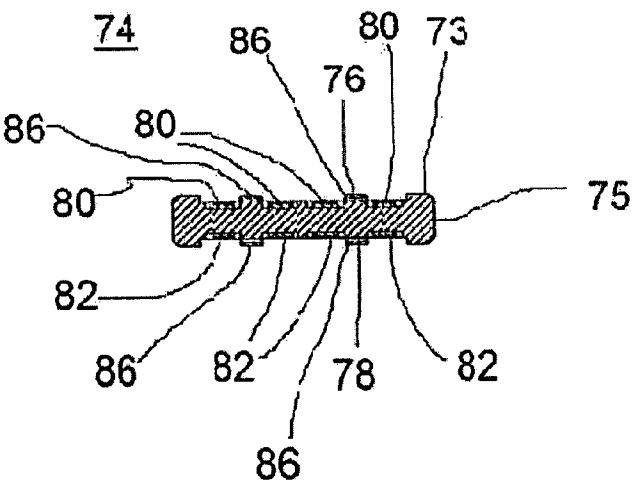
FIG. 3*d* is a sectional view through line D—D of FIG. 3*b;*
Figure 3B:
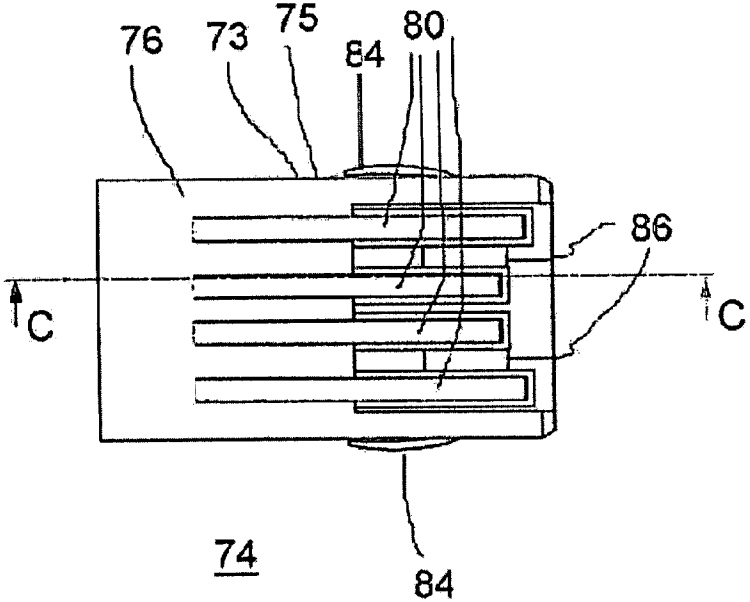
FIG. 3*b* is a plan view of the plug of FIG. 3*a;*

Reference is now made to FIGS. 3*a–d*. FIG. 3*a* is an isometric view of a reversible plug 74 that is constructed and operable in accordance with a third alternate embodiment of the present invention. FIG. 3*b* is a plan view of reversible plug 74 of FIG. 3*a*. FIG. 3*c* is a sectional view through line C—C of FIG. 3*b*. FIG. 3*d* is a sectional view through line D—D of FIG. 3*b*. Reversible plug 74 includes an interface element 73 similar to the tongue arrangement of the first three embodiments. Unlike the first three embodiments, reversible plug 74 does not in this case have a shield or sleeve which surrounds interface element 73. As a result of the absence of an outer sleeve, interface element 73 may be rigidly mounted without freedom of up-down movement relative to a device to which it is attached. Instead, the interface element centers itself within the socket together with the entire device during insertion. Interface element 73 as illustrated here includes a central insulting layer 75 having an upper major surface 76 and a lower major surface 78. Central insulting layer 75 is substantially rigid. The term "substantially rigid" as used herein implies that the major structural element of the central insulating layer is relatively rigid. It should be noted however that the element may additionally include minor surface features and projections disposed on central insulting layer 75, some of which may be flexible, as will be described below. Upper major surface 76 includes four grooves in which a set of four electrical contacts 80 is recessed. Lower major surface 78 includes four grooves in which a set of four electrical contacts 82 is recessed.

Reversible plug 74 includes a projection 84 disposed on either side of central insulting layer 75. Reversible plug 74 also includes two projections 86 disposed on upper major surface 76 and lower major surface 78. Projections 84, 86 are configured for centering interface element 73 within hollow section 48 of A-type USB standard receptacle 34 as well as reducing lateral movement of interface element 73 within hollow section 48 of A-type USB standard receptacle 34. Projections 84, 86 are typically flexible projections which are formed integrally with central insulting layer 75. Projections 86 additionally prevent electrical contacts 80 and electrical contacts 82 from making electrical contact with shield 52 of A-type USB standard receptacle 34, as will be explained below with reference to FIG. 3*f*.

Figure 3E:
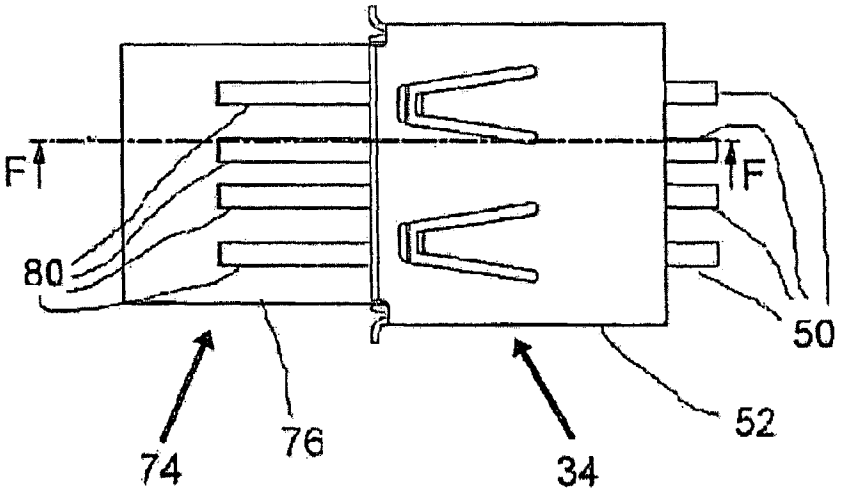
FIG. 3*e* is a plan view of the plug of FIG. 3*a* inserted into an A-type USB standard receptacle.
Figure 3F:
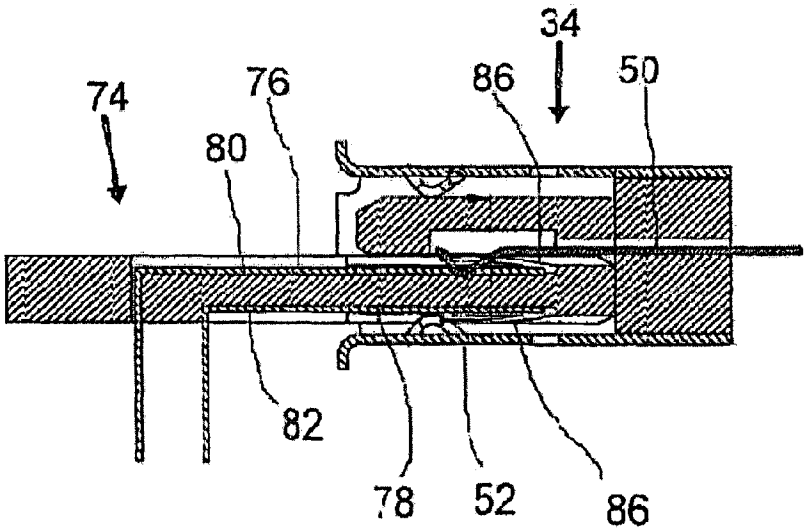
FIG. 3*f* is a sectional view through the line F—F of FIG. 3*e;*

Reference is now FIGS. 3*e* and 3*f*. FIG. 3*e* is a plan view of reversible plug 74 of FIG. 3*a* inserted into A-type USB standard receptacle 34. FIG. 3*f* is a sectional view through the line F—F of FIG. 3*e*. In the example of FIGS. 3*e* and 3*f*, reversible plug 74 is inserted into A-type USB standard receptacle 34 in a first coupling orientation. In this coupling orientation, electrical contacts 80 of upper major surface 76 are in electrical contact with electrical contacts 50 of A-type USB standard receptacle 34. Projections 86 prevent electrical contacts 82 of lower major surface 78 coming into electrical contact with shield 52 of A-type USB standard receptacle 34.

Similarly, if either reversible plug 74 or A-type USB standard receptacle 34 are turned over, electrical contacts 82 of lower major surface 78 make contact with electrical contacts 50 of A-type USB standard receptacle 34 when reversible plug 74 is coupled with A-type USB standard receptacle 34 in a second coupling orientation. Similarly, in this second coupling orientation, projections 86 prevent electrical contacts 80 from making electrical contact with shield 52.

Figure 4B:
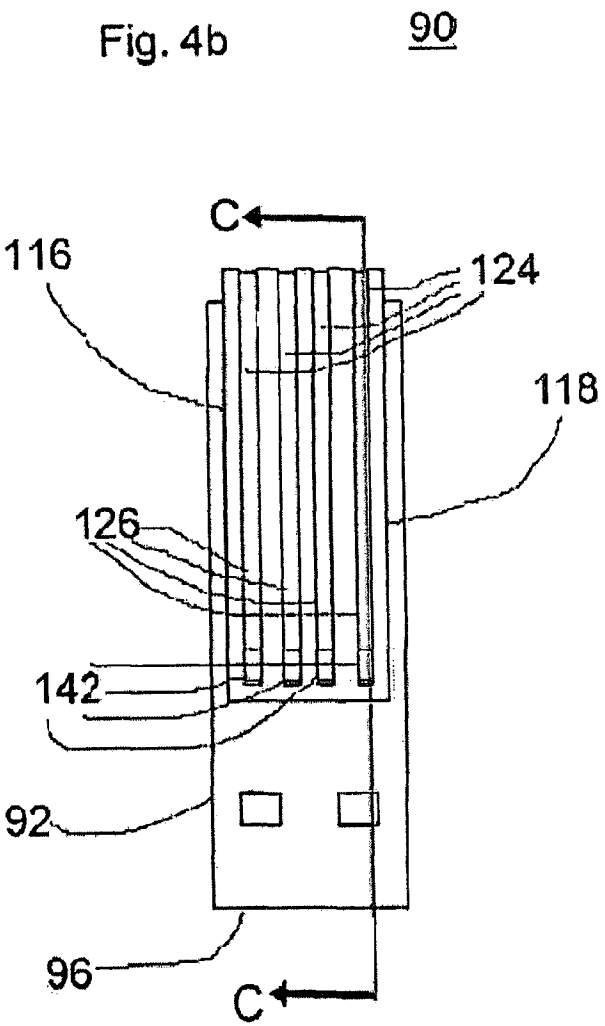
FIG. 4*b* is a plan view of the plug of FIG. 4*a;*
Figure 4A:
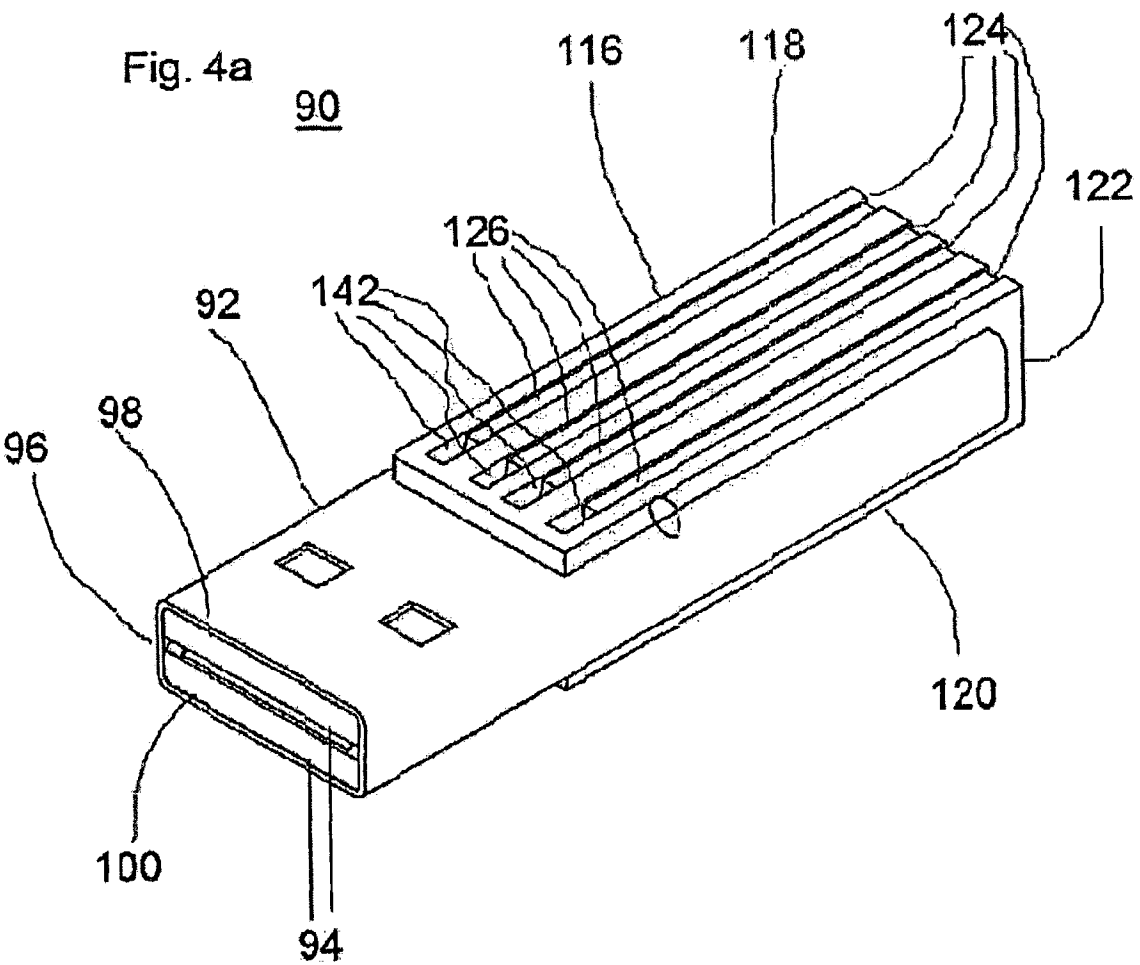
FIG. 4*a* is an isometric view of a reversible plug that is constructed and operable in accordance with a fourth alternate embodiment of the present invention.
Figure 4C:
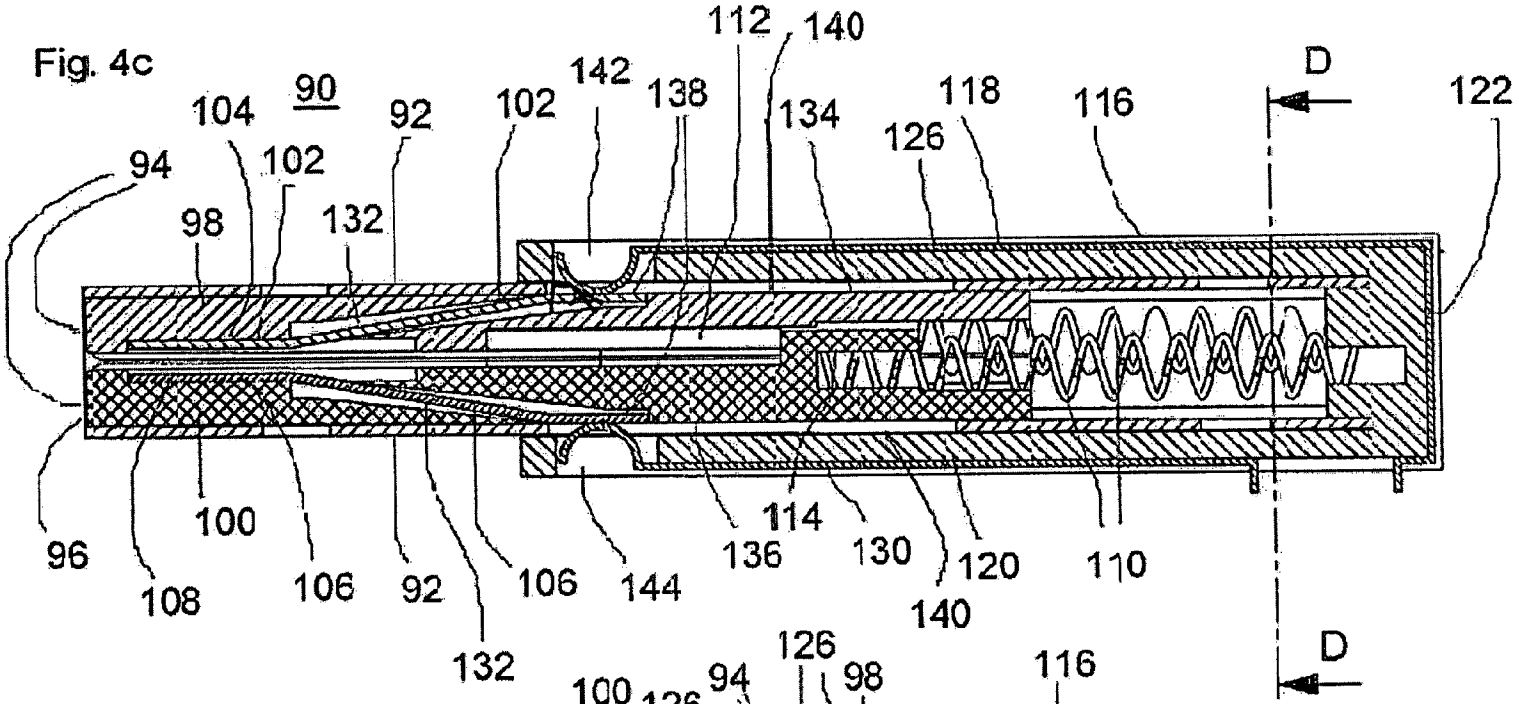
FIG. 4*c* is a sectional view through line C—C of FIG. 4*b;*
Figure 4D:
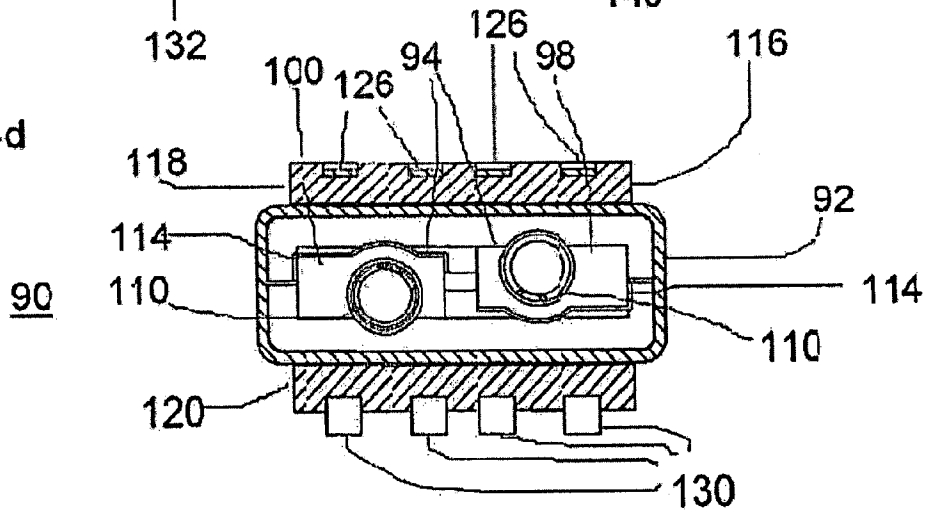
FIG. 4*d* is a sectional view through line D—D of FIG. 4*c;*
Figure 4E:
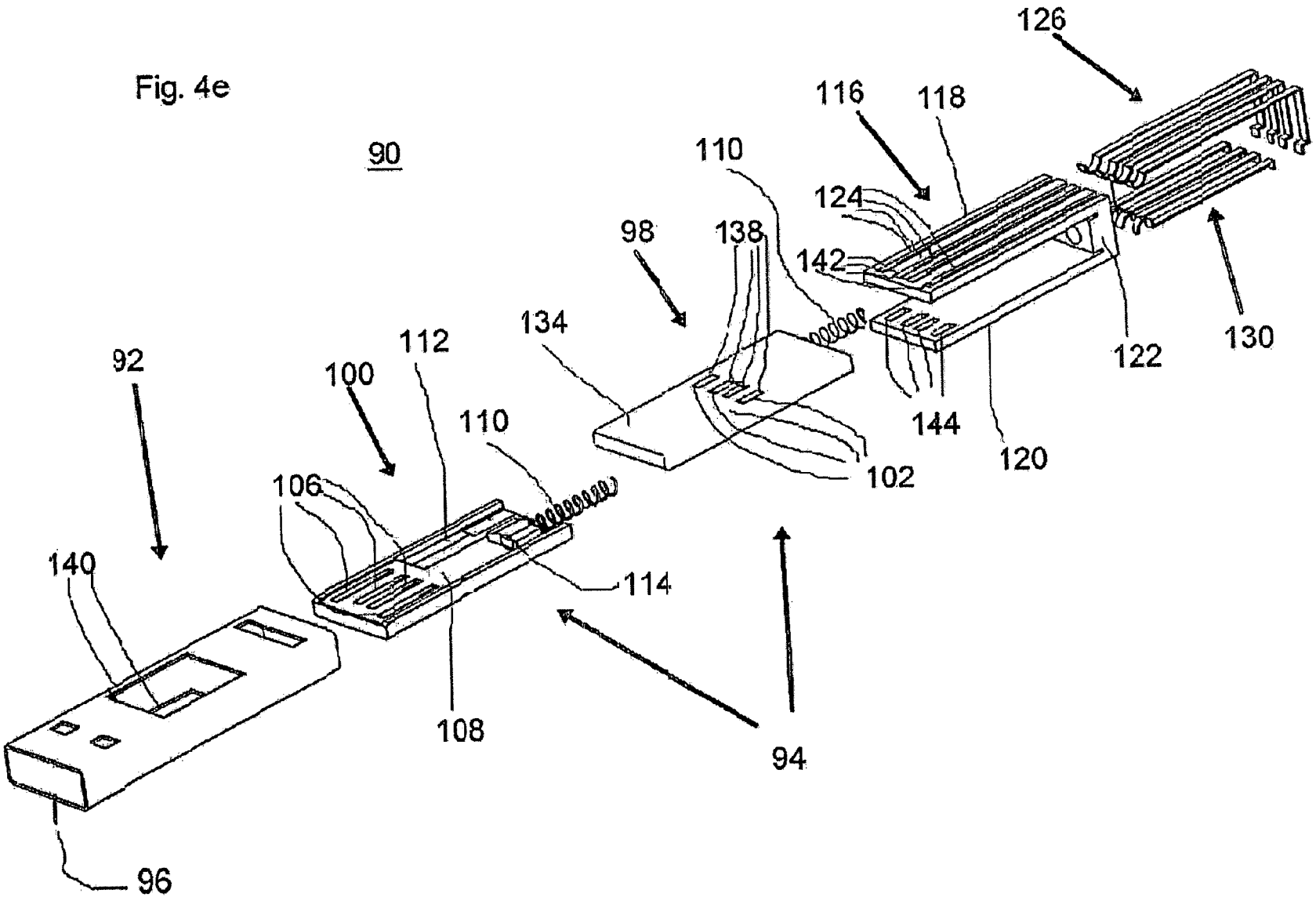
FIG. 4*e* is an exploded view of the plug of FIG. 4*a;*

Reference is now made to FIGS. 4*a–e*. FIG. 4*a* is an isometric view of a reversible plug 90 that is constructed and operable in accordance with a fourth alternate embodiment of the present invention. FIG. 4*b* is a plan view of reversible plug 90 of FIG. 4*a*. FIG. 4*c* is a sectional view through line C—C of FIG. 4*b*. FIG. 4*d* is a sectional view through line D—D of FIG. 4*c*. FIG. 4*e* is an exploded view of reversible plug 90 of FIG. 4*a*. Reversible plug 90 includes a sleeve 92 and a pair of blocks 94 slidably mounted adjacent to each other in sleeve 92. Sleeve 92 is an electrically conducting shield. Blocks 94 are configured for independently sliding between an operative position and a retracted position as will be explained in more detail with reference to FIGS. 4*e* and 4*f*. The term "independently sliding" is defined herein as each block slides between its operative position and its retracted position independently of the position of the other block. Sleeve 92 has two open ends, one at the rear of sleeve 92 and one at the end of sleeve 92 which couples with A-type USB standard receptacle 34. The open end of sleeve 92 which couples with A-type USB standard receptacle 34 is defined as coupling open end 96. The operative position is where blocks 94 are level with coupling open end 96 of sleeve 92. The retracted position is where blocks 94 are pushed into sleeve 92 as far as they will move due to the constraints of reversible plug 90. Blocks 94 include an upper block 98 and a lower block 100. A set of four electrical contacts 102 is recessed into four grooves in the lower surface 104 of upper block 98. Similarly, a set of four electrical contacts 106 is recessed into four grooves in the upper surface 108 of lower block 100. Therefore, electrical contacts 102 face electrical contacts 106 when both upper block 98 and lower block 100 are in the operative position. Each block 94 includes four channels 132 therein. Electrical contacts 102 and electrical contacts 106 continue from lower surface 104 and upper surface 108, respectively, through channels 132 to the other side of upper block 98 and lower block 100, respectively. Therefore, there are external contact regions 138 of electrical contacts 102 and electrical contacts 106 on the upper surface 134 of upper block 98 and the lower surface 136 of lower block 100, respectively. The function of external contact regions 138 is described in more detail below. Blocks 94 are typically formed from one or more molded plastic sections.

Reversible plug 90 also includes a rear housing 116 disposed around the rear portion of sleeve 92. Rear housing 116 has a top rectangular plate 118, a lower rectangular plate 120 and a central rectangular plate 122. One end of top rectangular plate 118 is connected to central rectangular plate 122. Similarly one end of lower rectangular plate 120 is connected to central rectangular plate 122. Rear housing 116 is typically formed as a unitary molded plastic or element. The top surface of top rectangular plate 118 has a plurality of grooves 124 therein for recessing a plurality of electrical terminals 126 therein. Similarly, the bottom of surface of lower rectangular plate 120 has a plurality of grooves 128 therein for recessing a plurality of electrical terminals 130 therein. Each groove 124 terminates, at the end closest to coupling open end 96 of sleeve 92, with an opening 142 in the surface of top rectangular plate 118. Electrical terminals 126 continue through openings 142 in order to make electrical contact with external contact regions 138 of electrical contacts 102 when upper block 98 is in the operative position (best seen in FIG. 4*c*). Similarly, each groove 128 terminates, at the end closest to coupling open end 96 of sleeve 92, with an opening 144 in the surface of lower rectangular plate 120. Electrical terminals 130 continue through openings 144 in order to make electrical contact with external contact regions 138 of electrical contacts 106 when lower block 100 is in the operative position. The middle region of the upper surface and lower surface of sleeve 92 has a rectangular opening 140 therein so that electrical terminals 126 and electrical terminals 130 make electrical contact with electrical contacts 102 and electrical contacts 106, when upper block 98 and lower block 100 are in the operative position, respectively.

Blocks 94 include a restoring arrangement 110 configured for restoring blocks 94 to the operative position. Restoring arrangement 110 typically includes two helical springs, one spring for each block 94. Each spring is disposed between its respective block 94 and central rectangular plate 122 of rear housing 116. Each block 94 has a width and a thickness. The thickness is defined as the minimum outside dimension of the surface exposed at coupling open end 96 of sleeve 92. It is desirable to use helical springs having an outer diameter greater than the thickness of each block 94. This is because narrower springs are not robust enough and are not readily available. Therefore, blocks 94 have cut out portions 112 and overlapping portions 114 at their rear. Cut out portions 112 of one block 94 are configured to accommodate overlapping portions 114 of the other block 94, and vice-versa (best seen in FIGS. 4*c–e*). In this way, helical springs having an outer diameter greater than the thickness of each block 94 are used without making the overall reversible plug 90 too bulky.

Figure 4F:
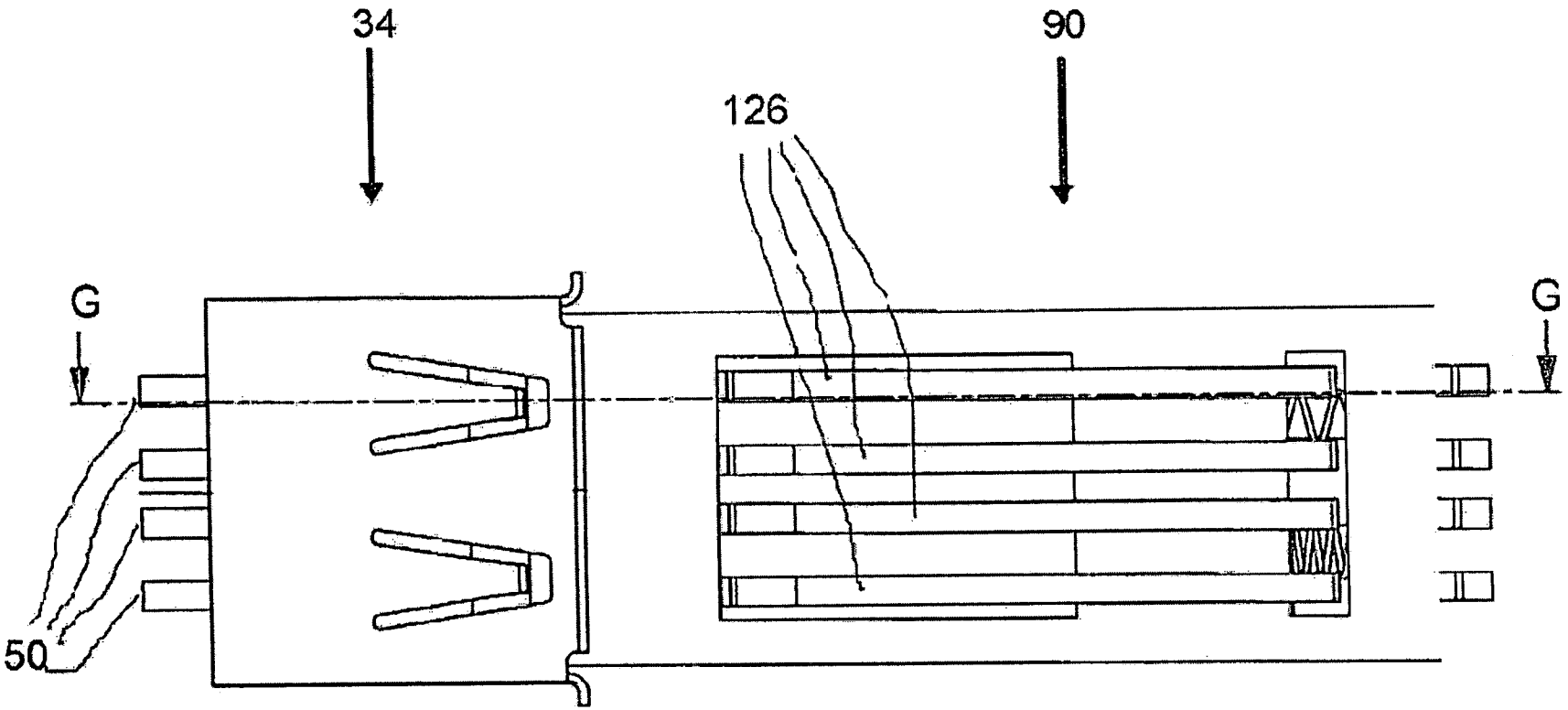
FIG. 4*f* is a plan view of the plug of FIG. 4*a* inserted into an A-type USB standard receptacle.
Figure 4G:
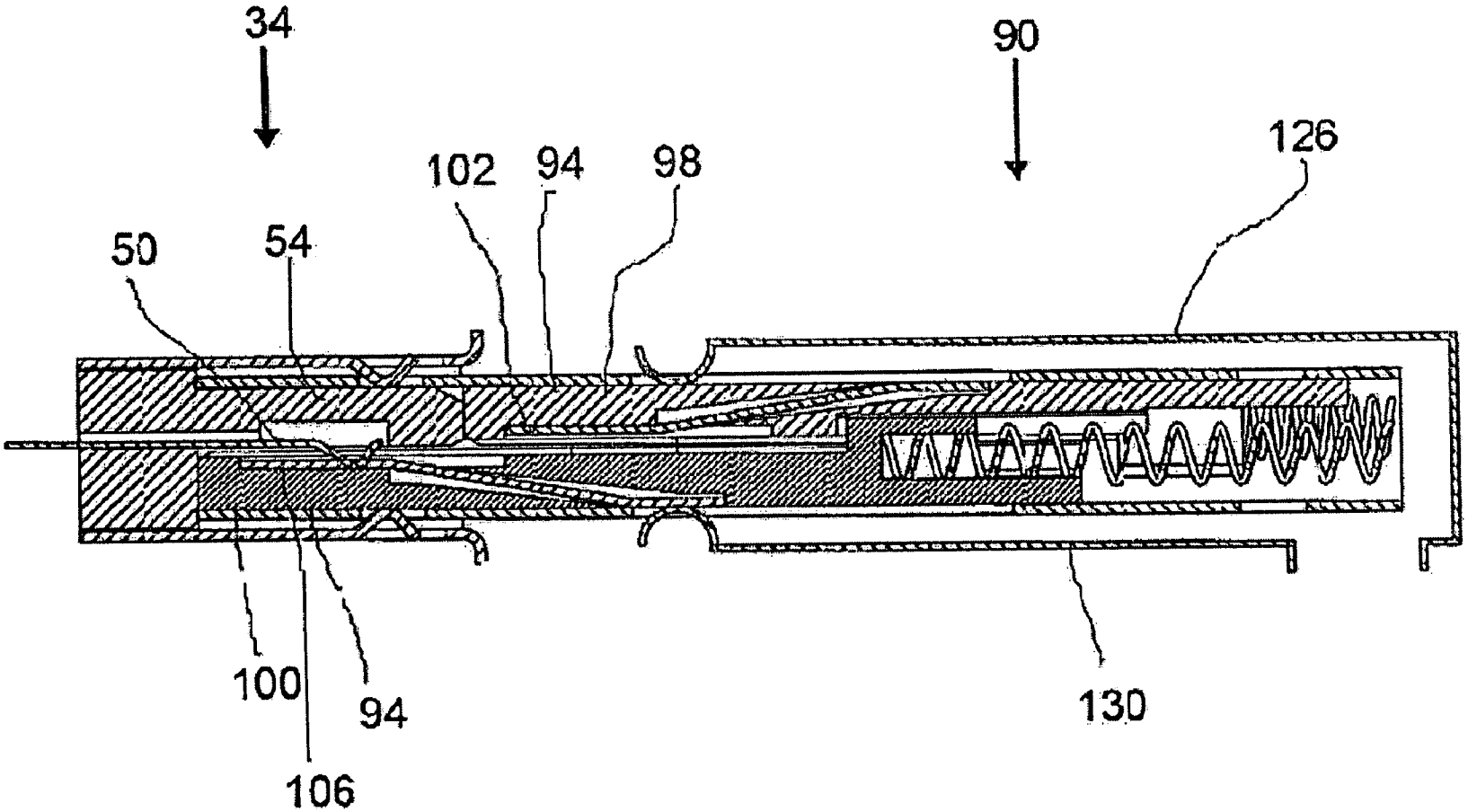
FIG. 4*g* is a sectional view through line G—G of FIG. 4*f;*

Reference is now made to FIGS. 4*f* and 4*g*. FIG. 4*f* is a plan view of reversible plug 90 of FIG. 4*a* inserted into A-type USB standard receptacle 34. FIG. 4*g* is a sectional view through line G—G of FIG. 4*f*. Depending upon the coupling orientation of reversible plug 90 with A-type USB standard receptacle 34 one of blocks 94 is pushed back to the retracted position by insulating block 54 of A-type USB standard receptacle 34. The other block remains in the operative position so that its electrical contacts make contact with electrical contacts 50 of A-type USB standard receptacle 34. In the example of FIGS. 4*f* and 4*g*, a first coupling orientation of reversible plug 90 with A-type USB standard receptacle 34, upper block 98 is moved by insulating block 54 of A-type USB standard receptacle 34 to the retracted position. Lower block 100 remains in the operative position with electrical contacts 106 in electrical contact with electrical contacts 50 of A-type USB standard receptacle 34.

Similarly, if either reversible plug 90 or A-type USB standard receptacle 34 is turned over, reversible plug 90 and A-type USB standard receptacle 34 couple in a second coupling orientation. In this second coupling orientation, lower block 100 is moved by insulating block 54 of A-type USB standard receptacle 34 to the retracted position. Upper block 98 remains in the operative position with electrical contacts 102 in electrical contact with electrical contacts 50 of A-type USB standard receptacle 34.

When either of blocks 98, 100 are pushed back from the operative position to the retracted position electrical contacts 102 and electrical contacts 106 are electrically isolated from electrical terminals 126 and electrical terminals 130, respectively.

Figure 9A:
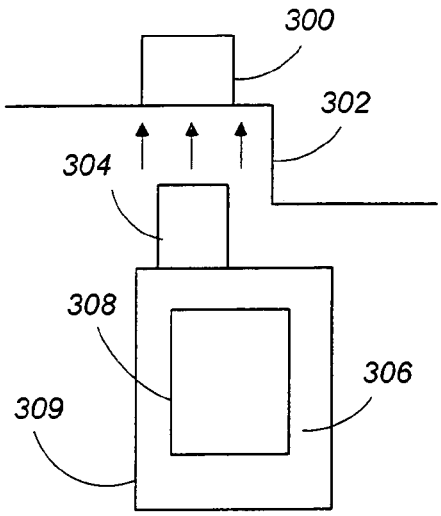
FIGS. 9*a*–9*h* are generic schematic representations of a reversible device that is constructed and operable in accordance with a preferred embodiment of the present invention.
Figure 9B:
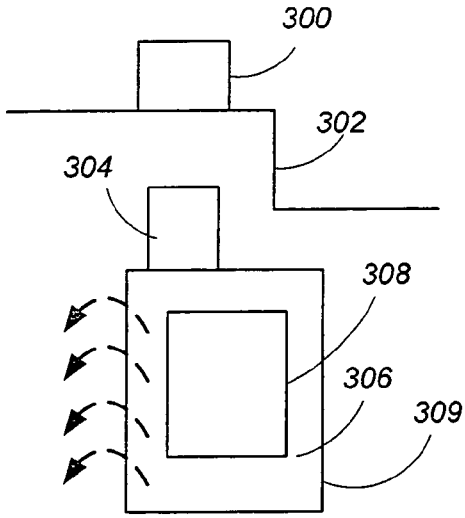
Figure 9C:
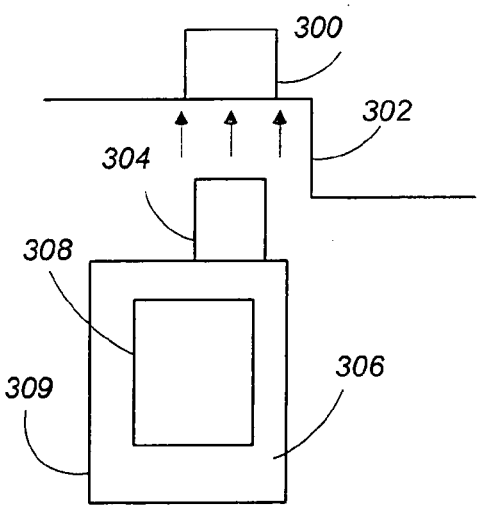
Figure 9D:
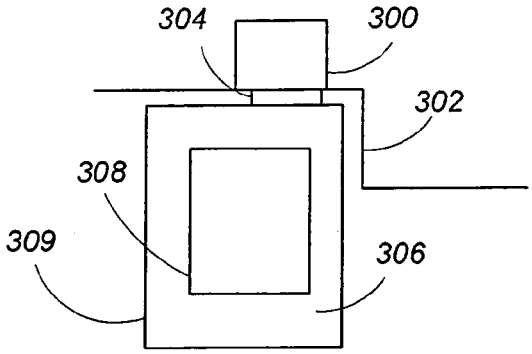
Figure 9E:
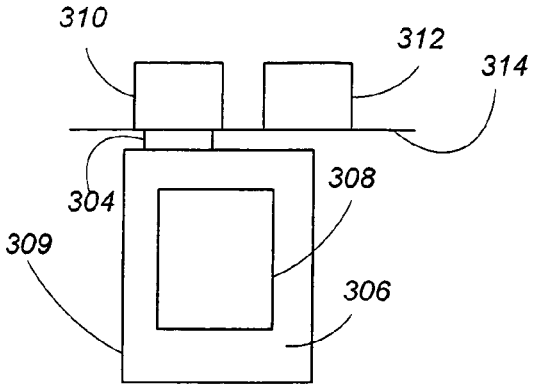
Figure 9F:
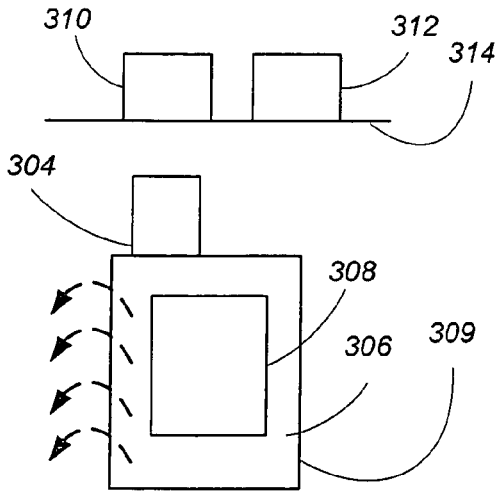
Figure 9G:
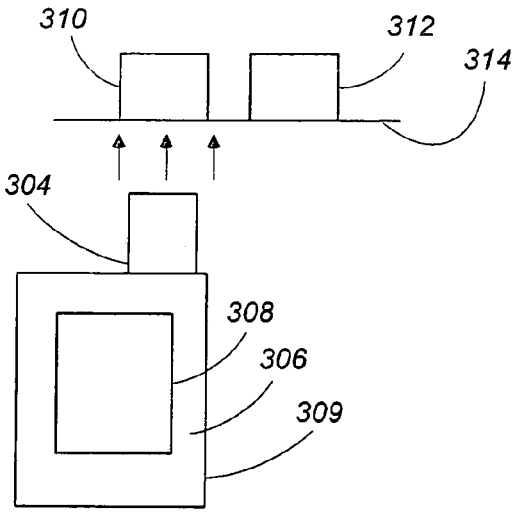
Figure 9H:
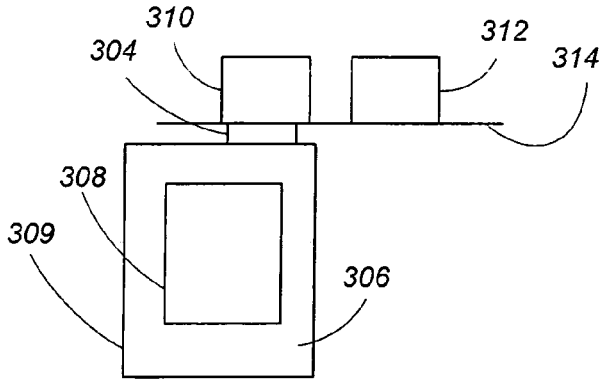

Referring now to FIGS. 9*a–9h*, schematic block diagrams depicting a reversible device that is constructed and operable in accordance with a preferred embodiment of the present invention. It should be noted that the term USB device is defined herein as an apparatus containing a USB plug, where as a USB appliance is defined herein as an apparatus containing a USB receptacle. Reversible USB device 306 includes a functional unit 308. Functional unit 308 is configured to perform at least one function, a non-limiting example of which is the storing of data packages on reversible USB device 306. Reversible USB device 306 further includes a reversible USB plug 304 which is connected to functional unit 308 and is used for interconnecting functional unit 308 with appliance 302. Reversible plug 304 conforms with any of the above mentioned embodiments or one of their possible derivatives. Reversible device 306 also consists of a body 309, serving as a physical encasement and housing for functional unit 308. Body 309 is constructed so it may be gripped by the user, being the physical element that is held by the user when attempting to engage reversible USB device 306 with appliance 302. Reversible plug 304 protrudes directly from body 309 in a rigid manner, or at least in a non-rotatable manner, and is situated asymmetrically in relation to the sides of body 309, the asymmetric positioning being for aesthetic or functional reasons. Appliance 302 contains a standard USB receptacle 300. FIG. 9*a* shows reversible USB device 306 positioned in a first coupling orientation in relation to appliance 302 and aligned for insertion. Yet, appliance 302 has a physical structure which prevents the insertion of reversible USB device 306 into standard USB receptacle 300 in a first coupling orientation. The coupling orientation of reversible device 306 is changed by the turning over of device 306, as can be seen in FIG. 9*b*. In the second coupling orientation (FIG. 9*c*) the physical structure of appliance 302 does not prevent the insertion of reversible USB device 306 into standard USB receptacle 300. Reversible USB plug 304, which may be inserted into a standard receptacle in both first and second coupling orientation, is coupled with standard receptacle 300 (FIG. 9*d*) thus connecting reversible device 306 and appliance 302 in the prescribed manner. FIGS. 9*e–9h* show another example of the coupling of reversible USB device 306 and an appliance containing a standard USB receptacle. Appliance 314 contains a standard USB receptacle 310 which is to be coupled with reversible USB plug 304 of reversible device 306. Appliance 314 further contains another standard USB receptacle 312. As can be seen in FIG. 9*e*, reversible USB device 306 is aligned with standard USB receptacle 310 in a first coupling orientation. In this orientation, the body of reversible USB device 306 obstructs the hollow opening of standard USB receptacle 312 due to the proximity of neighboring standard receptacles 310 and 312. Thus, another device employing a USB plug (not shown) may not be inserted into and coupled with standard receptacle 312. It should be noted that receptacle 312 is exemplary and may be any port, display or general feature that is obstructed by the physical structure of reversible USB device 306. The coupling orientation of reversible USB device 306 is changed by extracting device 306 from the standard receptacle 300 (FIG. 9*f*) and turning it over (FIG. 9*g*) in the same manner as has been described in FIG. 9*b*. FIG. 9*h* shows reversible USB device 306 coupled with standard USB receptacle 310 in a second coupling orientation, receptacle 312 being unobstructed, thus allowing the coupling of another USB device with it (not shown).

The next four embodiments relate to embodiments of a reversible receptacle for coupling with an A-type USB standard plug.

Figure 5A:
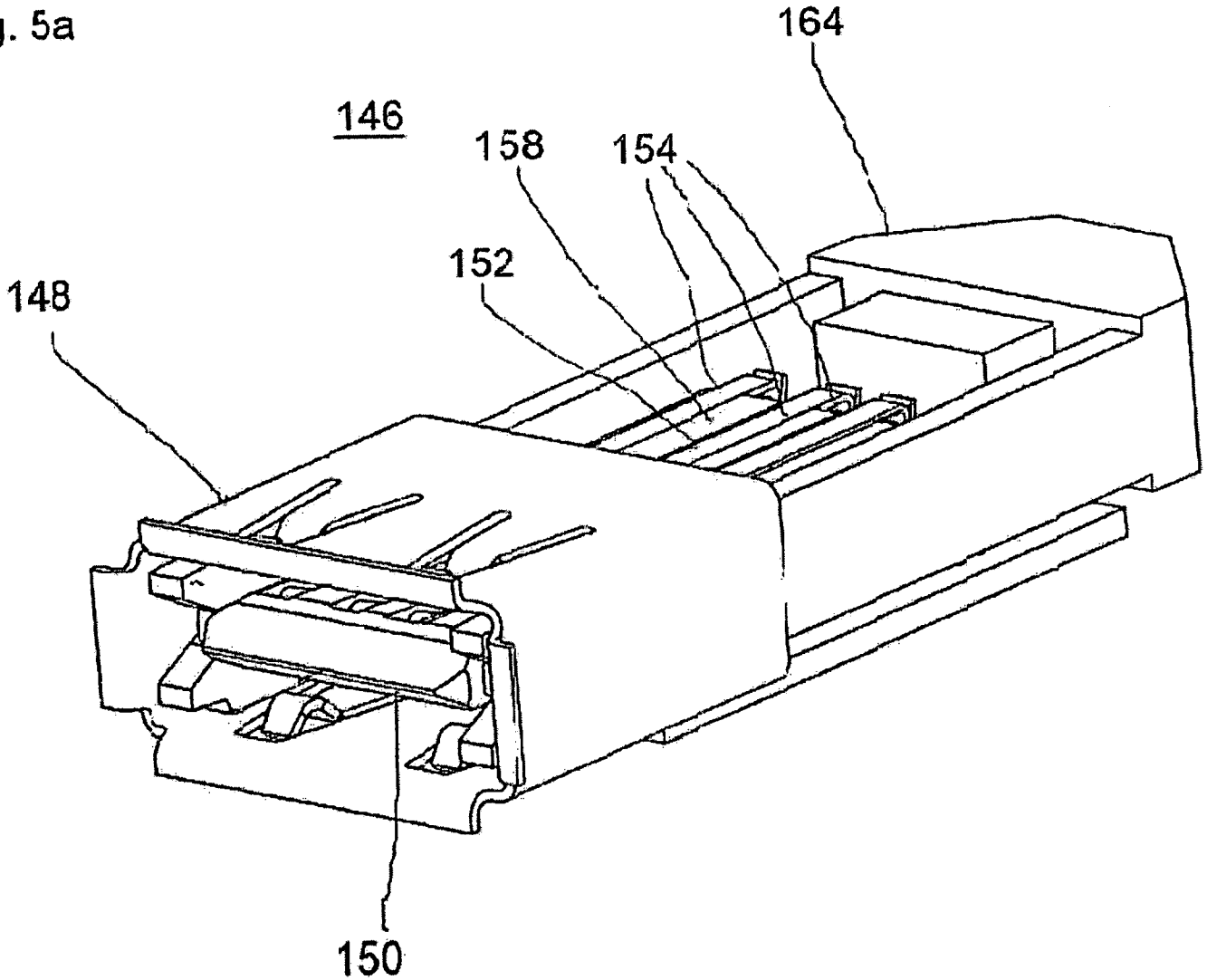
FIG. 5*a* is an isometric view of a reversible receptacle that is constructed and operable in accordance with a preferred embodiment of the present invention.
Figure 5B:
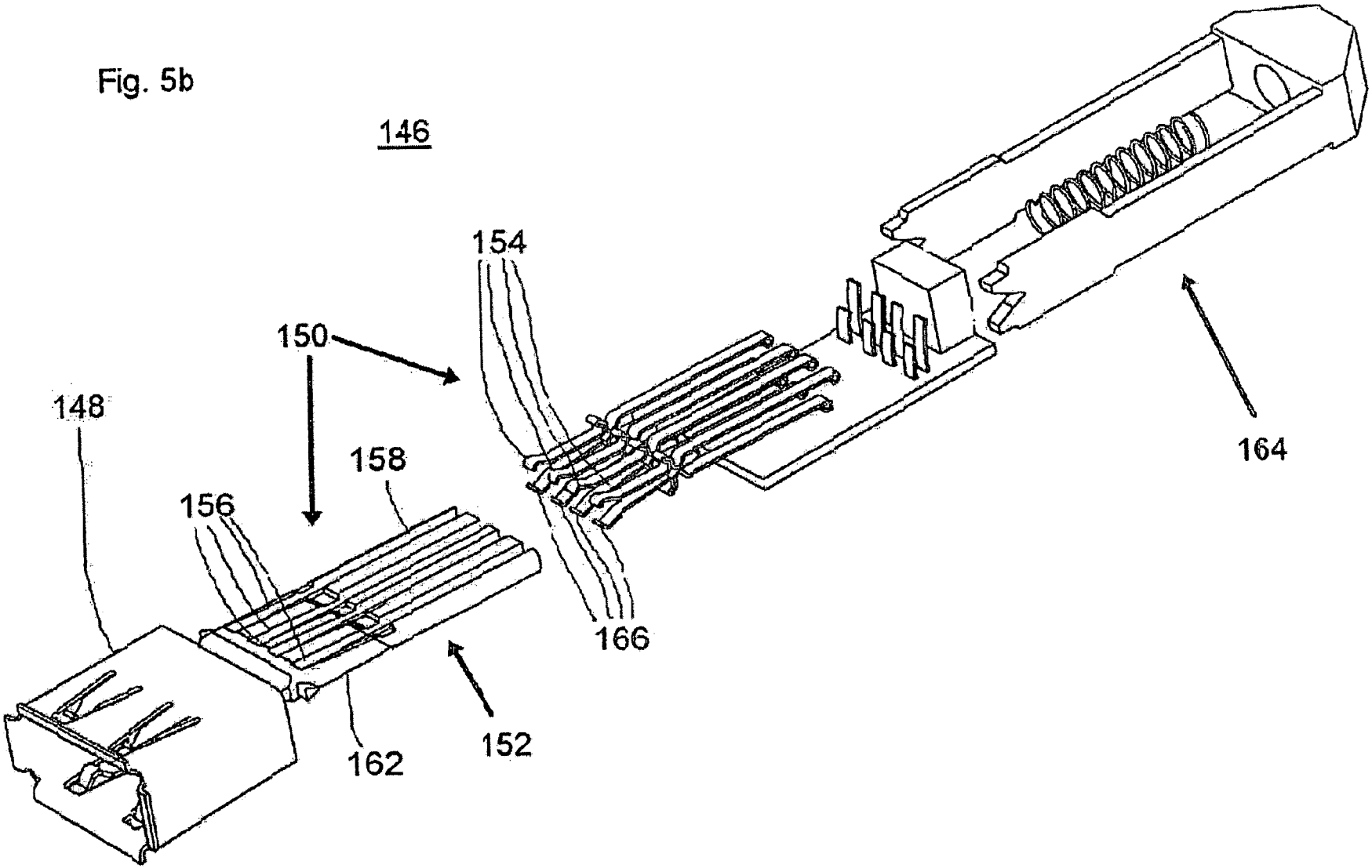
FIG. 5*b* is an exploded isometric view of the receptacle of FIG. 5*a;*

Reference is now made to FIGS. 5*a* and 5*b*. FIG. 5*a* is an isometric view of a reversible receptacle (socket) 146 that is constructed and operable in accordance with a preferred embodiment of the present invention. FIG. 5*b* is an exploded isometric view of reversible receptacle 146 of FIG. 5*a*. Reversible receptacle 146 is substantially the same as reversible plug 10 of FIGS. 1*a–f* except for the following differences described below and in FIGS. 5*a* to 5*e*. Reversible receptacle 146 has a sleeve 148. Sleeve 148 is an electrically conducting shield, similar to shield 52 of A-type USB standard receptacle 34. Reversible receptacle 146 has a tongue arrangement 150 having a central insulating layer 152 with a set of electrical contacts 154 disposed in grooves 156 on an upper side 158 of central insulating layer 152 and another set of electrical contacts 166 disposed in grooves on a lower side 162 of central insulating layer 152. Tongue arrangement 150 is hinged so tongue arrangement 150 is able to move up and down. Reversible receptacle 146 has a centering mechanism 164 which operates substantially the same as centering mechanism 18 of reversible plug 10.

Figure 5C:
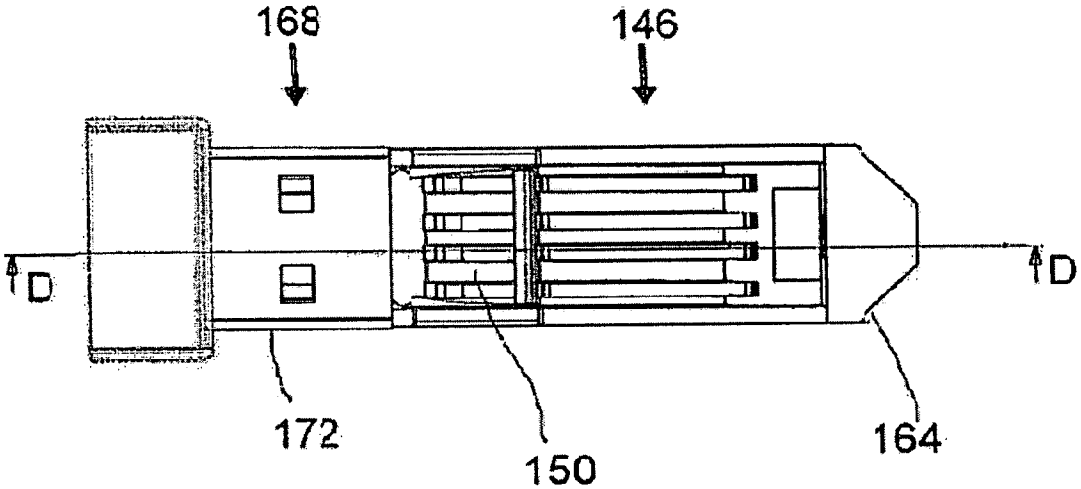
FIG. 5*c* is a plan view of the receptacle of FIG. 5*a* making contact with an A-type USB standard plug.
Figure 5D:
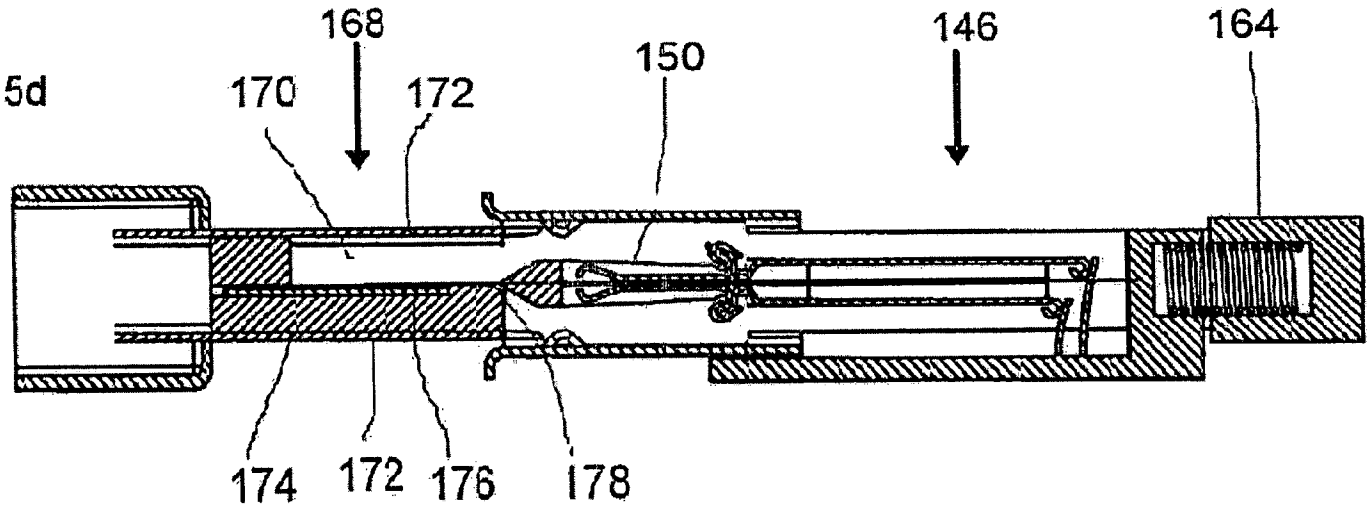
FIG. 5*d* is a sectional view through line D—D of FIG. 5*c;*

Reference is now made to FIGS. 5*c* and 5*d*. FIG. 5*c* is a plan view of reversible receptacle 146 of FIG. 5*a* making contact with an A-type USB standard plug 168. FIG. 5*d* is a sectional view through line D—D of FIG. 5*c*. A-type USB standard plug 168 has a hollow 170 surrounded on three sides by an electrically conducting shield 172. A block 174 having a set of four electrical contacts 176 thereon is disposed on a fourth side of hollow 170. Block 174 has a beveled edge 178 toward the center of shield 172. As reversible receptacle 146 is inserted into A-type USB standard plug 168, centering mechanism 164 is released and beveled edge 178 of block 174 of A-type USB standard plug 168 pushes tongue arrangement 150 upward.

Figure 5E:
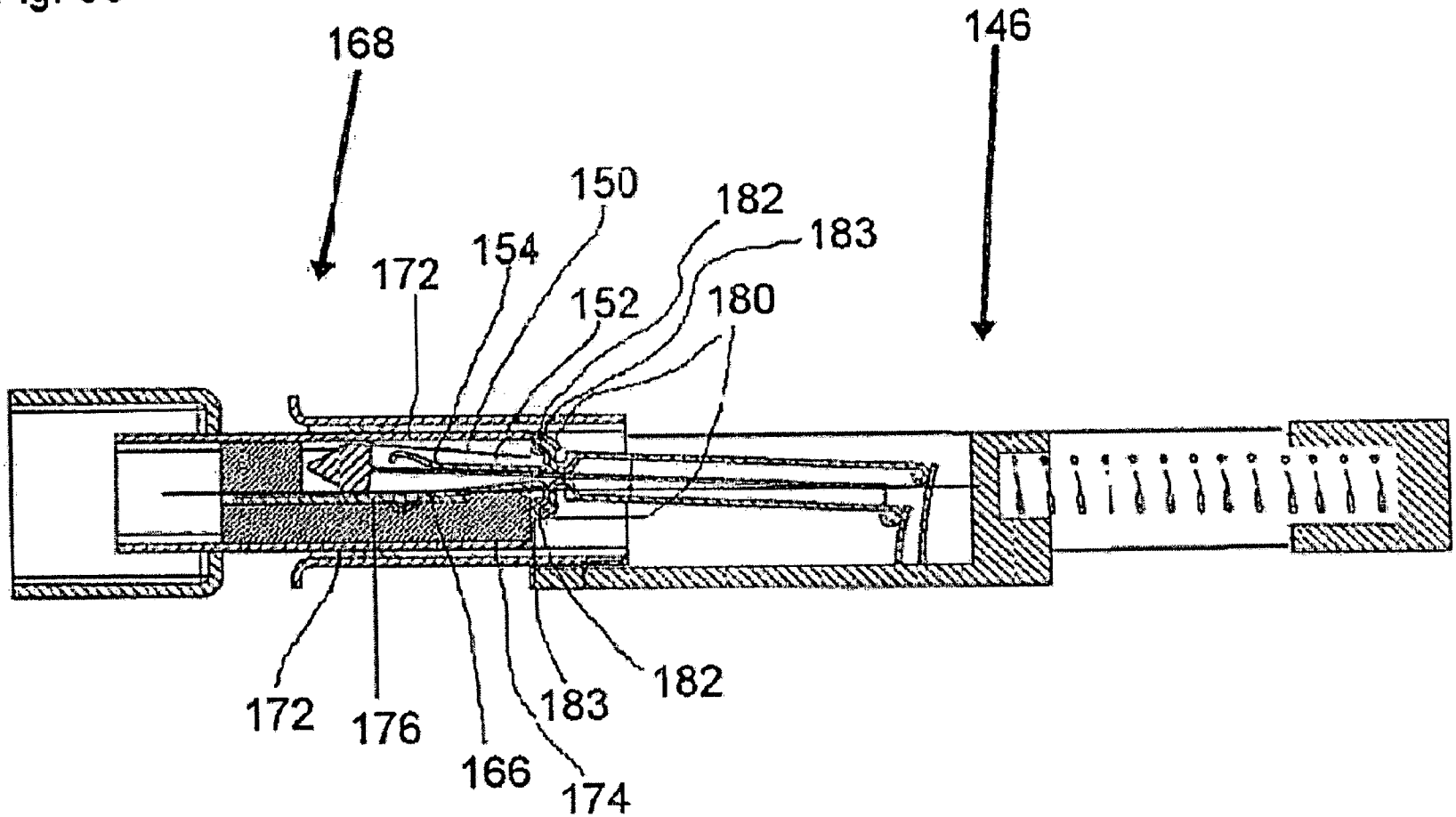
FIG. 5*e* is a sectional view of the receptacle and plug of FIG. 5*c* fully coupled.

Reference is now made to FIG. 5*e*, which is a sectional view of reversible receptacle 146 and A-type USB standard plug 168 of FIG. 5*c* fully coupled. By way of introduction, electrical contacts 50 of A-type USB standard receptacle 34 have projecting portions 51 which make electrical contact with the flat contacts of the plug inserted into hollow section 48 of A-type USB standard receptacle 34. If the contacts of A-type USB standard receptacle 34 did not have projections, contact would not be made between electrical contacts 50 of A-type USB standard receptacle 34 and the flat contacts of a USB plug. Therefore, electrical contacts 154 and electrical contacts 166 of reversible receptacle 146 need to have projecting portions so that electrical contacts 154 and electrical contacts 166 make contact with the flat contacts of an A-type USB standard plug. However, if both electrical contacts 154 and electrical contacts 166 had projecting portions, the projecting portions would interfere with coupling of reversible receptacle 146 and A-type USB standard plug 168 since the metal sleeve surface of the standard plug facing its contacts does not have recesses to accommodate such projections. Additionally, inserting A-type USB standard plug 168 in a first orientation would result in the projecting portions of electrical contacts 154 making contact with shield 172 of A-type USB standard plug 168 and thereby short-circuiting the electrical contacts of reversible receptacle 146, a similar situation occurs when inserting standard plug 168 in a second orientation. Therefore, electrical contacts 154 and electrical contacts 166 are generally recessed below the surface of central insulating layer 152 and are configured to be selectively deflected away from central insulating layer 152 when required, as will be described below.

Reversible receptacle 146 includes a contact raising arrangement 180. In the example of FIG. 5*e*, reversible receptacle 146 is in a first coupling orientation with A-type USB standard plug 168. Contact raising arrangement 180 is configured for deflecting electrical contacts 166 away from tongue arrangement 150, so that electrical contacts 166 make mechanical contact with the electrical contacts 176 of A-type USB standard plug 168. The term "deflecting away from tongue arrangement" is defined herein as moving the electrical contacts away from central insulating layer 152. The phrase "contact raising" is used herein to refer to a localized deflection of one or more metallic strip providing a contact region towards the corresponding surface with which it is to make electrical contact. Electrical contacts 154 remain recessed below central insulating layer 152 and therefore electrical contacts 154 are electrically isolated from shield 172 of A-type USB standard plug 168.

Similarly, in a second coupling orientation (not shown) of reversible receptacle 146 and A-type USB standard plug 168, electrical contacts 154 are deflected away from tongue arrangement 150, so that electrical contacts 154 makes mechanical contact with electrical contacts 176 of A-type USB standard plug 168. Electrical contacts 166 remain recessed below central insulating layer 152 and therefore electrical contacts 166 are electrically isolated from shield 172 of A-type USB standard plug 168.

Contact raising arrangement 180 is formed as part of electrical contacts 166 and electrical contacts 154 as follows. Each electrical contact 154, 166 has a doubled over portion towards its middle to form a loop 182. Each loop 182 is covered by an insulating cap 183. Loop 182 is pushed by block 174 just before reversible receptacle 146 is fully coupled with A-type USB standard plug 168. Pushing loop 182 deflects the associated contact way from tongue arrangement 150. For example, in the first coupling orientation, loops 182 of electrical contacts 166 are pushed by block 174 thereby deflecting electrical contacts 166 away from tongue arrangement 150. However, loops 182 of electrical contacts 154 are not moved and therefore electrical contacts 154 remain recessed in tongue arrangement 150.

Figure 6A:
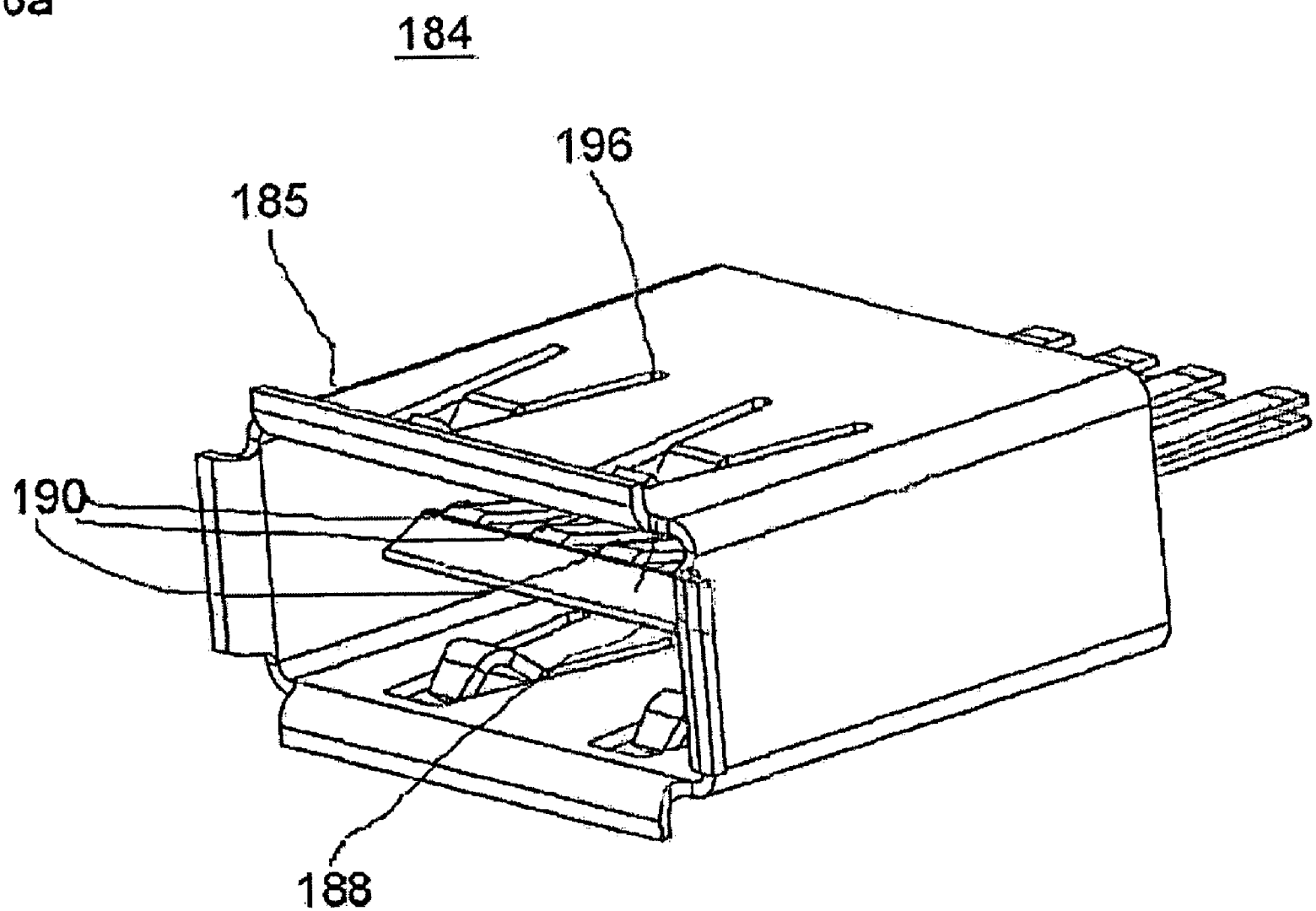
FIG. 6*a* is an isometric view of a reversible receptacle (without its accompanying circuit board) that is constructed and operable in accordance with a first alternate embodiment of the present invention.
Figure 6B:
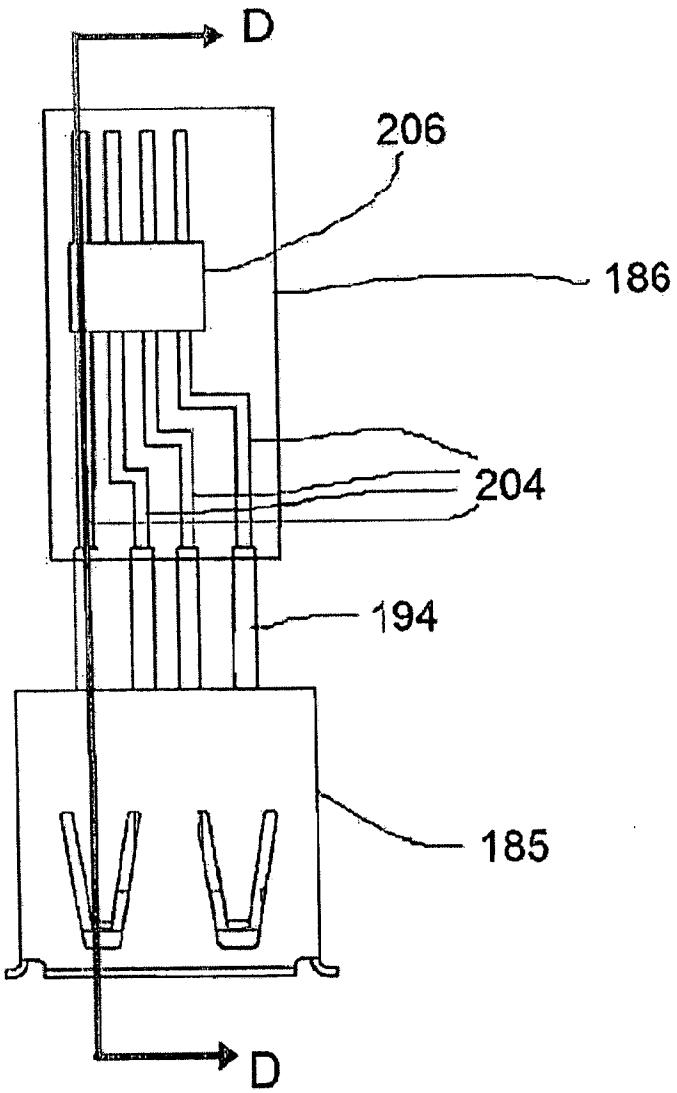
FIG. 6*b* is plan view of the receptacle of FIG. 6*a* (with its accompanying circuit board)
Figure 6C:
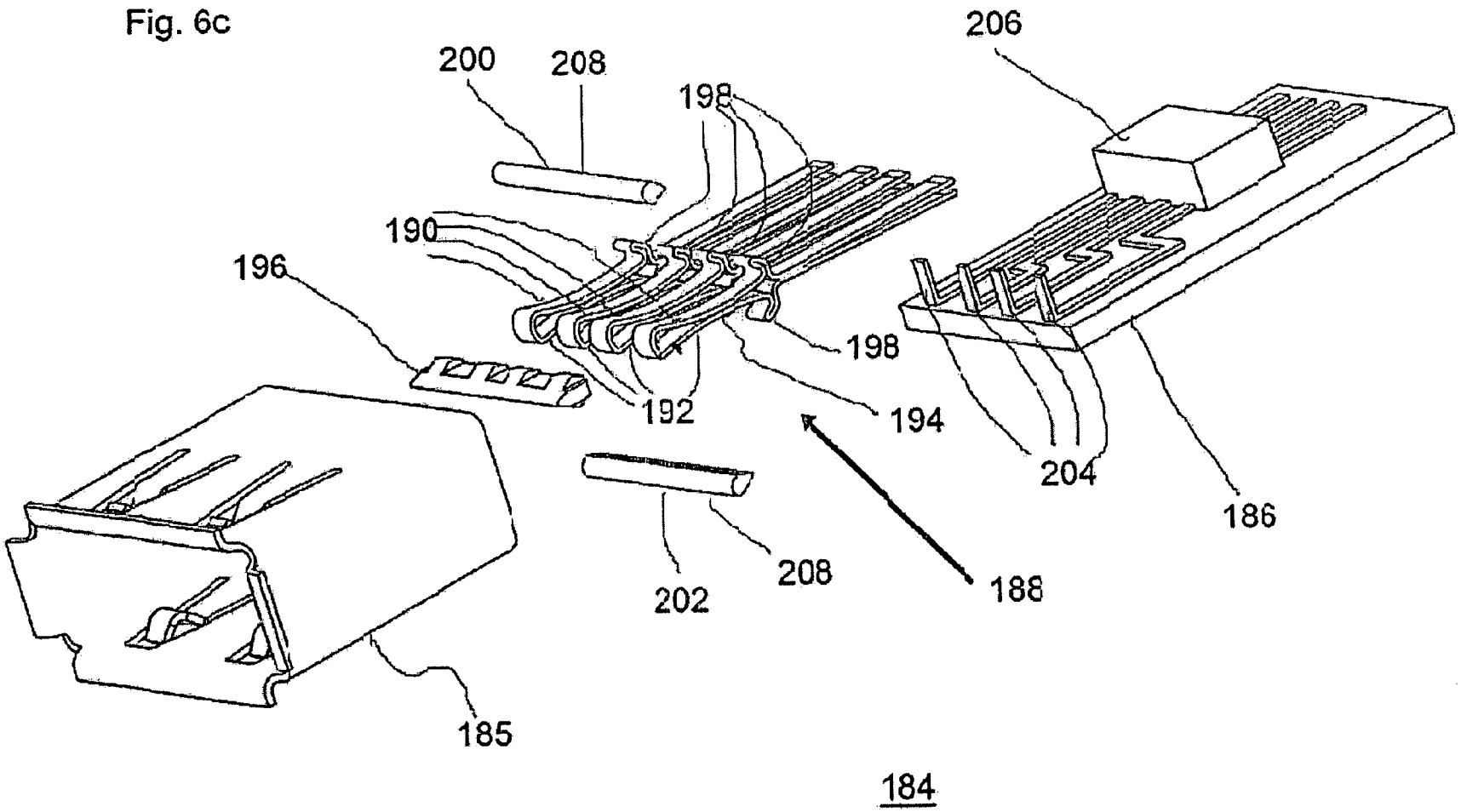
FIG. 6*c* is an exploded isometric view of the receptacle of FIG. 6*c;*

Reference is now made to FIGS. 6*a*–6*c*. FIG. 6*a* is an isometric view of a reversible receptacle 184 (without its accompanying circuit board) that is constructed and operable in accordance with a first alternate embodiment of the present invention. FIG. 6*b* is plan view of reversible receptacle 184 of FIG. 6*a* (with its accompanying circuit board 186). FIG. 6*c* is an exploded isometric view of reversible receptacle 184 of FIG. 6*c*. Reversible receptacle 184 is substantially the same as reversible plug 58 of FIGS. 2*a*–2*f* except for the differences described below and shown in FIGS. 6*a* to 6*c*. Reversible receptacle 184 has a sleeve 185 with is substantially the same as sleeve 148 of reversible receptacle 146 of FIG. 5*a*. Reversible receptacle 184 has a tongue arrangement 188 centrally disposed in sleeve 185. Tongue arrangement 188 has an upper set of contact regions 190 and a lower set of contact regions 192. Upper set of contact regions 190 and lower set of contact regions 192 form a leaf spring electrical contact arrangement 194. Tongue arrangement 188 has an insulated cap 196 disposed at the tip of tongue arrangement 188. Insulated cap 196 is described in more detail with reference to FIGS. 6*d* and 6*e*. Each contact of upper set of contact regions 190 and lower set of contact regions 192 is doubled over towards the middle of each contact to form a plurality of loops 198 projecting from tongue arrangement 188. Loops 198 of upper set of contact regions 190 are covered with an insulating cover 200. Similarly, loop 198 of lower set of contact regions 192 are covered with an insulating cover 202. Insulating covers 200 and 202 provide protection against the loops 198 becoming shorted against the outer shielding of the plug. Loops 198, insulating cover 200 and insulating cover 202 form a tongue actuator 208 which is described in more detail with reference to FIG. 6*e*.

A set of four electrical terminals 204 is disposed on accompanying circuit board 186. Electrical terminals 204 are connected to the rear of leaf spring electrical contact arrangement 194 and an electronic switching arrangement 206. Electronic switching arrangement 206 performs the same function as electronic switching arrangement 70 of reversible plug 58 of FIG. 2*f*.

Figure 6D:
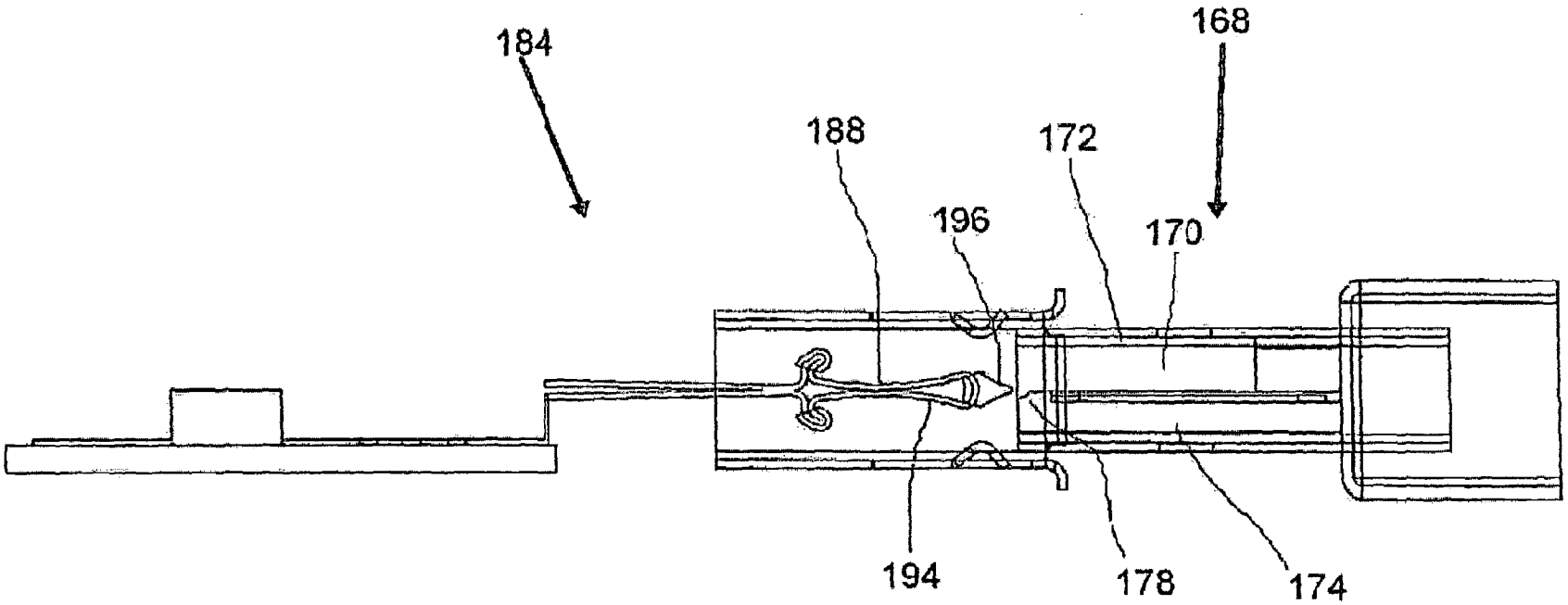
FIG. 6*d* is a sectional of the receptacle of FIG. 6*b* through line D—D making contact with an A-type USB standard plug.

Reference is now made to FIG. 6*d*, which is a sectional of reversible receptacle 184 of FIG. 6*b* through line D—D making contact with A-type USB standard plug 168. As A-type USB standard plug 168 is inserted into reversible receptacle 184, tongue arrangement 188 is pushed up by beveled edge 178 of block 174 of A-type USB standard plug 168. Tongue arrangement 188 is pushed up so much that tongue arrangement 188 touches shield 172 of A-type USB standard plug 168. Therefore, insulated cap 196 is configured for preventing electrical contact between leaf spring electrical contact arrangement 194 and shield 172 of A-type USB standard plug 168 as tongue arrangement 188 couples with hollow 170 of A-type USB standard plug 168. In other words, insulated cap 196 and leaf spring electrical contact arrangement 194 are configured so that when a central plane of tongue arrangement 188 makes an acute angle with shield 172, the first part of tongue arrangement 188 to make contact with shield 172 is insulated cap 196. Therefore, leaf spring electrical contact arrangement 194 is prevented from making contact with shield 172.

Figure 6E:
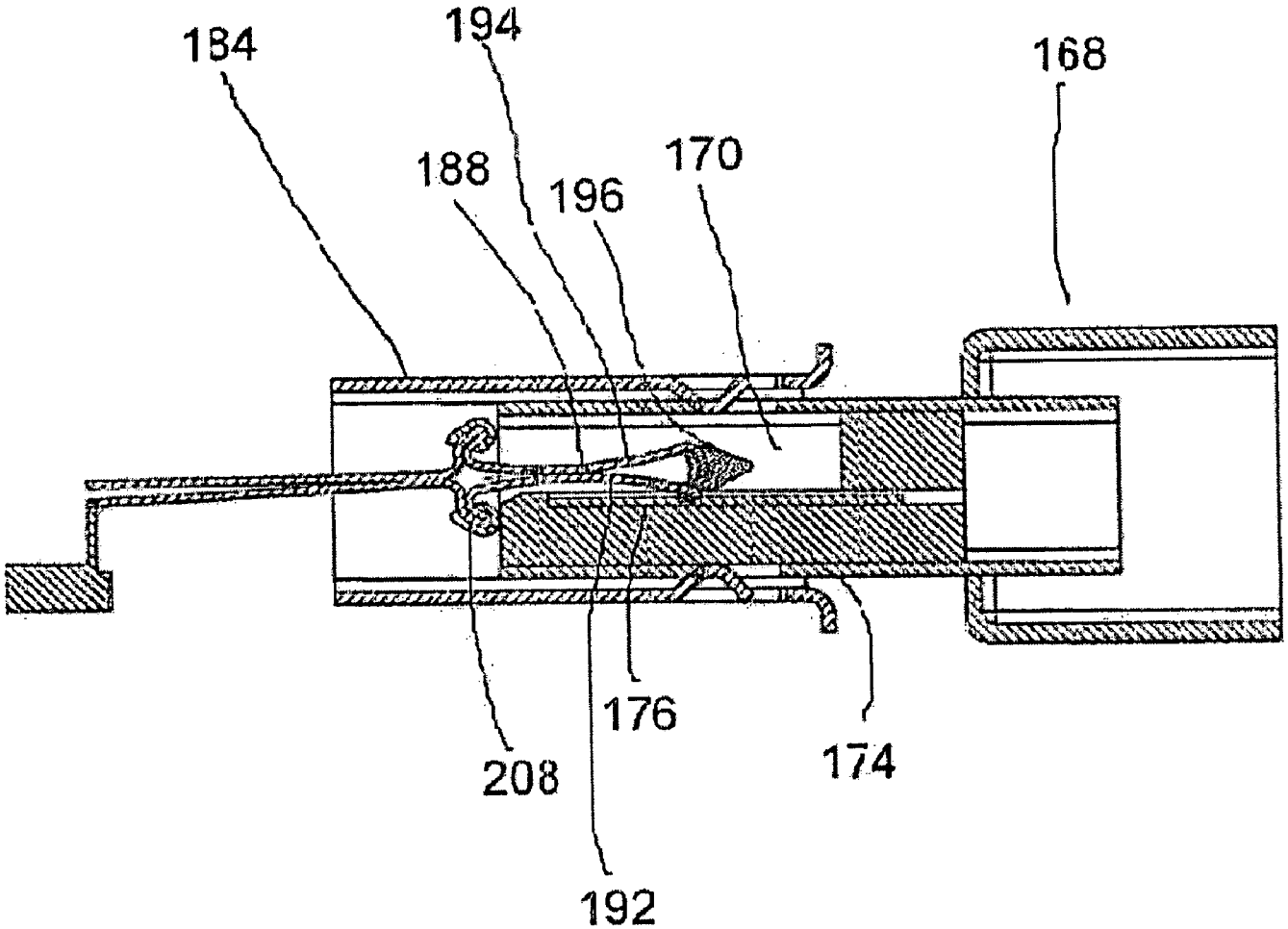
FIG. 6*e* is a sectional view of the plug and receptacle of FIG. 6*d*, fully coupled.

Reference is now made to FIG. 6*e*, which is a sectional view of reversible receptacle 184 and A-type USB standard plug 168 of FIG. 6*d*, fully coupled. As A-type USB standard plug 168 is pushed further into hollow 170 of reversible receptacle 184, block 174 of A-type USB standard plug 168 pushes on tongue actuator 208. Tongue actuator 208, in turn, points tongue arrangement 188 back down towards the electrical contacts 176 of A-type USB standard plug 168 so that the central plane of tongue arrangement 188 is approximately horizontal. Insulated cap 196 and leaf spring electrical contact arrangement 194 are configured such that, as tongue arrangement 188 is pointed back down with the central plane of tongue arrangement 188 approximately horizontal, the first part of tongue arrangement 188 to make contact with electrical contacts 176 is leaf spring electrical contact arrangement 194. Therefore, insulated cap 196 does not prevent leaf spring electrical contact arrangement 194 from making contact with electrical contacts 176. Therefore, insulated cap 196 and leaf spring electrical contact arrangement 194 need to be configured to: (a) prevent contact between leaf spring electrical contact arrangement 194 when tongue arrangement 188 is pointing up toward shield 172; and (b) allow contact between leaf spring electrical contact arrangement 194 and electrical contacts 176 when tongue arrangement 188 is pointed back down. Leaf spring electrical contact arrangement 194 and insulated cap 196 are symmetrical about the central plane of tongue arrangement 188 so that in a second coupling orientation leaf spring electrical contact arrangement 194 makes contact with electrical contacts 176, but leaf spring electrical contact arrangement 194 does not make contact with shield 172.

Figure 6F:
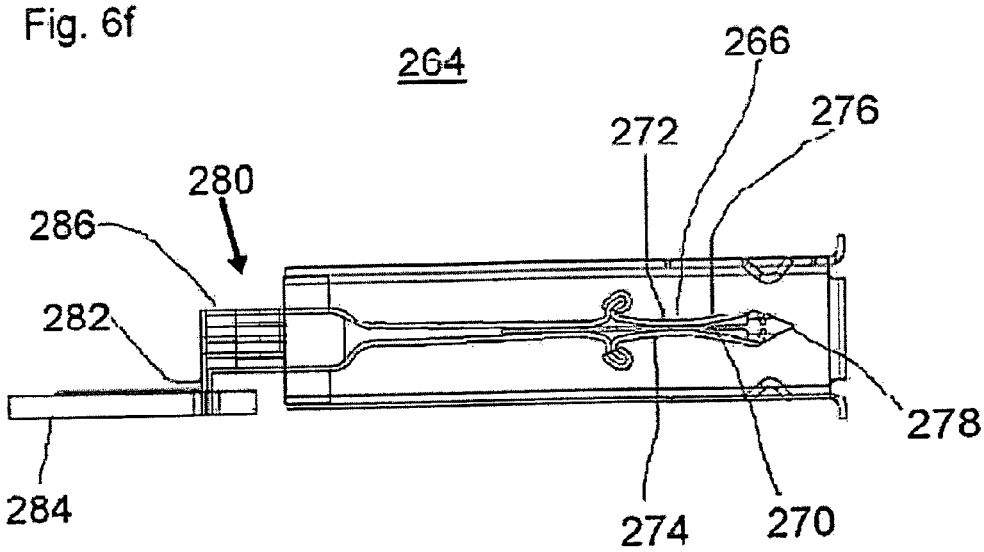
FIG. 6*f* is a sectional view of a reversible receptacle that is constructed and operable in accordance with a second alternate embodiment of the present invention.
Figure 6G:
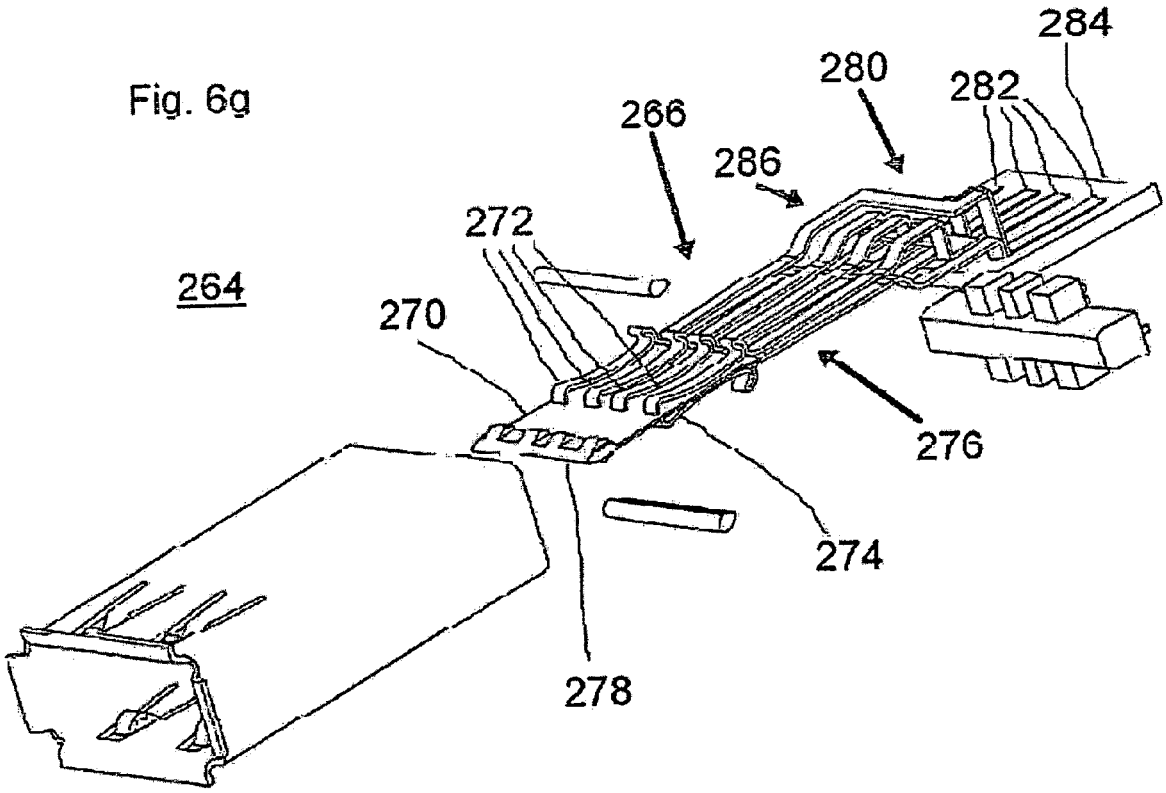
FIG. 6*g* is an exploded isometric view of the receptacle of FIG. 6*f;*
Figure 6H:
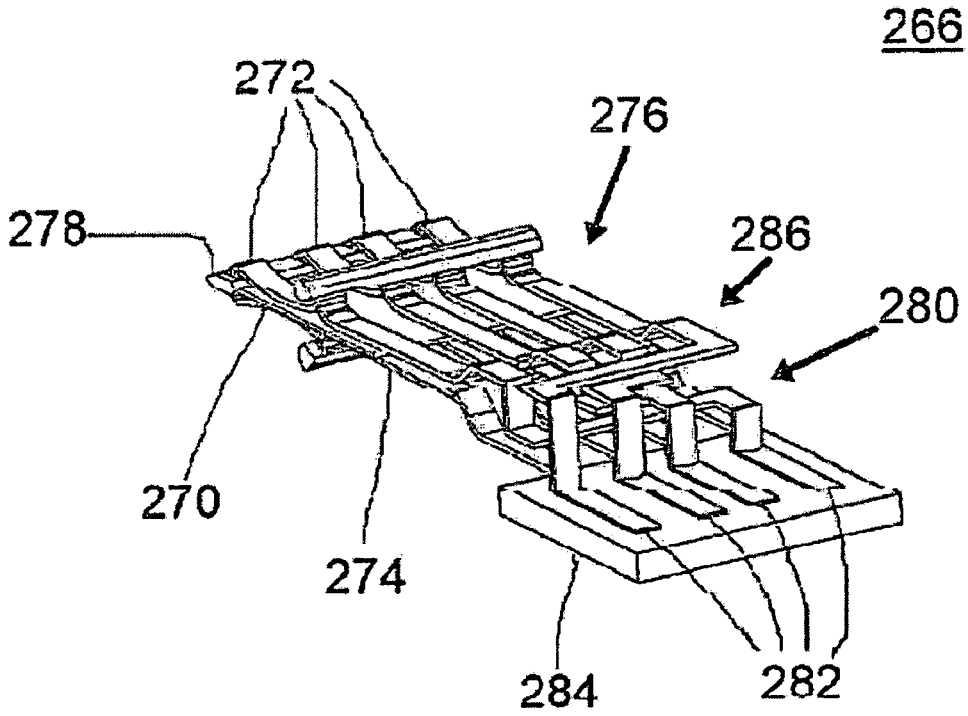
FIG. 6*h* is a rear isometric view of a tongue arrangement of the receptacle of FIG. 6*f;*
Figure 6I:
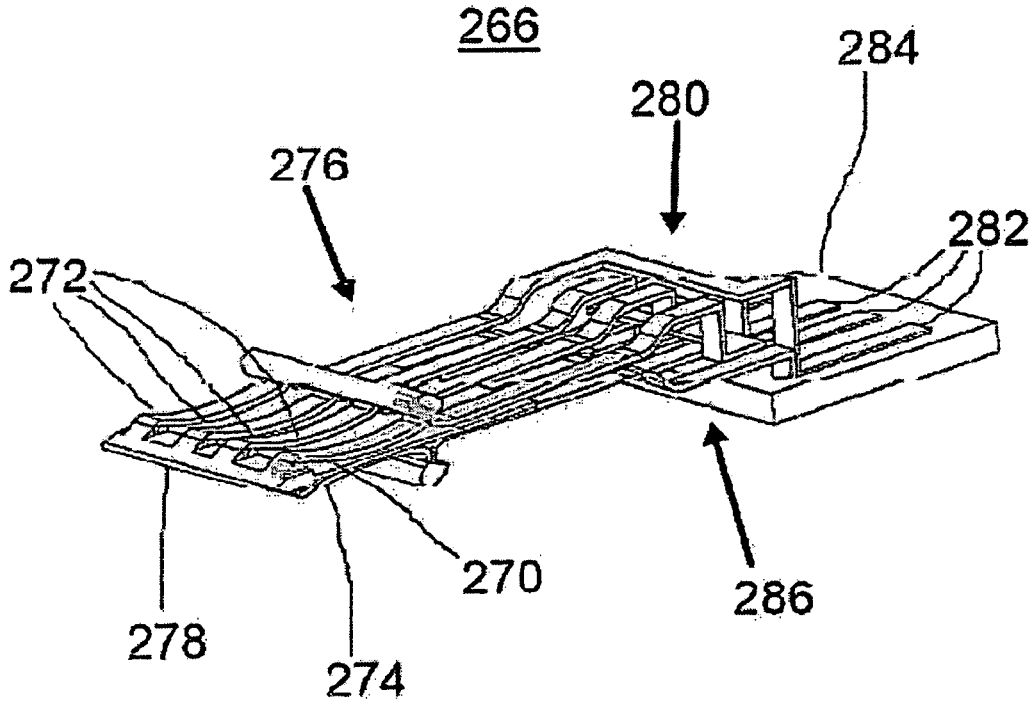
FIG. 6*i* is a front isometric view of the tongue arrangement of FIG. 6*h;*

Reference is now made to FIGS. 6*f* to 6*i*. FIG. 6*f* is a sectional view of a reversible receptacle 264 that is constructed and operable in accordance with a second alternate embodiment of the present invention. FIG. 6*g* is an exploded isometric view of reversible receptacle 264 of FIG. 6*f*. FIG. 6*h* is a rear isometric view of a tongue arrangement 266 of reversible receptacle 264 of FIG. 6*f*. FIG. 6*i* is a front isometric view of tongue arrangement 266 of FIG. 6*h*. Reversible receptacle 264 is substantially the same as reversible receptacle 184 of FIGS. 6*a* to 6*e* except for the differences described below and shown in FIGS. 6*f* to 6*i*. Tongue arrangement 266 has an insulating layer 270 disposed between a set of electrical contact regions 272 and a set of electrical contact regions 274. Set of electrical contact regions 272 and set of electrical contact regions 274 are formed as a leaf spring electrical contact arrangement 276. Set of electrical contact regions 272 and set of electrical contact regions 274 are not electrically connected at a tip 278 of tongue arrangement 266. As with reversible receptacle 184, the primary mechanical element of tongue arrangement 266 of reversible receptacle 184 is the set of metallic strips which also serves as a leaf spring electrical contact arrangement 276. Insulating layer 270 is primarily for electrically isolating set of electrical contact regions 272 and set of electrical contact regions 274 over the flexible portion of tongue arrangement 266. Reversible receptacle 264 also includes a printed circuit board interface connector arrangement 280 having four terminals 282 disposed thereon. Each terminal 282 is configured for connection to a printed circuit board 284. Printed circuit board interface connector arrangement 280 has a crossover arrangement 286 for electrically connecting electrically corresponding contact regions of set of electrical contact regions 272 and set of electrical contact regions 274 to terminals 282. Therefore, in whichever coupling orientation reversible receptacle 264 is inserted into an A-type USB standard plug, the same terminals of the A-type USB standard plug are in electrical contact with the same terminals 282 of printed circuit board interface connector arrangement 280.

Figure 7A:
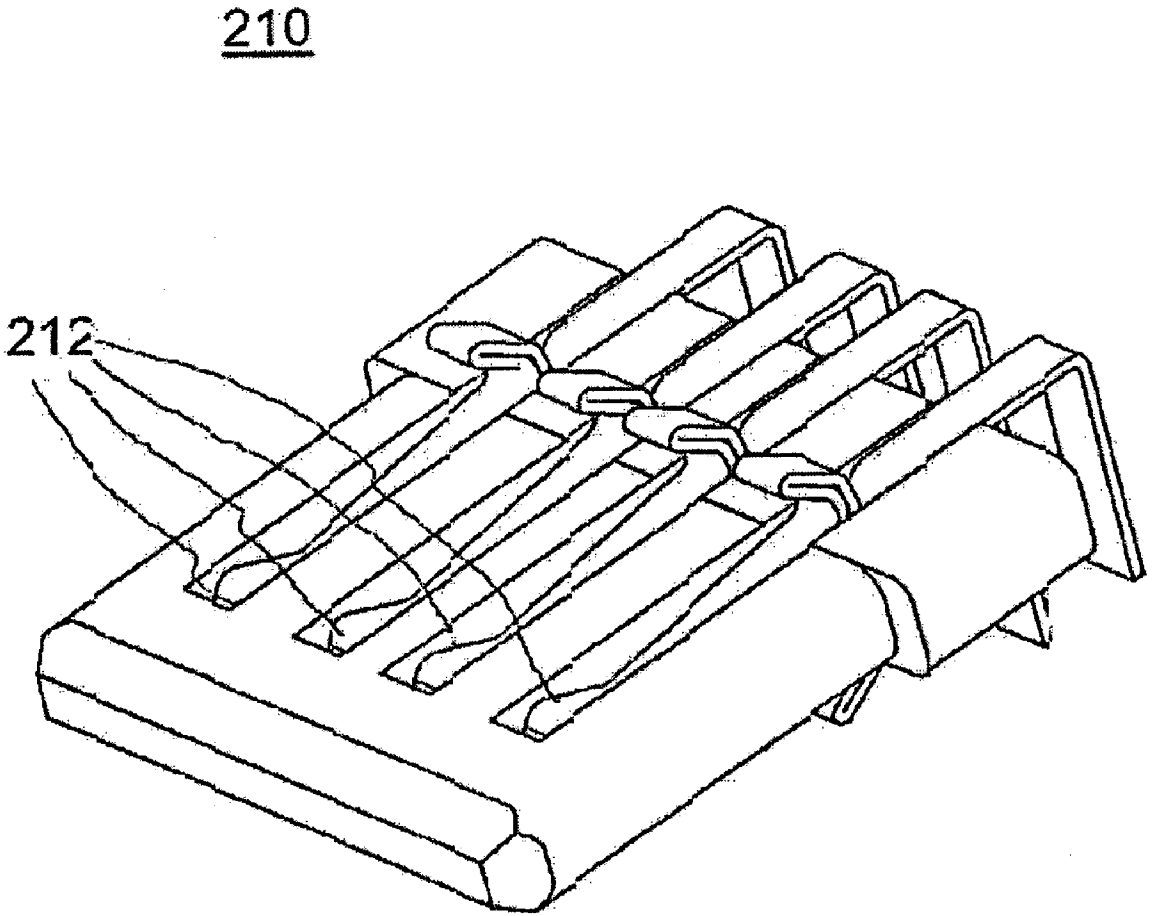
FIG. 7*a* is an isometric view of a reversible receptacle that is constructed and operable in accordance with a third alternate embodiment of the present invention.
Figure 7B:
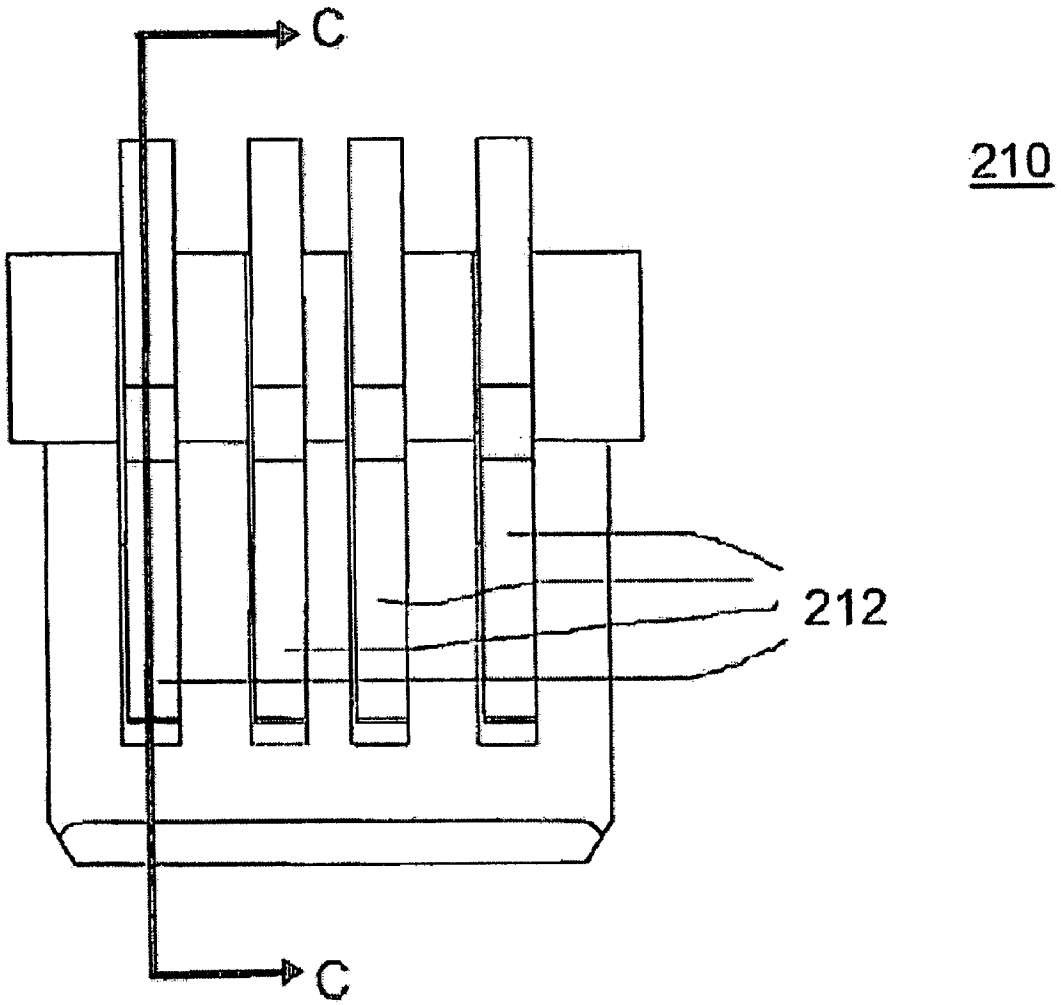
FIG. 7*b* is a plan view of the receptacle of FIG. 7*a;*
Figure 7C:
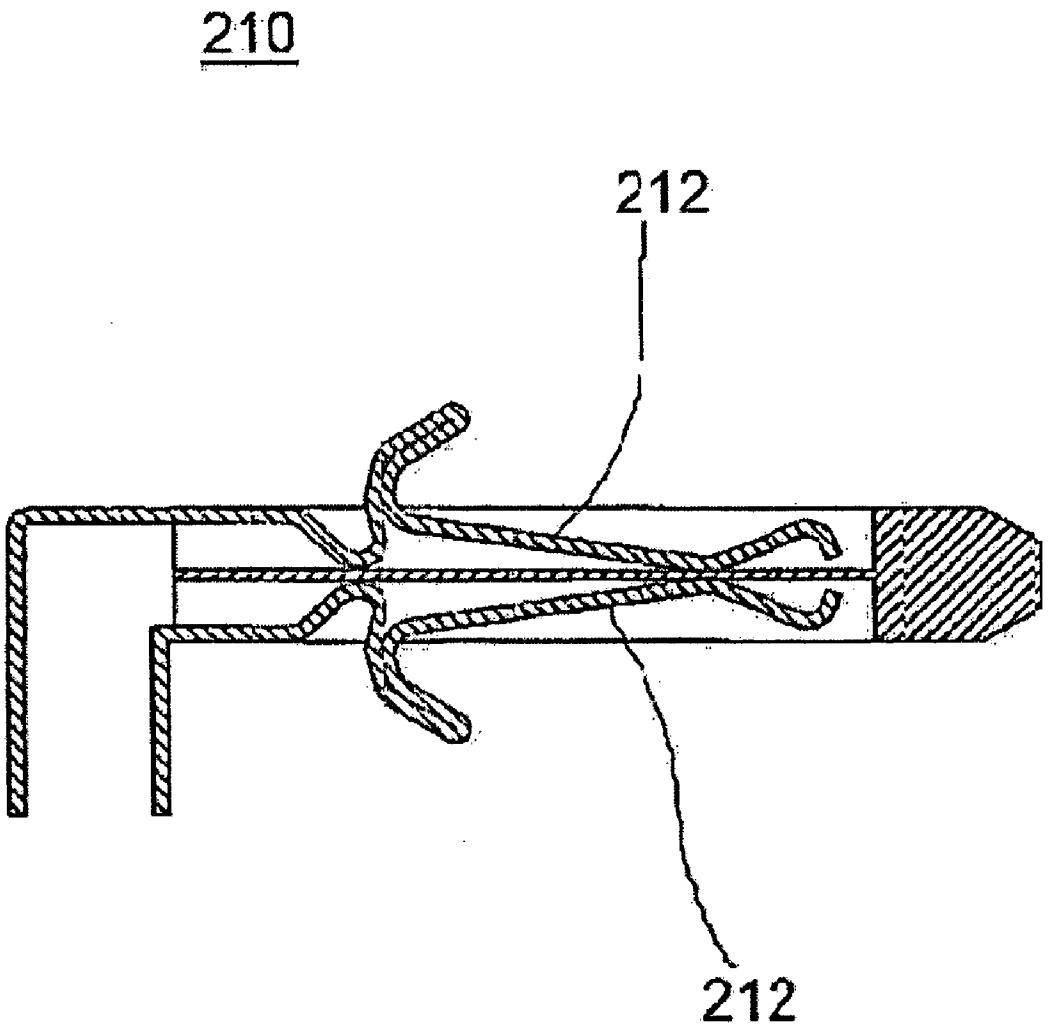
FIG. 7*c* is a sectional view through line C—C of FIG. 7*b;*

Reference is now made to FIGS. 7*a*–*c*. FIG. 7*a* is an isometric view of a reversible receptacle 210 that is constructed and operable in accordance with a third alternate embodiment of the present invention. FIG. 7*b* is a plan view of reversible receptacle 210 of FIG. 7*a*. FIG. 7*c* is a sectional view through line C—C of FIG. 7*b*. Reversible receptacle 210 is substantially the same as reversible plug 74 except that reversible receptacle 210 has selectively raisable contacts 212 on both sides of reversible receptacle 210 using a mechanism similar to the contact raising mechanism described above. Additionally, reversible receptacle 210 does not have flexible surface projections included with reversible plug 74.

Figure 7D:
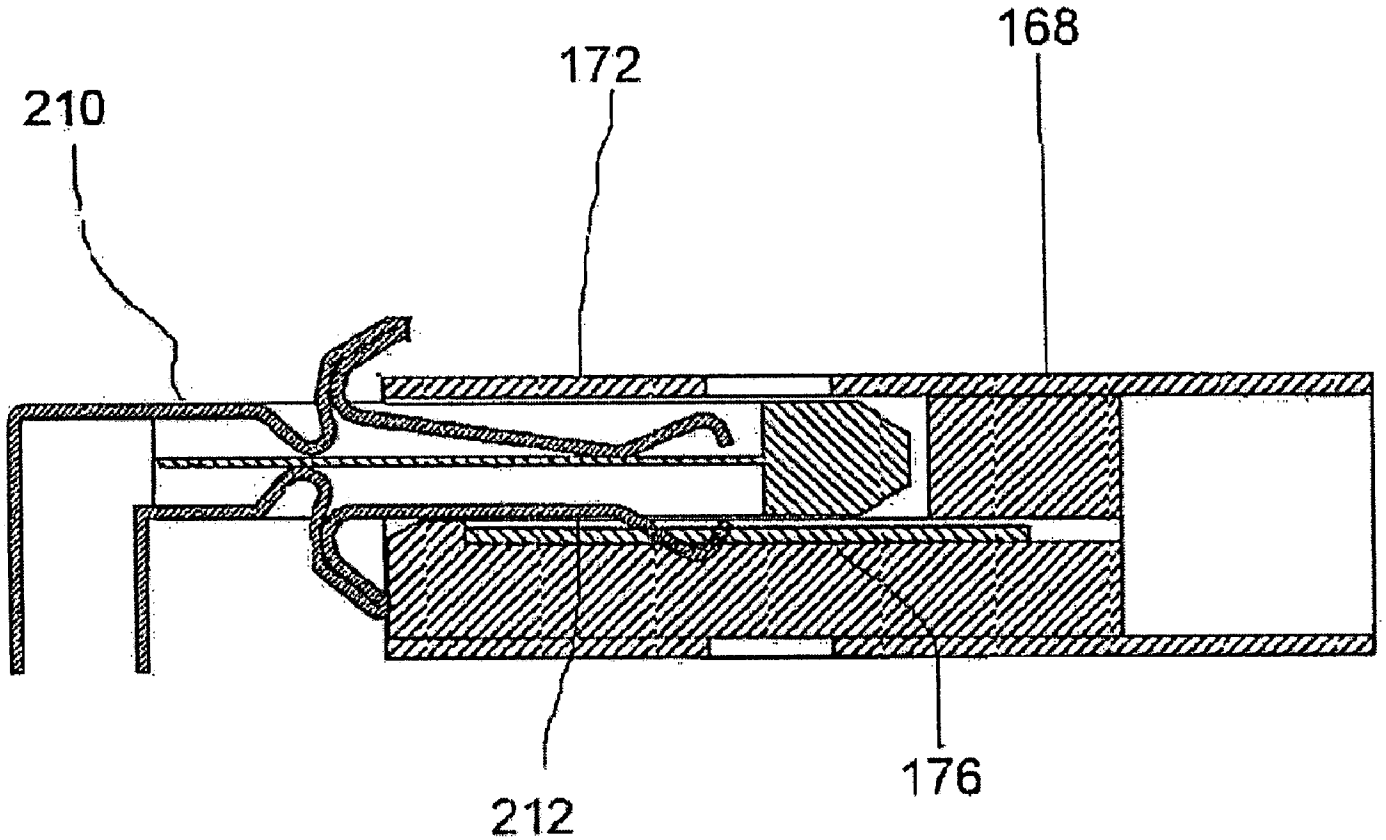
FIG. 7*d* is a sectional view of the receptacle of FIG. 7*c* coupled with an A-type USB standard plug.

Reference is now made to FIG. 7*d*, which is a sectional view of reversible receptacle 210 of FIG. 7*c* coupled with A-type USB standard plug 168. FIG. 7*d* shows a first coupling orientation of reversible receptacle 210 with A-type USB standard plug 168. The lower raisable contacts 212 are deflected away from the interface element of reversible receptacle 210 in order to make contact with electrical contacts 176 of A-type USB standard plug 168. The upper raisable contacts 212 remain recessed in the interface element of reversible receptacle 210 to prevent shorting with shield 172 of A-type USB standard plug 168.

Figure 8A:
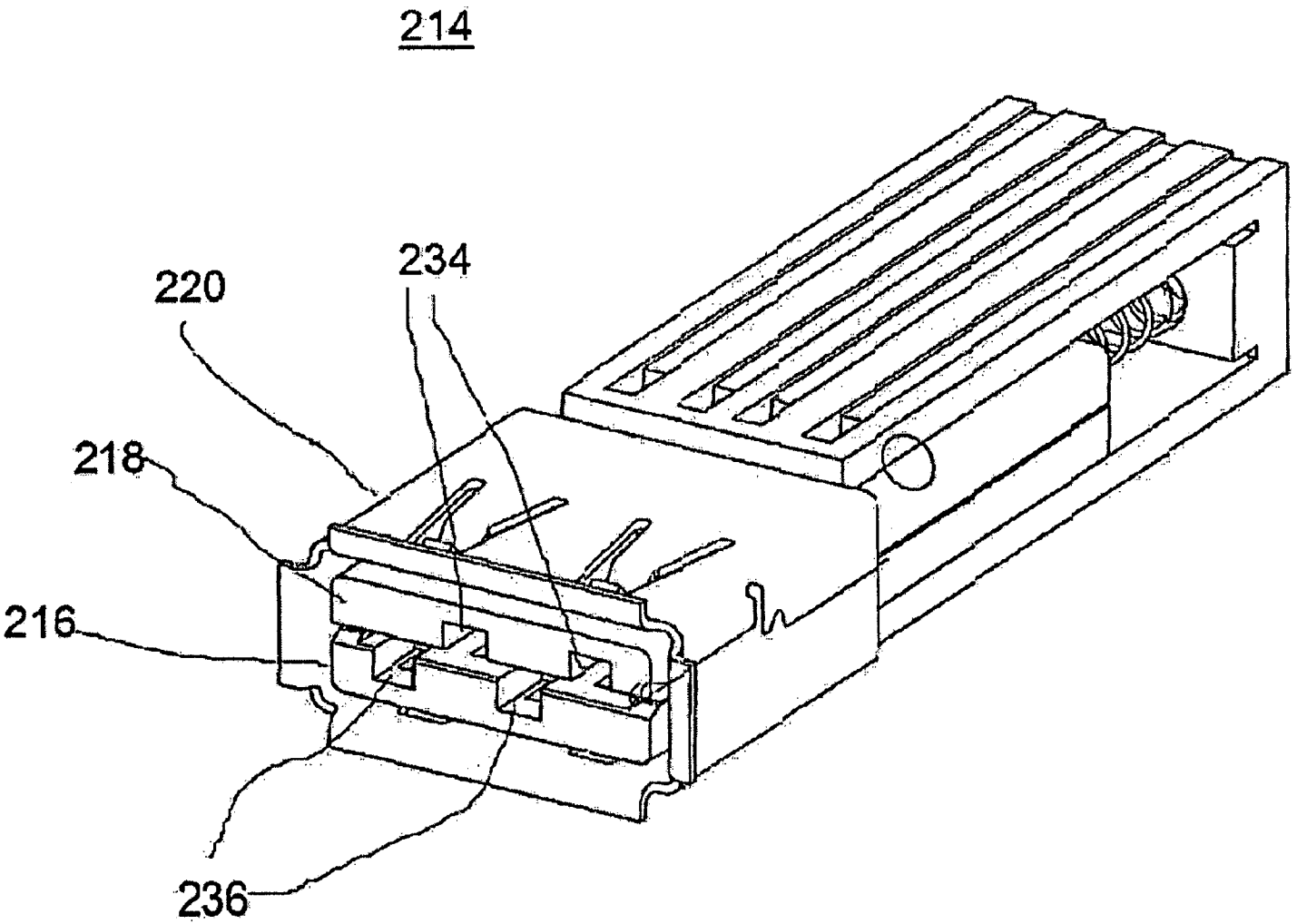
FIG. 8*a* is an isometric view of a reversible receptacle that is constructed and operable in accordance with a fourth alternate embodiment of the present invention.
Figure 8B:
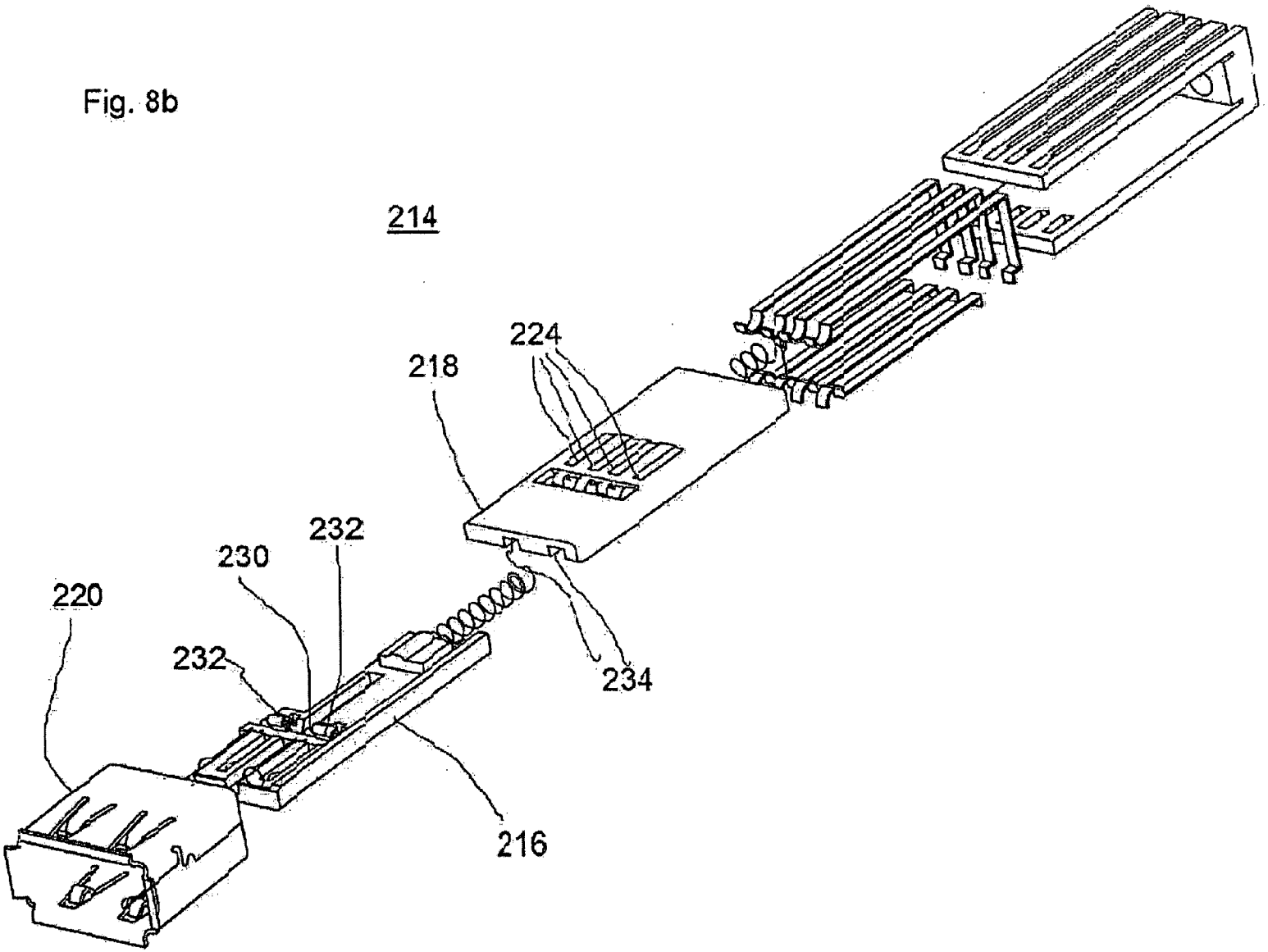
FIG. 8*b* is an exploded isometric view of the receptacle of FIG. 8*a;*
Figure 8C:
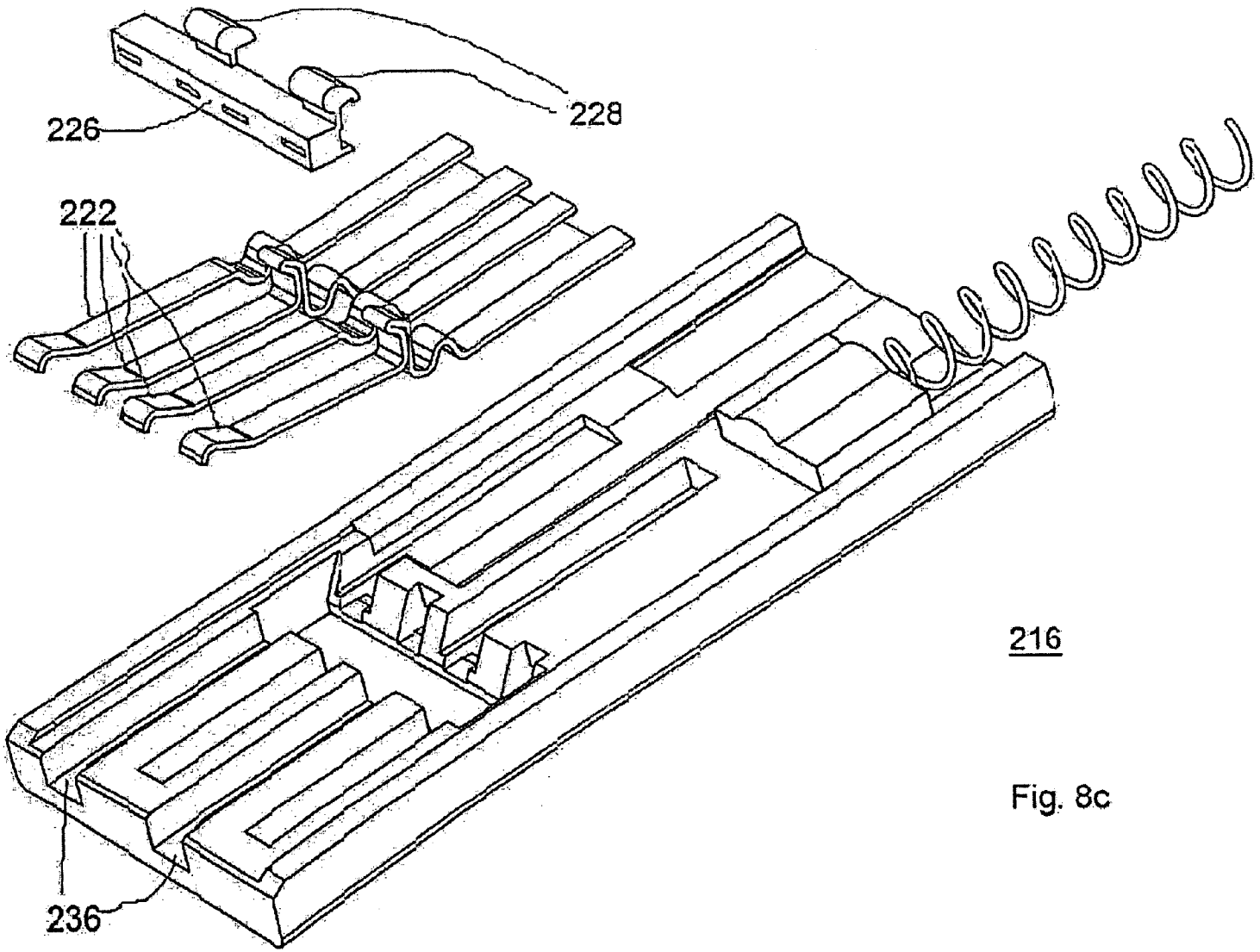
FIG. 8*c* is an exploded isometric view of the lower block of the receptacle of FIG. 8*b;*

Reference is now made to FIGS. 8*a*–8*c*. FIG. 8*a* is an isometric view of a reversible receptacle 214 that is constructed and operable in accordance with a fourth alternate embodiment of the present invention. FIG. 8*b* is an exploded isometric view of reversible receptacle 214 of FIG. 8*a*. FIG. 8*c* is an exploded isometric view of a lower block 216 of reversible receptacle 214 of FIG. 8*b*. Reversible receptacle 214 is substantially the same as reversible plug 90 of FIGS. 4*a*–4*g* except for the following differences described below and shown in FIGS. 8*a* to 8*g*. Reversible receptacle 214 has a sleeve 220 which is the same as sleeve 148 of FIG. 5*a*. As sleeve 220 is shorter than sleeve 92 of reversible plug 90, rectangular openings 140 disposed in reversible plug 90 are not needed in sleeve 220. Additionally, as reversible receptacle 214 couples with the flat electrical contacts 176 of A-type USB standard plug 168, the contacts of reversible receptacle 214 need to be raisable. Reversible receptacle 214 includes lower block 216 and an upper block 218. Lower block 216 has a set of four recessed electrical contacts 222 with loops. Upper block 218 has a set of four recessed electrical contacts 224 with loops. The loops of electrical contacts 222 are mechanically connected via an insulating element 226 having two actuating levers 228 thereon. Actuating levers 228 are configured to be pushed by A-type USB standard plug 168 when reversible receptacle 214 and A-type USB standard plug 168 are coupled in order to raise electrical contacts 222. Similarly, electrical contacts 224 are connected via an insulting element 230 having two actuating levers 232 thereon. Upper block 218 includes two grooves 234 disposed between the grooves of electrical contacts 224 to accommodate actuating levers 228 of electrical contacts 222 of lower block 216 during relative movement of lower block 216 and upper block 218. Similarly, lower block 216 includes two grooves 236 disposed between the grooves of electrical contacts 222 to accommodate actuating levers 232 of electrical contacts 224 of upper block 218 during relative movement of lower block 216 and upper block 218.

Figure 8D:
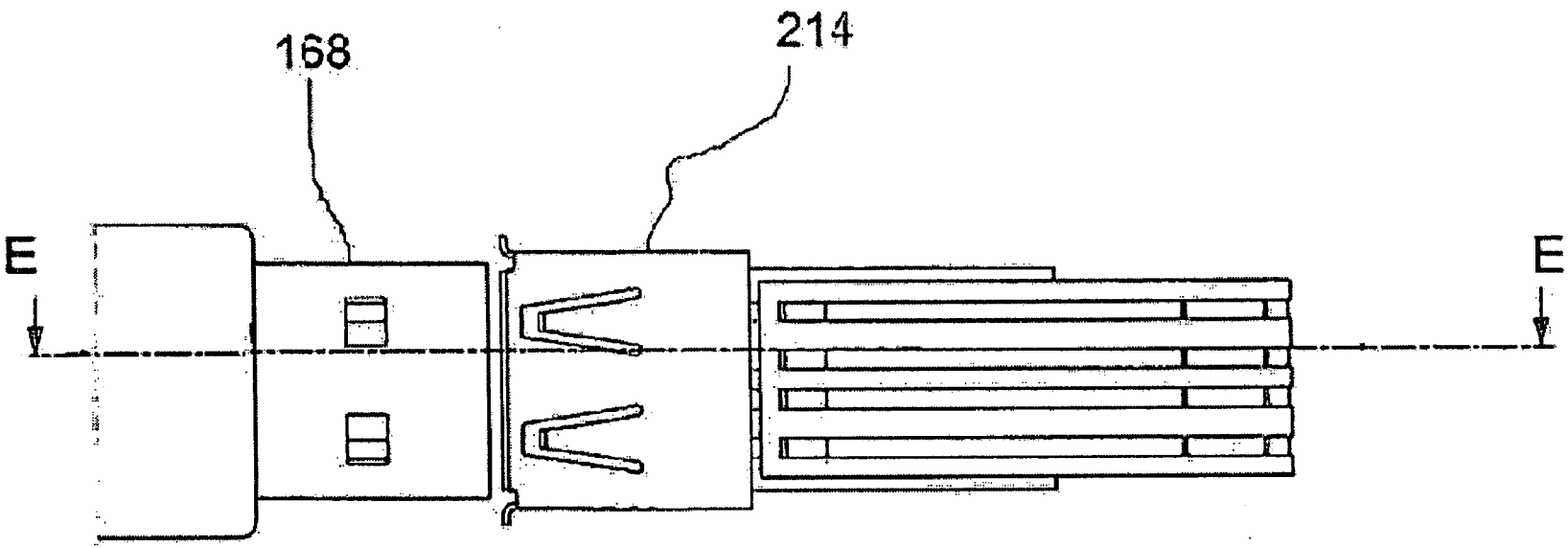
FIG. 8*d* is a plan view of the receptacle of FIG. 8*a* making contact with an A-type USB standard plug.
Figure 8E:
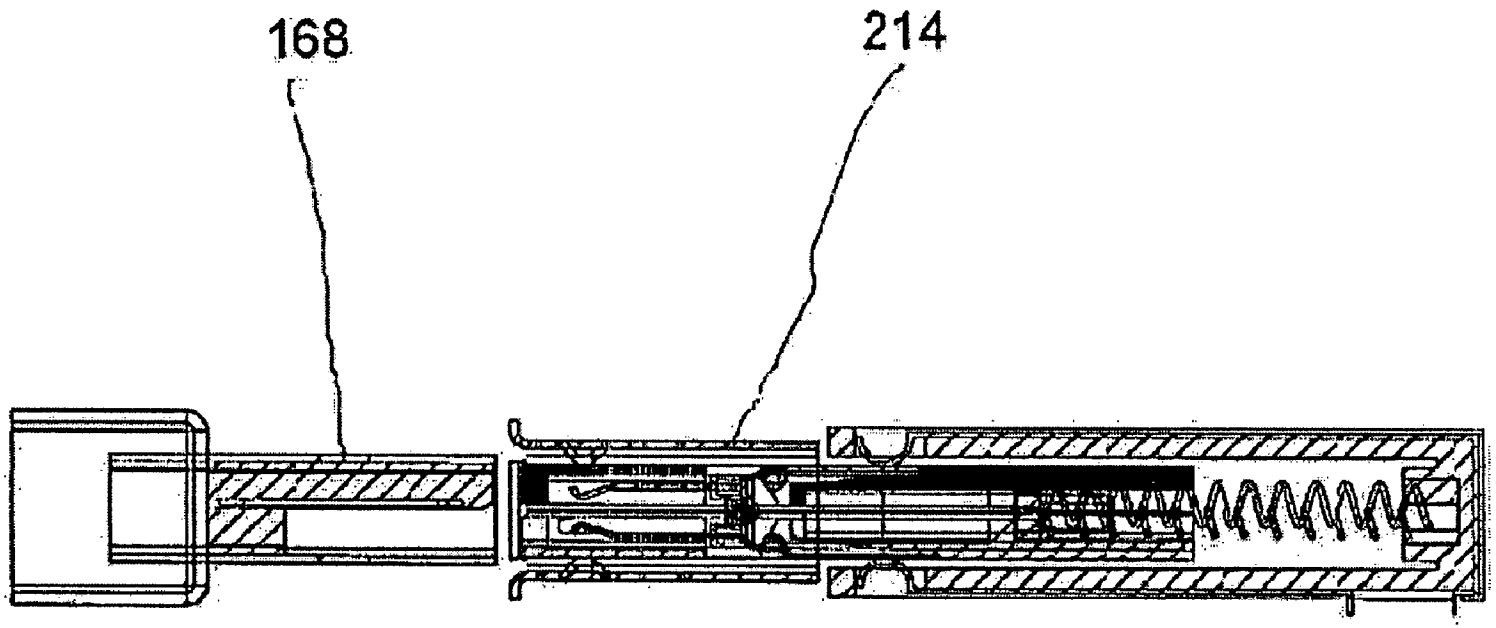
FIG. 8*e* is a sectional view through line E—E of FIG. 8*d;*

Reference is now made to FIGS. 8*d–e*. FIG. 8*d* is a plan view of reversible receptacle 214 of FIG. 8*a* making contact with A-type USB standard plug 168. FIG. 8*e* is a sectional view through line E—E of FIG. 8*d*.

Figure 8F:
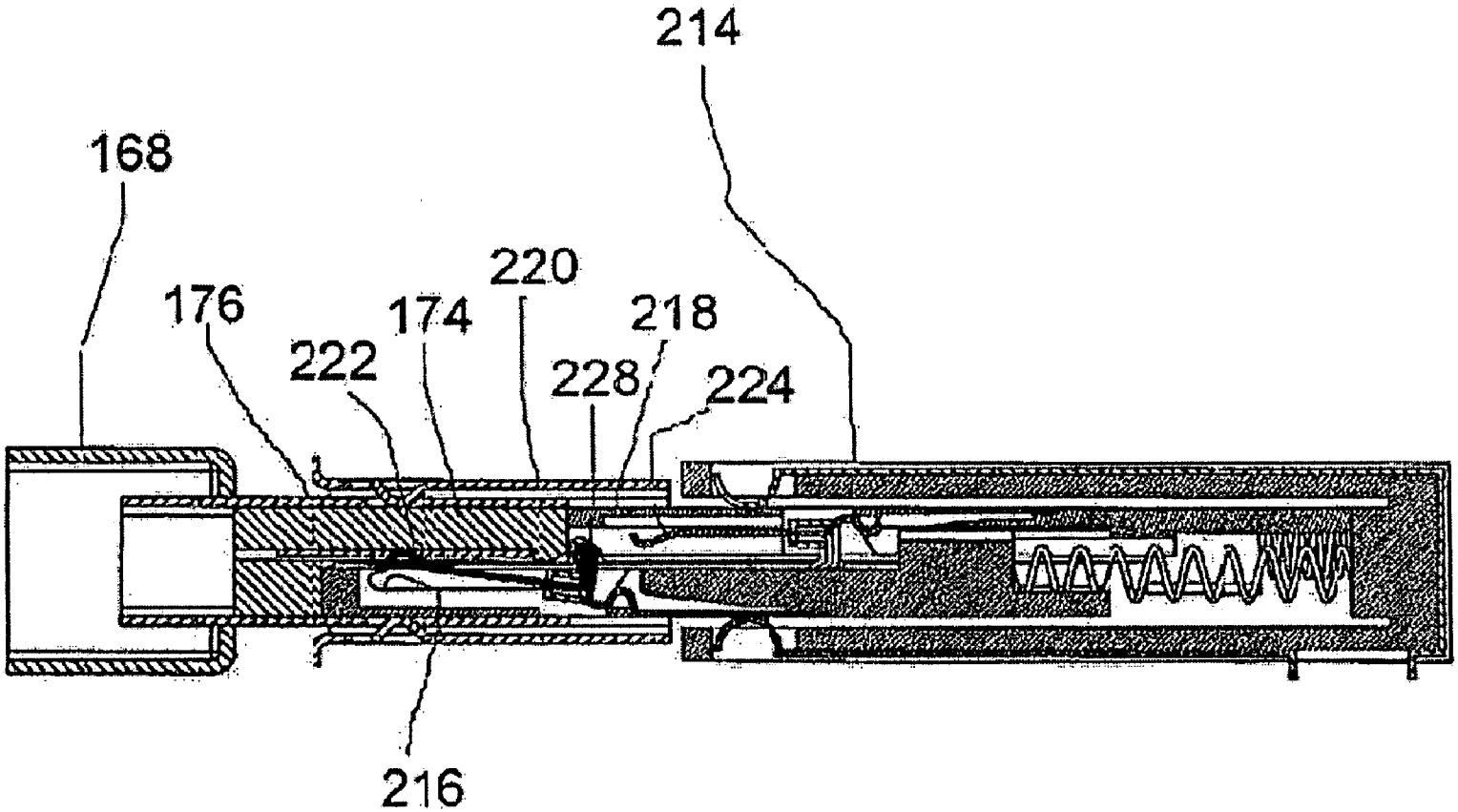
FIG. 8*f* is a sectional view of the receptacle and plug of FIG. 8*d*, fully coupled.
Figure 8G:
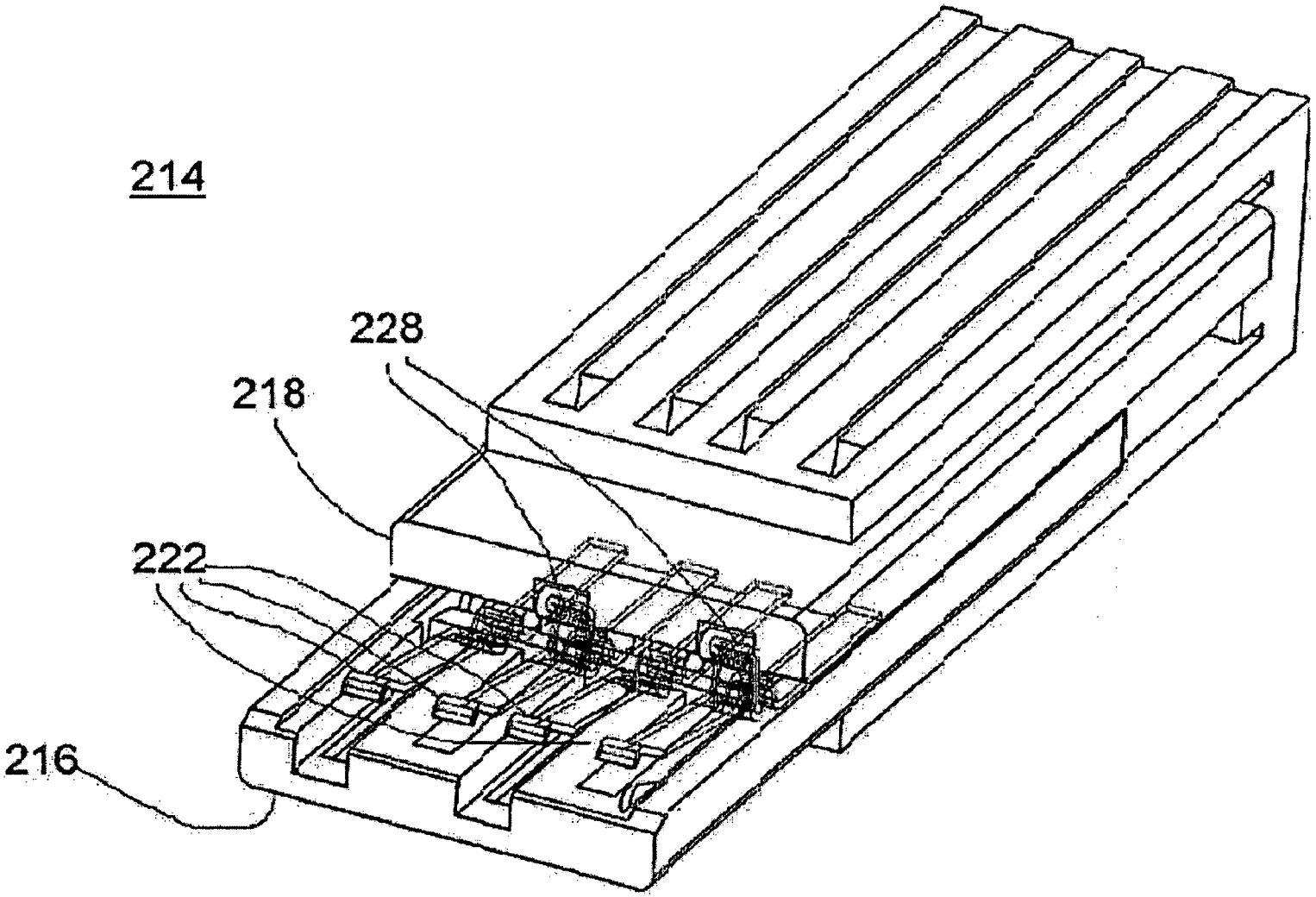
FIG. 8*g* is an isometric view of the receptacle of FIG. 8*f* (having its shield removed for clarity) when fully coupled with the plug of FIG. 8*f*, the plug being removed for clarity.

Reference is now made to FIGS. 8*f* and 8*g*. FIG. 8*f* is a sectional view of reversible receptacle 214 and A-type USB standard plug 168 of FIG. 8*d*, fully coupled. FIG. 8*g* is an isometric view of reversible receptacle 214 of FIG. 8*f* (having sleeve 220 removed for clarity) when fully coupled with A-type USB standard plug 168 of FIG. 8*f*, A-type USB standard plug 168 being removed for clarity. FIGS. 8*f* and 8*g* show a first coupling orientation of reversible receptacle 214 and A-type USB standard plug 168. Upper block 218 has been pushed back to the retracted position by block 174 of A-type USB standard plug 168. Additionally, block 174 pushes actuating levers 228 which raises electrical contacts 222 away from lower block 216 so that electrical contacts 222 makes mechanical and electrical contact with electrical contacts 176 of A-type USB standard plug 168.

Similarly, in a second coupling orientation electrical contacts 224 are raised away from upper block 218 so that electrical contacts 224 make contact with electrical contacts 176 of A-type USB standard plug 168.

Figure 10:
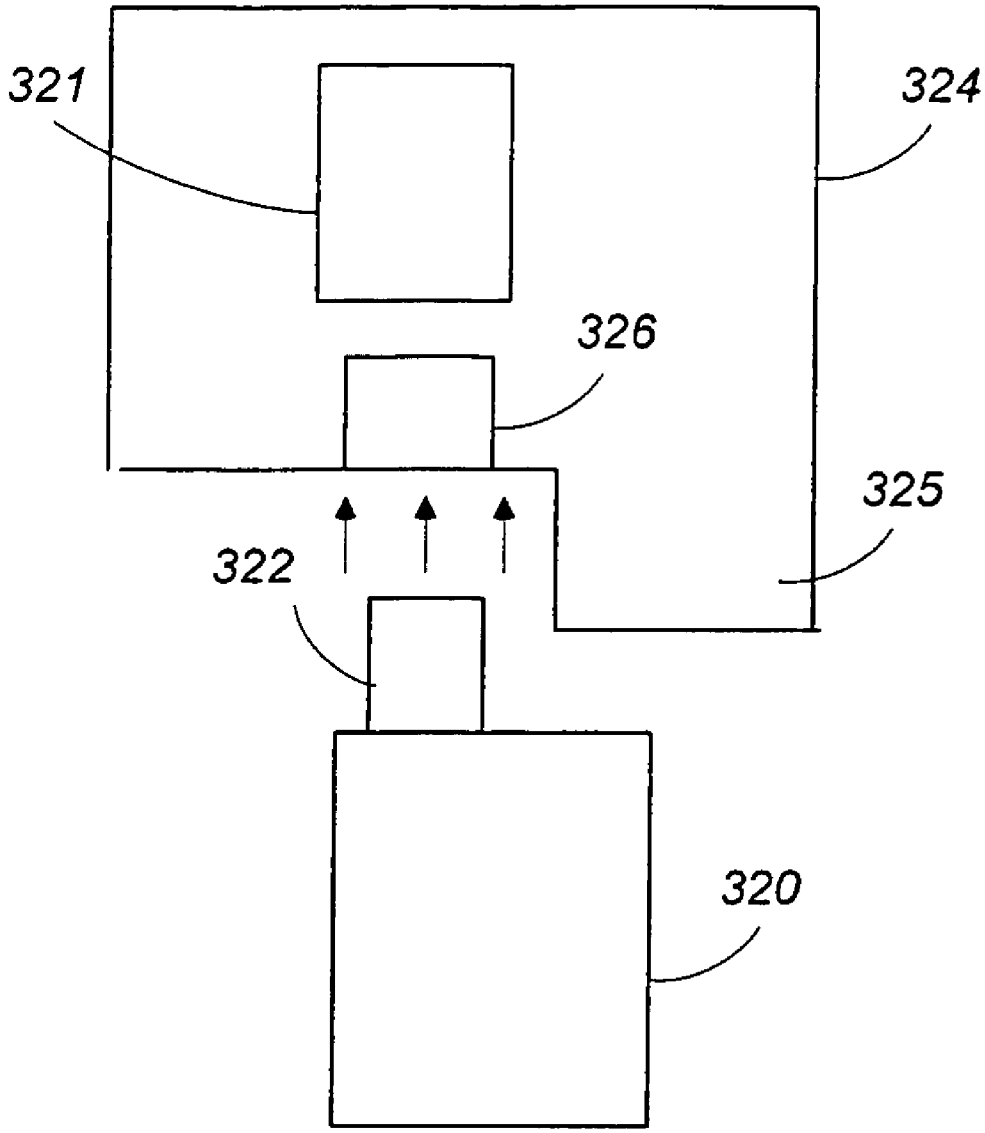
FIG. 10 is a generic schematic representation of an appliance which incorporates a reversible receptacle that is constructed in accordance with a preferred embodiment of the current invention.

Referring now to FIG. 10, a schematic block diagram depicting an appliance incorporating a reversible USB receptacle with relation to a device containing a standard USB plug. Reversible USB appliance 324 includes functional unit 321. Functional unit 321 is configured to perform at least one function, a non-limiting example of which is performing mathematical operations. Appliance 324 further contains a reversible USB receptacle 326 which is connected to functional unit 321 and is used for interconnecting functional unit 321 with USB device 320. Reversible receptacle 326 conforms with any of the above mentioned embodiments or one of their possible derivatives. Reversible USB appliance 324 also consists of a body 325, serving as a physical encasement and housing for functional unit 321. Reversible receptacle 326 is typically rigidly joined to body 325 of reversible USB appliance 324. USB device 320 contains a standard USB plug 322, which is to be coupled with reversible USB receptacle 326. Appliance 324 allows the coupling of USB device 320 in two coupling orientation, thus creating the same advantageous effect of alternate coupling as has been described in reference to FIGS. 9*a–*9*h*.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claimed is:

1. A reversible connector for coupling with a USB A-type standard connector, the standard connector having a hollow section, a fixed set of four electrical contacts disposed on one side of the hollow section and an electrically conducting shield disposed on three sides of the hollow section, the reversible connector comprising:

(a) a first block having a first set of four electrical contacts deployed for mechanical connection to the set of electrical contacts of the standard connector when the reversible connector is in a first coupling orientation relative to the standard connector;

(b) a second block having a second set of four electrical contacts deployed for mechanical connection to the set of electrical contacts of the standard connector when the reversible connector is in a second coupling orientation relative to the standard connector;

wherein said first and second blocks are slidably mounted adjacent to each other and configured for independently sliding between an operative position and a retracted position such that, when the reversible connector is engaged with the standard connector in the first coupling orientation, said second block slides to said retracted position and said first block assumes said operative position for insertion into the hollow section of the standard connector, and when the reversible connector is engaged with the standard connector in the second coupling orientation, said first block slides to said retracted position and said second block assumes said operative position for insertion into the hollow section of the standard connector.

2. The reversible connector of claim 1, wherein the reversible connector is a plug and the standard connector is a USB A-type receptacle.

3. The reversible connector of claim 1, wherein the reversible connector is a receptacle and the standard connector is a USB A-type plug.

4. The reversible connector of claim 1, further comprising a conductive sleeve, wherein said first and second blocks are slidingly mounted within said sleeve.

5. The connector of claim 1, further comprising a restoring arrangement configured for restoring said blocks to said operative position.

6. The connector of claim 5, wherein said restoring arrangement includes two helical springs, said blocks having a width and a thickness, each of said helical springs having an outside diameter greater than said thickness.

7. The connector of claim 1, wherein each of said blocks include a plurality of grooves, said first set of electrical contacts and said second set of electrical contacts being recessed in said grooves.

8. The connector of claim 1, further comprising a housing having a set of electrical terminals disposed therein, said set of electrical terminals and said first set of electrical contacts being configured such that:

(a) said set of electrical terminals makes electrical contact with said first set of electrical contacts when said first block is in said operative position; and (b) said set of electrical terminals is electrically isolated from said first set of electrical contacts when said first block is in said retracted position.

9. The connector of claim 1, further comprising a contact raising arrangement configured for:

(a) raising said first set of contacts away from said first block in said first coupling orientation, so that said first set of contacts makes mechanical contact with the set of electrical contacts of the standard connector; and (b) raising said second set of contacts away from said second block in said second coupling orientation, so that said second set of contacts makes mechanical contact with the set of electrical contacts of the standard connector.

10. The connector of claim 9, further comprising a first lever arrangement and a second lever arrangement, said first lever arrangement being mechanically connected to said first set of contacts, said second lever arrangement being mechanically connected to said second set of contacts, said first lever arrangement and said second lever arrangement being configured to raise said first set of contacts and said second set of contacts, respectively, in response to actuation by the standard connector.

11. The connector of claim 10, wherein said first block has at least one groove therein configured to accommodate at least part of said first lever arrangement during relative movement of said first block and said second block, and wherein said second block has at least one groove therein configured to accommodate at least part of said second lever arrangement during relative movement of said first block and said second block.

12. A reversible plug for coupling with a USB A-type standard receptacle, the standard receptacle having a hollow section, a fixed set of four electrical contacts disposed on one side of the hollow section and an electrically conducting shield disposed on three sides of the hollow section, the reversible plug comprising:

(a) a first block having a first set of four electrical contacts deployed for mechanical connection to the set of electrical contacts of the standard receptacle when the reversible plug is in a first coupling orientation relative to the standard receptacle;

(b) a second block having a second set of four electrical contacts deployed for mechanical connection to the set of electrical contacts of the standard receptacle when the reversible plug is in a second coupling orientation relative to the standard receptacle;

wherein said first and second blocks are slidably mounted adjacent to each other and configured for independently sliding between an operative position and a retracted position such that, when the reversible plug is engaged with the standard receptacle in the first coupling orientation, said second block slides to said retracted position and said first block assumes said operative position for insertion into the hollow section of the standard receptacle, and when the reversible plug is engaged with the standard receptacle in the second coupling orientation, said first block slides to said retracted position and said second block assumes said operative position for insertion into the hollow section of the standard receptacle.

13. A reversible receptacle for coupling with a USB A-type standard plug, the standard plug having a hollow section, a fixed set of four electrical contacts disposed on one side of the hollow section and an electrically conducting shield disposed on three sides of the hollow section, the reversible receptacle comprising:

(a) a first block having a first set of four electrical contacts deployed for mechanical connection to the set of electrical contacts of the standard plug when the reversible receptacle is in a first coupling orientation relative to the standard plug;

(b) a second block having a second set of four electrical contacts deployed for mechanical connection to the set of electrical contacts of the standard plug when the reversible receptacle is in a second coupling orientation relative to the standard plug;

wherein said first and second blocks are slidably mounted adjacent to each other and configured for independently sliding between an operative position and a retracted position such that, when the reversible receptacle is engaged with the standard plug in the first coupling orientation, said second block slides to said retracted position and said first block assumes said operative position for insertion into the hollow section of the standard plug, and when the reversible receptacle is engaged with the standard plug in the second coupling orientation, said first block slides to said retracted position and said second block assumes said operative position for insertion into the hollow section of the standard plug.

* * * * *